US006513906B1

(12) United States Patent
Tanaka et al.

(10) Patent No.: US 6,513,906 B1
(45) Date of Patent: Feb. 4, 2003

(54) RECORDING APPARATUS AND RECORDING METHOD

(75) Inventors: Hideki Tanaka, Yokohama (JP); Yasuyuki Tamura, Yokohama (JP); Hiroto Takahashi, Yokohama (JP); Shinji Takagi, Kawasaki (JP); Makoto Shioya, Tokyo (JP); Masayoshi Tachihara, Chofu (JP); Tatsuo Kimura, Kawasaki (JP); Jun Ashiwa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 07/893,071

(22) Filed: Jun. 3, 1992

(30) Foreign Application Priority Data

| | | |
|---|---|---|
| Jun. 6, 1991 | (JP) | 3-135110 |
| Jun. 7, 1991 | (JP) | 3-136576 |
| Apr. 23, 1992 | (JP) | 4-104356 |

(51) Int. Cl.[7] ..... B41J 2/15
(52) U.S. Cl. ..... 347/41; 347/41
(58) Field of Search ..... 347/41, 40, 15, 347/12, 16, 9

(56) References Cited

U.S. PATENT DOCUMENTS

| | | | | |
|---|---|---|---|---|
| 4,302,701 A | | 11/1981 | Yamamoto | 346/75 |
| 4,312,005 A | | 1/1982 | Iwasaki | 346/75 |
| 4,313,124 A | | 1/1982 | Hara | 346/140 R |
| 4,401,991 A | | 8/1983 | Martin | 346/75 |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,686,538 A | * | 8/1987 | Kouzato | 347/15 |
| 4,723,129 A | | 2/1988 | Endo et al. | 346/1.1 |
| 4,740,796 A | | 4/1988 | Endo et al. | 346/1.1 |
| 4,914,483 A | * | 4/1990 | Paxon | 399/305 |
| 4,920,355 A | * | 4/1990 | Katerberg | 347/41 |
| 4,965,593 A | * | 10/1990 | Hickman | 347/41 X |
| 4,989,016 A | * | 1/1991 | Gatten et al. | 347/9 X |
| 5,012,257 A | | 4/1991 | Lowe et al. | 346/1.1 |

FOREIGN PATENT DOCUMENTS

| | | | | |
|---|---|---|---|---|
| EP | 376596 | | 7/1990 | B41J/2/05 |
| JP | 54-56847 | | 5/1979 | B41M/5/26 |
| JP | 59123670 | | 7/1984 | B41J/3/04 |
| JP | 59138461 | | 8/1984 | B41J/3/04 |
| JP | 60-71260 | | 4/1985 | B41J/3/04 |
| JP | 60208251 | | 10/1985 | |
| JP | 63-254051 | | 10/1988 | |
| JP | 1-242259 | * | 9/1989 | 347/15 |
| JP | 4361054 | | 12/1992 | |

OTHER PUBLICATIONS

Durbeck, Robert C. and Sherr, Sol; "Output Hardcopy Devices", Academic Press, Inc. 1250 Sixth Avenue, San Diago, CA 92101, Copyright 1988, pp. 350–352.*

A.L. Mix, "Interface–Scan Arreys", *IBM Technical Disclosure Bulletin*, vol. 21, No. 10, Mar. 1979, pp. 3947–3948.*

* cited by examiner

*Primary Examiner*—John S. Hilten
*Assistant Examiner*—K. Feggins
(74) *Attorney, Agent, or Firm*—Fitzpatrick, Cella, Harper & Scinto

(57) ABSTRACT

Each of pixels of recorded image is formed by a plurality of dots composed with ink droplets ejected from a plurality of different orifices at individual different main-scannings. With this recording process, the variation of ink ejection characteristics between a plurality of orifices in a recording head can be reduced in forming pixels.

8 Claims, 53 Drawing Sheets

| PIXEL \ SCAN | | 1 | 2 | 3 | 4 |
|---|---|---|---|---|---|
| U00 | I00 | NO.7 | | | |
| | 1/3 | | NO.5 | | |
| | 2/3 | | | NO.3 | |
| U01 | I01 | | | | NO.1 |
| | 1/3 | NO.8 | | | |
| | 2/3 | | NO.6 | | |
| U02 | I02 | | | NO.4 | |
| | 1/3 | | | | NO.2 |
| | 2/3 | NO.9 | | | |
| U03 | I03 | | NO.7 | | |
| | 1/3 | | | NO.5 | |
| | 2/3 | | | | NO.3 |
| U04 | I04 | | | | |
| | 1/3 | | NO.8 | | |
| | 2/3 | | | NO.6 | |

FIG.14

| SCAN NO. \ ORIFICE NO. | 1 | 2 | 3 | 4 | 5 | 6 | 7 | 8 | 9 |
|---|---|---|---|---|---|---|---|---|---|
| 1 | $4\frac{1}{3}$ | $5\frac{2}{3}$ | 7 | $8\frac{1}{3}$ | $9\frac{2}{3}$ | 11 | $12\frac{1}{3}$ | $13\frac{2}{3}$ | 15 |
| 2 | $7\frac{1}{3}$ | $8\frac{2}{3}$ | 10 | $11\frac{1}{3}$ | $12\frac{2}{3}$ | 14 | $15\frac{1}{3}$ | $16\frac{2}{3}$ | 18 |
| 3 | $10\frac{1}{3}$ | $11\frac{2}{3}$ | 13 | $14\frac{1}{3}$ | $15\frac{2}{3}$ | 17 | $18\frac{1}{3}$ | $19\frac{2}{3}$ | 21 |
| 4 | $13\frac{1}{3}$ | $14\frac{2}{3}$ | 16 | $17\frac{1}{3}$ | $18\frac{2}{3}$ | 20 | $21\frac{1}{3}$ | $22\frac{2}{3}$ | 24 |
| 5 | $16\frac{1}{3}$ | $17\frac{2}{3}$ | 19 | $20\frac{1}{3}$ | $21\frac{2}{3}$ | 23 | $24\frac{1}{3}$ | $25\frac{2}{3}$ | 27 |
| 6 | $19\frac{1}{3}$ | $20\frac{2}{3}$ | 22 | $23\frac{1}{3}$ | $24\frac{2}{3}$ | 26 | $27\frac{1}{3}$ | $28\frac{2}{3}$ | 30 |
| 7 | $22\frac{1}{3}$ | $23\frac{2}{3}$ | 25 | $26\frac{1}{3}$ | $27\frac{2}{3}$ | 29 | $30\frac{1}{3}$ | $31\frac{2}{3}$ | 33 |
| 8 | $25\frac{1}{3}$ | $26\frac{2}{3}$ | 28 | $29\frac{1}{3}$ | $30\frac{2}{3}$ | 32 | $33\frac{1}{3}$ | $34\frac{2}{3}$ | 36 |
| 9 | $28\frac{1}{3}$ | $29\frac{2}{3}$ | 31 | $32\frac{1}{3}$ | $33\frac{2}{3}$ | 35 | $36\frac{1}{3}$ | $37\frac{2}{3}$ | 39 |
| 10 | $31\frac{1}{3}$ | $32\frac{2}{3}$ | 34 | $35\frac{1}{3}$ | $36\frac{2}{3}$ | 38 | $39\frac{1}{3}$ | $40\frac{2}{3}$ | 42 |
| 11 | $34\frac{1}{3}$ | $35\frac{2}{3}$ | 37 | $38\frac{1}{3}$ | $39\frac{2}{3}$ | 41 | $42\frac{1}{3}$ | $43\frac{2}{3}$ | 45 |
| 12 | $37\frac{1}{3}$ | $38\frac{2}{3}$ | 40 | $41\frac{1}{3}$ | $42\frac{2}{3}$ | 44 | $45\frac{1}{3}$ | $46\frac{2}{3}$ | 48 |
| 13 | $40\frac{1}{3}$ | $41\frac{2}{3}$ | 43 | $44\frac{1}{3}$ | $45\frac{2}{3}$ | 47 | $48\frac{1}{3}$ | $49\frac{2}{3}$ | 51 |
| 14 | $43\frac{1}{3}$ | $44\frac{2}{3}$ | 46 | $47\frac{1}{3}$ | $48\frac{2}{3}$ | 50 | $51\frac{1}{3}$ | $52\frac{2}{3}$ | 54 |
| ⋮ | ⋮ | ⋮ | ⋮ | ⋮ | ⋮ | ⋮ | ⋮ | ⋮ | ⋮ |

FIG. 15

RECORDING APPARATUS AND RECORDING METHOD

BACKGROUND OF THE INVENTION

1. Field of the Invention

The present invention relates to a recording apparatus and its recording method used as an information output apparatus in word processors, copy machines, facsimiles and so on, and used as a printer connected to a host computer for outputting information from the host computer, and specifically to a recording apparatus and its recording method using a serial type recording head.

2. Description of the Prior Art

Characters and visualized images recorded on recording media such as recording sheets are digitized images generally formed by a set of pixels, each of which has individual gray level data. Each pixel is composed of a dot formed on the recording media by the recording head. As for recording heads for forming dots, a thermal transfer method and an ink jet recording method are widely known. Among them, an ink jet recording method has been widely used in recent years and it has many advantages in enabling relatively high fine-pitched dot formation and high-speed recording.

In expressing gray scale of recorded images with several gray levels, a dot density is assigned to each pixel according to these gray level data, and the dot pattern for each pixel is determined in accordance with the dot density. Definition forms of the dot patterns are categorized into two groups; one refers to a method that a plurality of dots are placed in an identical position in responsive to the dot density, and the other refers to a method that a designated dot pattern is developed with a plurality of dots in responsive to the dot density.

A dot pattern formed in the former method is relatively often used in a recording apparatus with an ink jet recording method. As for the former method, a multi-droplet method is known to be a method that, by forming dots by projecting a plurality of ink droplets ejected from an identical orifice onto a substantially identical position on the recording sheet, the dot density of the pixel can be controlled by changing the number of projected ink droplets.

Therefore, the multi-droplet method is effective for controlling the dot density in the ink jet recording method in which it is difficult to change the size of each ink droplet to a large extent, and effective particularly in a method in which ink droplets may be ejected by shock waves by a bubble generated in an ink fluid by thermal energy. This way of using thermal energy for ejecting ink droplets is effective for recording images with a high dot density and a great many gray-scale levels.

As a single pixel is formed by a plurality of ink droplets ejected from a single orifice in the multi-droplet method, in case that the amount of an ejected ink droplet changes from orifice to orifice and that there are orifices unable to eject ink droplets, shading in the recorded image may occur and the recorded image may contain stripe-noises (banding).

Above problems occur in case of forming a pixel by projecting dots with a designated dot pattern. In order to prevent those problems, in prior art recording head, the manufacturing process of the recording heads must be controlled precisely for reducing variations of the amount of ejected ink droplets from orifice to orifice. As a result, a manufacturing cost may increase and a productivity of recording heads cannot be attained to be a designated level.

As for a software-based method for preventing the shading in the recorded image, what has been known is a method for changing the number of ejected ink droplets so as to compensate the variation of the amount of an ejected ink droplets by image processing such as error diffusion method. However, the cost of the system may be often raised up by installing specific circuits for such image processing.

In addition, even if using such image processing methods, for example, in case that the variation of the amount of ejected ink droplets with respect to orifices changes while the recording apparatus is operated so long time, parameters for specifying the number of ejected ink droplets should be modified in needs, which may lead to the reduction of maintainability and usability of the system.

SUMMARY OF THE INVENTION

An object of the present invention is to provide a recording apparatus and a recording method therein which can eliminate unfavorable recording noise patterns and irregular print patterns by reducing variations among recording characteristics of recording elements by means of establishing a single picture element (or a pixel) by dots formed by a plurality of recording elements.

Another object of the present invention is to provide a recording apparatus and a recording method therein which can eliminate the decrease in the gray level by forming a plurality of dots defining a single pixel at distinctive positions respectively and which can control the gray level by changing the location in which recorded dots are formed.

A further object of the present invention is to provide a recording apparatus and a recording method therein, in case of recording color images, which can eliminate the decrease in the chromaticness of color images and can record color images with high chromaticness.

A further object of the present invention is to provide a recording apparatus and a recording method therein which can obtain recording images with a preferable gray level by controlling the positions of dots in a pixel in responsive to recording conditions and materials of recording media characterized by ink blot rate and so on.

A further object of the present invention is to provide a recording apparatus and a recording method therein which can perform good recording operations even in case that some of a plurality of orifices of a recording head suffer from ejection failures.

In the first aspect of the present invention, a recording method for recording an image with a set of pixels composed of a dot, comprises the steps of:

providing for a recording head having a plurality of recording elements for forming the dot on a recording medium;

allowing a first relative movement between the recording head and the recording medium;

allowing a second relative movement between the recording head and the recording medium, the second relative movement being different from the first relative movement in a direction; and forming a plurality of dots in each of the pixels, a plurality of dots being formed by using an individual different recording element of a plurality of recording elements every the first relative movement so that a plurality of dots are formed in individual different positions in the pixel.

In the second aspect of the present invention, a recording method for recording an image with a set of pixels composed of a dot, comprises the steps of:

providing for a recording head having a plurality of recording elements for forming the dot on a recording medium;

allowing a relative movement between the recording head and the recording medium; and forming a plurality of dots in each of the pixels, a plurality of dots being formed by using an individual different recording element of a plurality of recording elements every the relative movement so that a plurality of dots are formed in individual different positions in the pixel.

In the third aspect of the present invention, a recording apparatus for recording an image with a set of pixels composed of a dot, comprises:

a recording head having a plurality of recording elements for forming the dot on a recording medium;

a first moving means for allowing a first relative movement between the recording head and the recording medium;

a second moving means for allowing a second relative movement between the recording head and the recording medium, the second relative movement being different from the first relative movement in a direction; and a control means for controlling the recording head, the first moving means and the second moving means to form a plurality of dots in each of the pixels, a plurality of dots being formed by using an individual different recording element of a plurality of recording elements every the first relative movement so that a plurality of dots are formed in individual different positions in the pixel.

In the fourth aspect of the present invention, a recording apparatus for recording an image with a set of pixels composed of a dot, comprises:

a recording head having a plurality of recording elements for forming the dot on a recording medium;

a moving means for allowing a relative movement between the recording head and the recording medium; and a control means for controlling the recording head, and the moving means to form a plurality of dots in each of the pixels, a plurality of dots being formed by using an individual different recording element of a plurality of recording elements every the first relative movement so that a plurality of dots are formed in individual different positions in the pixel.

The above and other objects, effects, features and advantages of the present invention will become more apparent from the following description of embodiments thereof taken in conjunction with the accompanying drawings.

BRIEF DESCRIPTION OF THE DRAWINGS

FIG. 14 is a schematic illustration illustrating a relationship among pixels, the number of scanning operations and orifice indices in embodiment 3 of the present invention;

FIG. 15 is a schematic illustration illustrating a content of RAM storing driving data in embodiment 3;

DETAILED DESCRIPTION OF PREFERRED EMBODIMENTS

As will be described, these and other features of the present invention and one embodiment of it are more fully described below in the detailed description and with the accompanying drawings.

Figure 1:
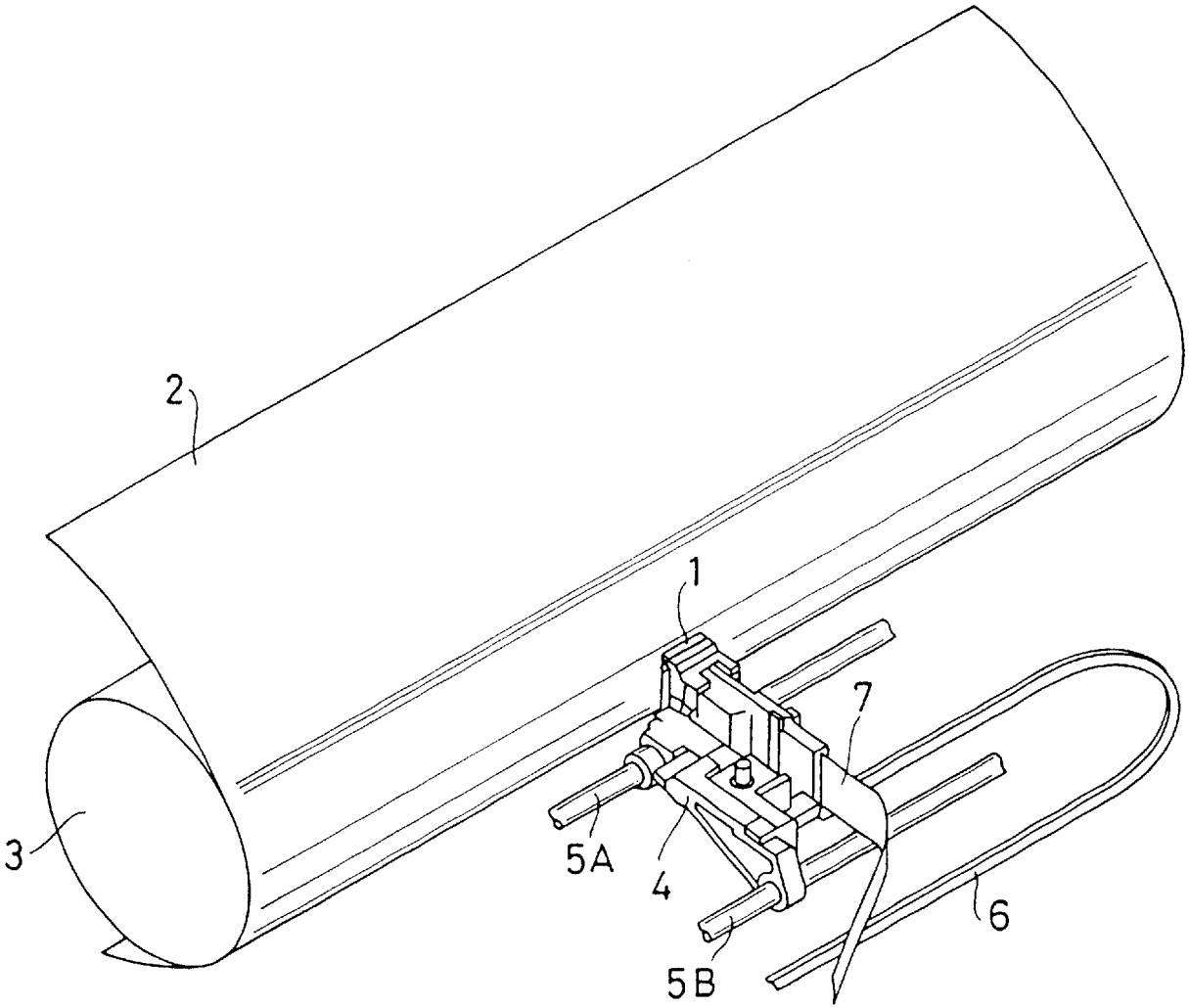
FIG. 1 is a perspective view showing major parts of an ink jet recording apparatus of one embodiment of the present invention.

FIG. 1 is a perspective view showing major parts of an ink jet recording apparatus of one embodiment of the present invention. In FIG. 1, in the recording head 1, for example, 32 orifices with their mutual interval being 70.5 $\mu$m are placed in an array extended in the direction in which the recording paper 2 is fed, this direction designated sub-scanning direction, and in each ink path connecting to each corresponding orifice, installed is a heater for generating thermal energy used for ejecting ink droplets. The heater generates thermal energy in responsive to electric pulses correlated with driving signal data, and film boiling occurs in the ink fluids which leads to generating a bubble and finally to ejection of an ink droplets from the orifice. In this embodiment, the frequency of heater driving signals, that is, the ejection frequency, is 2 kHz.

Incidentally, in embodiments described here and hereinafter of the present invention, term "discharging portion", "outlet" or "nozzle" may be used instead of term "orifice".

A carriage 4 on which a recording head 1 is mounted is supported by a couple of guide shafts 5A and 5B so as to move freely along the guide shafts 5A and 5B. In the following description, this movement of the recording head 1 is called main-scanning and its scanning direction is called main-scanning direction. The carriage 4 is fixed on a part of a belt expanded by pulleys and the carriage 4 is moved by rotational movements of pulleys driven by the motor linked with the pulleys. In FIG. 1, these pulleys and the motor are not shown. An ink tube 6 is connected to the recording head 1, through which the ink fluids can be supplied from an ink tank not shown to the recording head 1. A flexible cable 7 is connected to the recording head 1 which can transmit driving signals corresponding to recording data and control signals from a host apparatus or a control part of the ink jet recording apparatus to a head driving circuit (a head driver). The ink supply tube 6 and the flexible cable 7 are composed of flexible materials so as to follow the movement of the carriage 4.

The longer side of the platen roller 3 is extended in parallel to the guide shafts 5A and 5B and the platen roller 3 is driven by a paper feed motor not shown and used for feeding a recording sheet 2 as recording media and for defining a recording face of the recording sheet 2. In the above described structure, the recording head 1 ejects the ink fluids on the recording face of the recording sheet 2 in front of the orifices of the recording head 1.

Figure 2:
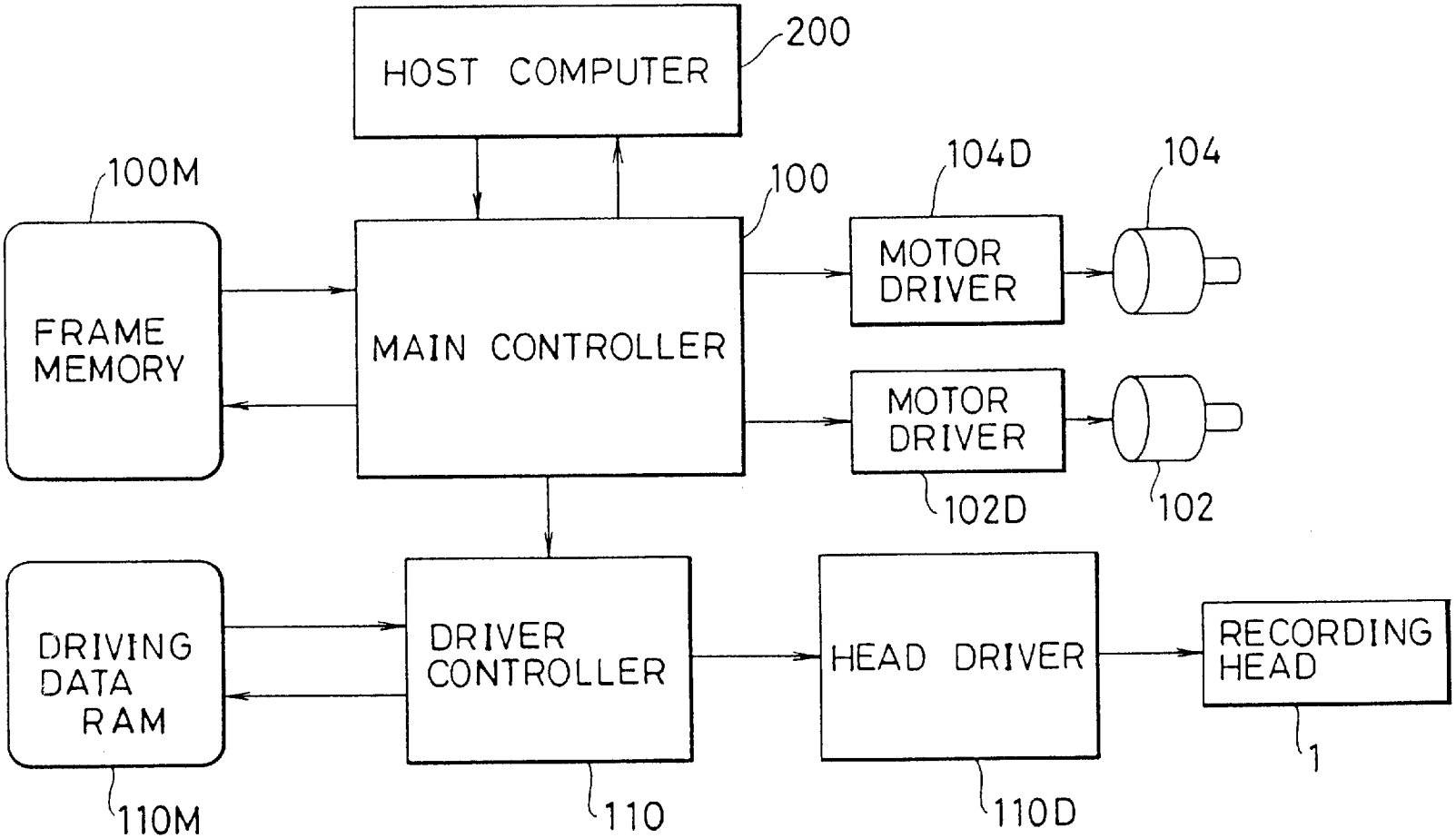
FIG. 2 is a block diagram showing a control structure of an ink jet recording apparatus of one embodiment of the present invention.

FIG. 2 is a block diagram showing a control structure of the ink jet recording apparatus as shown in FIG. 1.

A main controller 100 is composed of CPU and so on, and transfers image data supplied from a host computer 200 into gray level data of each pixel and store the gray level data into the frame memory 100M. The main controller 100 supplies the gray level data of each pixel stored in the frame memory 100M to the driver controller 110 in predetermined timing. As described later with FIG. 15 and so on, the driver controller 110 converts the gray level data supplied from the frame memory 100M into drive data which describes turn-on or turn-off signals to each heater of the recording head 1 and each of which corresponds to a respective orifice index number and a respective scan number. The orifice index number is the order of the orifice array in the recording head and the scan number is the sequential number of iterative main-scanning operations. The drive data converted by the driver controller 110 are stored in the drive data RAM 110M. The driver controller 110 read out the drive data stored in the drive data RAM 110M by referring their orifice index number and scan number in responsive to control signals from the main controller 100, and supplies the read-out drive data into the head driver 110D and controls its driving timing.

In the above described structure, the main controller 100 controls the ink ejection by the recording head 1 and the rotational movements of the carriage drive motor 104 and the paper feed motor 102 through the driver controller 110, the motor driver 104D and the motor driver 102D. So far, characters and graphic images corresponding to input image data are recorded on the recording sheet 2.

In the above described structure, though the driver controller 110 converts the gray level data into the drive data, this conversion may be performed by the main controller 100. In this case, the drive data can be stored in the frame memory 100M and hence, the RAM 110M can be removed.

In the followings, several embodiments of an ink jet recording apparatus in the present invention are described in detail.

Embodiment 1

Principles of this embodiment is described below.

This embodiment is characterized by the following equations and conditions;

$$\{(N-1)q+p\}/s \geqq 2, \quad (1)$$

$$NKp/s \geqq m \quad (2)$$

and $$s/q \text{ and } q/s \text{ are not integers}, \quad (3)$$

where

N is the number of orifices of the recording head, an integer greater than 1, p is the pitch of pixels on the recording medium in the sub-scanning direction, measured by $\mu$m, q is the pitch of orifices, measured by $\mu$m, s is a relative displacement in the sub-scanning direction between the recording head and the recording medium per single scanning operation, in particular to this embodiment, the length of recording sheet feed per single scanning operation, measured by $\mu$m, K is the maximum number of ink droplets per one pixel and per one scanning operation, that is, the maximum number of ink droplets ejected from one orifice for one pixel during single scanning operation, an integer greater than 0, and m is the maximum number of ink droplets to be ejected per one pixel, that is defined by subtracting 1 from the maximum gray levels, an integer greater than 1.

The condition defined by equation (1) is a requirement for all the pixels which define recording images, being capable of being composed by a plurality of dots formed by ink droplets ejected from different orifices by a plurality of scanning operations (two or more scanning operations) of the recording head. This means that the array of orifices of the recording head moving in the sub-scanning direction by s moves {(N−1)q+p}/s times over the length of the array of orifices, (N−1)q, and the width of the single pixel, p, and that, if the number of this movement of the array of orifices is 2 or over, multiple scanning operations can be applied to each pixel and single pixel can be composed of a plurality of dots formed by ink droplets ejected from different orifices.

The condition described in the equation (2) is a requirement for the number of ink droplets enabled to be ejected into a single pixel to be equivalent to the number m, which is calculated by subtracting 1 from the maximum gray level defined, or to be greater than the number m. This condition can be established in the following manner. When the recording head moves in the sub-scanning direction by s, the number of pixels scanned repetitively within this displacement is defined by s/p, and hence, the sum of the maximum number of dots to be projected in the pixels located within this displacement is (s/p)·m. On the other hand, in the repetitive scanning operation in the width s displacement, as each of N orifices of the recording head can eject ink droplets, the sum of the ink droplets projected to pixels located within this width s displacement is NK. So far, the requirement for permitting the maximum number of ink droplets to be projected into one pixel as to be subtracting 1 from the maximum gray levels is the condition defined by (s/p)·m≦NK.

The condition defined by the equation (3) is a requirement for the case that ink droplets from the recording head may not be directed to an identical point on the recording sheet, that is, a pixel composed of a plurality of dots which are located in the different positions each other in the pixel may exist.

Suppose that s=ap and q=bp, the equations (1) to (3) take the following forms;

$$\{(N-1)b+1\}/a \geqq 2, \quad (1)'$$

$$NK/a \geqq m, \quad (2)'$$

and $$a/b \text{ and } b/a \text{ are not integers}. \quad (3)'$$

Let h be defined by [{(N−1)b+1}/a], where [#] is an operator for taking an integer part of the number #. With this notation, the number of repetitive scanning operations for forming a single pixel is defined by h or h+1. If {(N−1)b+1}/a products no remainder, the number of repetitive scanning operations is h. Therefore, in this embodiment, a single pixel is recorded by ejecting ink fluids from h or h+1 different orifices in h or h+1 times scanning operations, which is called main scanning.

As a result, if the amount of ink droplets ejected from orifices is distributed as a normal distribution with the standard deviation σ with respect to orifices, in case of forming a single pixel by a plurality of ink droplets ejected from h or h+1 different orifices, the deviation of the amount of ink droplets projected per single pixel is reduced to $\sigma/\sqrt{h}$ or $\sigma/\sqrt{h+1}$. The deviation of the amount of ink droplets projected to the pixels is recognized as the deviation of the gray levels of pixels. As the deviation of the gray levels of pixels is not necessarily zero but allowed to be smaller enough in order to establish clear recorded images to a certain extent, according to this embodiment, it will be appreciated that clear recorded images, which have less shading than that of prior art systems can be obtained.

The value of h is preferably large enough to reduce the deviation of the gray level of pixels; according to estimations by the authors of the present invention, in case that h=2, recorded images relatively clearer than those by prior art apparatus can be obtained, and in case that h=3, it is proved that extremely clear recorded images can be obtained.

In this embodiment, the maximum number of ink droplets enable to be projected into a single pixel is NKp/s, and in order to record images between 0 and m+1 gray levels, an optimal amount of ink droplets per single pixel is between 0 and m. Therefore, in the case that the equation (2), NKp/s>m is effective in this embodiment, as the total number of ink droplets being capable of being ejected can be taken to be larger than the number of ink droplets to be projected per single pixel, even if some orifices may fail to eject ink droplets or cannot eject enough amount of ink droplets, other well-conditioned orifices can compensate these ejection failures so that recorded images may not be worsen such as striped-noise print.

In addition, according to estimations by the authors of the present invention, it is proved that, in forming a plurality of dots in a single pixel, high optical density of recorded images can be obtained by shifting slightly mutually the positions of projecting ink droplets. In this embodiment, a plurality of dots can be shifted by taking the relative displacement s to be non-integral multiples of the pitch q of orifices and by taking the pitch q of orifices to be non-integral multiples of the relative displacement s.

In the followings, what is explained is a case that a recording apparatus shown in FIGS. 1 and 2 is used with the above described recording method and that the pitch of pixels is 63.5 $\mu$m and three gray levels are used. In this case, the number of ink droplets projected into a single pixel is varied between 0 and 2.

Figure 3:
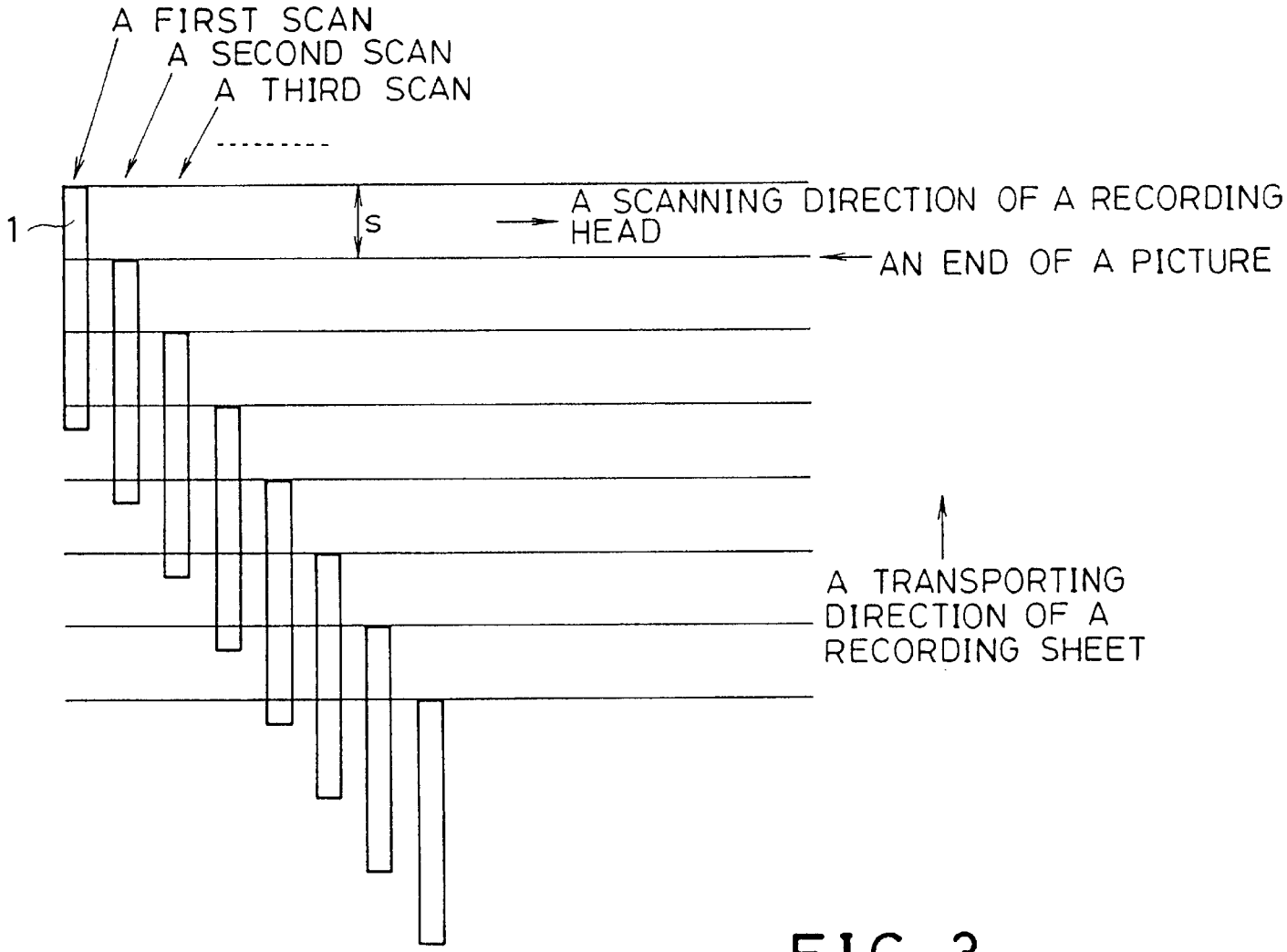
FIG. 3 is a schematic illustration illustrating recording operations of embodiment 1 of the present invention.
Figure 4:
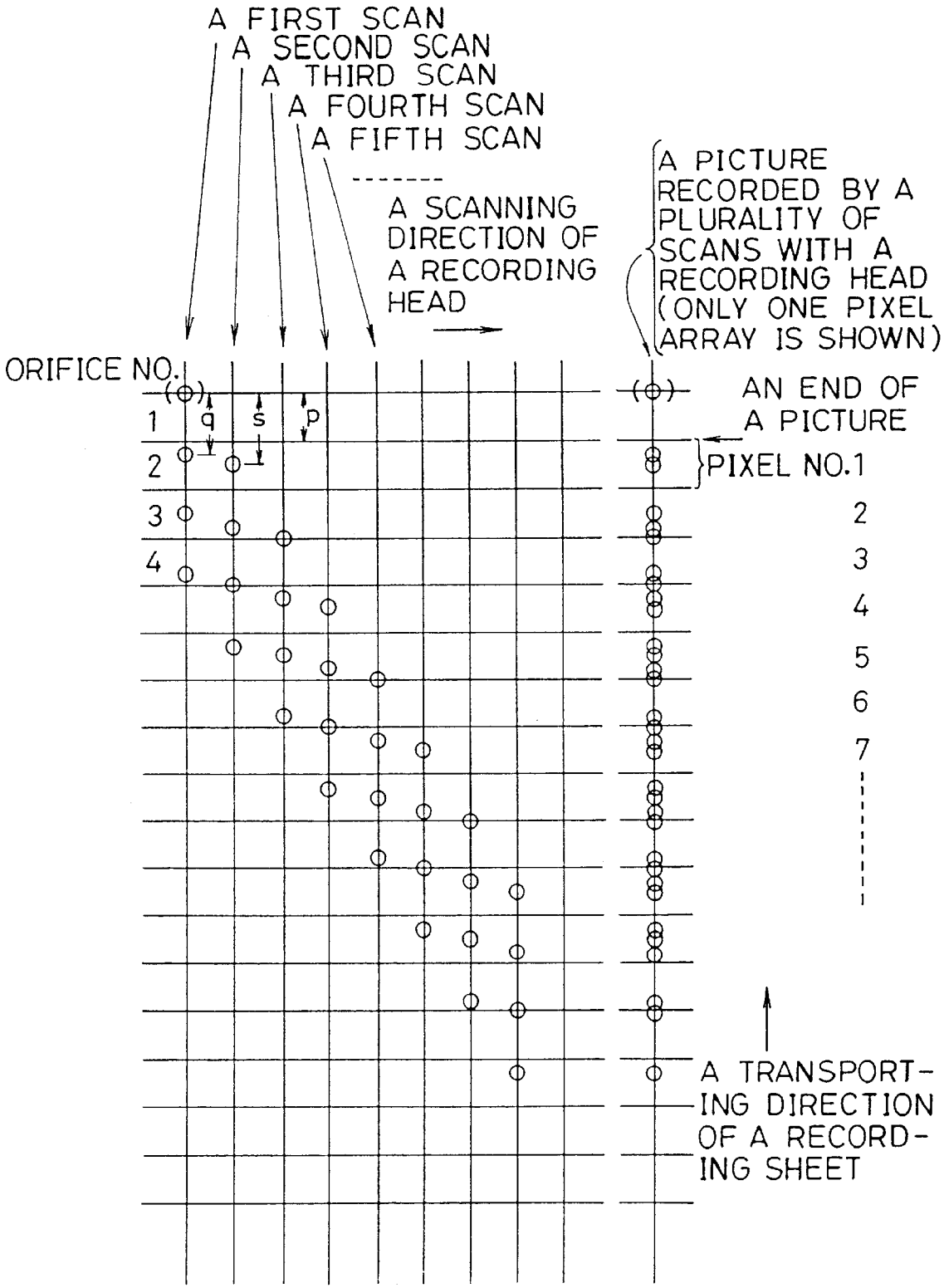
FIG. 4 is a schematic illustration illustrating dot formation of embodiment 1 of the present invention.

FIGS. 3 and 4 are diagrams for explaining recording operations in this embodiment. FIG. 3 illustrates that the recording head 1 moves by a unit transporting displacement s relatively to the recording sheet every scanning operation in order to record information, and FIG. 4 illustrates diagrammatically that shifted dots in each pixel are formed by defining appropriately the displacement s at every scan and the pitch q of orifices in relative to the pixel width (pitch) p. In FIG. 4, although what is shown is limited to be a single pixel array extended in the sub-scanning direction, the other arrays are similarly established by forming dots in each pixel. In FIG. 3, the recording head 1 is illustrated diagrammatically in which four orifices with an identical interval q between adjacent orifices are placed from the top to the bottom in FIG. 3 for explanation. In FIG. 3, four orifices are designated No. 1, 2, 3 and 4 from the top to the bottom. In addition, it is assumed that the number of ink droplets projected in a single pixel at a single scan is 1, that is, K=1.

In recording information on the recording sheet, at first, only three orifices No. 2, 3 and 4 are used for recording while the carriage is moved in the first scan. In the first scan, three pixels No. 1, 2 and 3, which are first three pixels from the upward side of a picture (the recorded images), are recorded with 0 or 1 ink droplet. Dots formed at the pixel boundaries are included in the pixel at the downward side of the recording sheet, which is effective in the following descriptions. Next, the recording sheet is transported by one and a half pixel-units (a=1.5, that is s=1.5p) in the upward direction, and all the four orifices No. 1 to 4 are used for recording in the second scan. In FIGS. 3 and 4, notated is that the recording head is moved in the downward direction relatively to the recording sheet. As the result of the first and second scans, pixels No. 1 and 2 are recorded with the sum of ink droplets being between 0 and 2, and pixels No. 3 and 4 are recorded with the number of ink droplets being 0 or 1. And finally, the recorded sheet is transported again by one and a half pixel-unit in the upward direction, and all the four orifices No. 1 to 4 are used for recording in the third scan. By repeating the first scan to the third scan sequentially for recording information, according to FIG. 4, it is proved that each pixel is composed of dots, the maximum number of which is between 2 and 3. So far, by eliminating one dot projection by adjusting the driving data at the pixel where three dots can be formed, m can be taken to be 2 at each pixel which leads to establishing recorded images which has three gray levels.

In recorded images developed in the above described method, as a single pixel is formed with ink droplets projected from a plurality of different orifices, the deviation of the amount of ink droplets to be projected on pixels can be converged and recorded images without stripe-noises and shading. In addition, when 2 or more ink droplets in all are projected in a single pixel, as the projection positions are shifted slightly at every droplet, each pixel is covered by ink droplets sufficiently and a high optical density can be obtained in forming recorded images.

In the result of several attempts to record various kinds of images with the above described recording method, it is concluded that clear recorded images without stripe-noises and shading can be obtained, in comparison with one of prior art methods where a single pixel is developed by a plurality of ink droplets projected from an identical orifice.

In this embodiment, though the maximum number of dots per single pixel is assumed to be 2, there may be pixels, for example, pixels No. 4 and 5 in FIG. 4, which are defined by recording with 0 to 3 ink droplets, and for these pixels, one orifice is not used for projecting ink droplets, and hence it is not required. Specifically, as found by the detail consideration of FIG. 4, either the orifice No. 2 or the orifice No. 3 may be allowed to fail to eject ink droplets. It may, therefore, be possible that a control part of the recording apparatus judges information on damaged orifices, which could be known during the fabricating process of the recording head and could be stored in ROM or RAM memories in the recording apparatus, so that the control part selects orifices being capable of being used to record operations. In case that, during operating a recording apparatus in which all the orifices are initially well-conditioned, some orifices happen to be damaged and fail to eject ink droplets accidentally, it may be possible that the user or the service person add specific information on the damaged orifices to the RAM memory in the recording apparatus and that operations of the damaged orifices may be replaced by the other well-conditioned orifices.

Embodiment 1A

Figure 5:
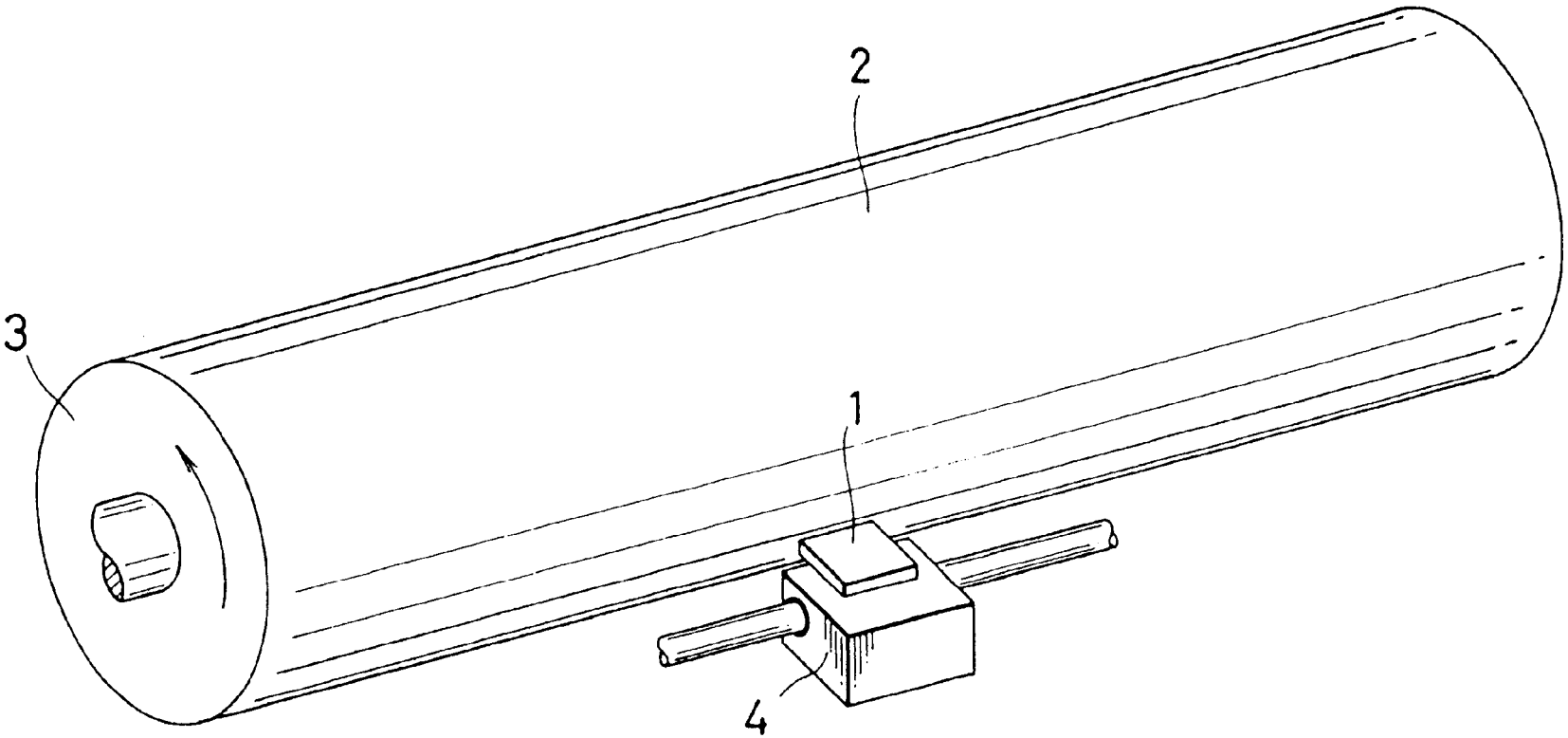
FIG. 5 is a diagrammatic perspective view showing major parts of an ink jet recording apparatus of another embodiment of the present invention.

FIG. 5 is a diagrammatic perspective view of an ink jet recording apparatus of embodiment 1A of the present invention.

The recording head 1 has 5 orifices arranged in the lateral direction in FIG. 5 with the density of 16 orifices per 1 mm. The recording head 1 is mounted on the carriage 4 so as to move along the rail linked to the carriage so that the carriage 4 may move freely. The recording sheet 2 is wrapped around the cylindrical drum 3 and the drum 3 is driven to rotate by a motor not shown. In this structure, the main-scanning operations are performed by the rotational movement of the drum 3. What is explained below is an example of recording information in which the pixel density is 16 pixels per 1 mm and the number of gray levels is 4.

Figure 6:
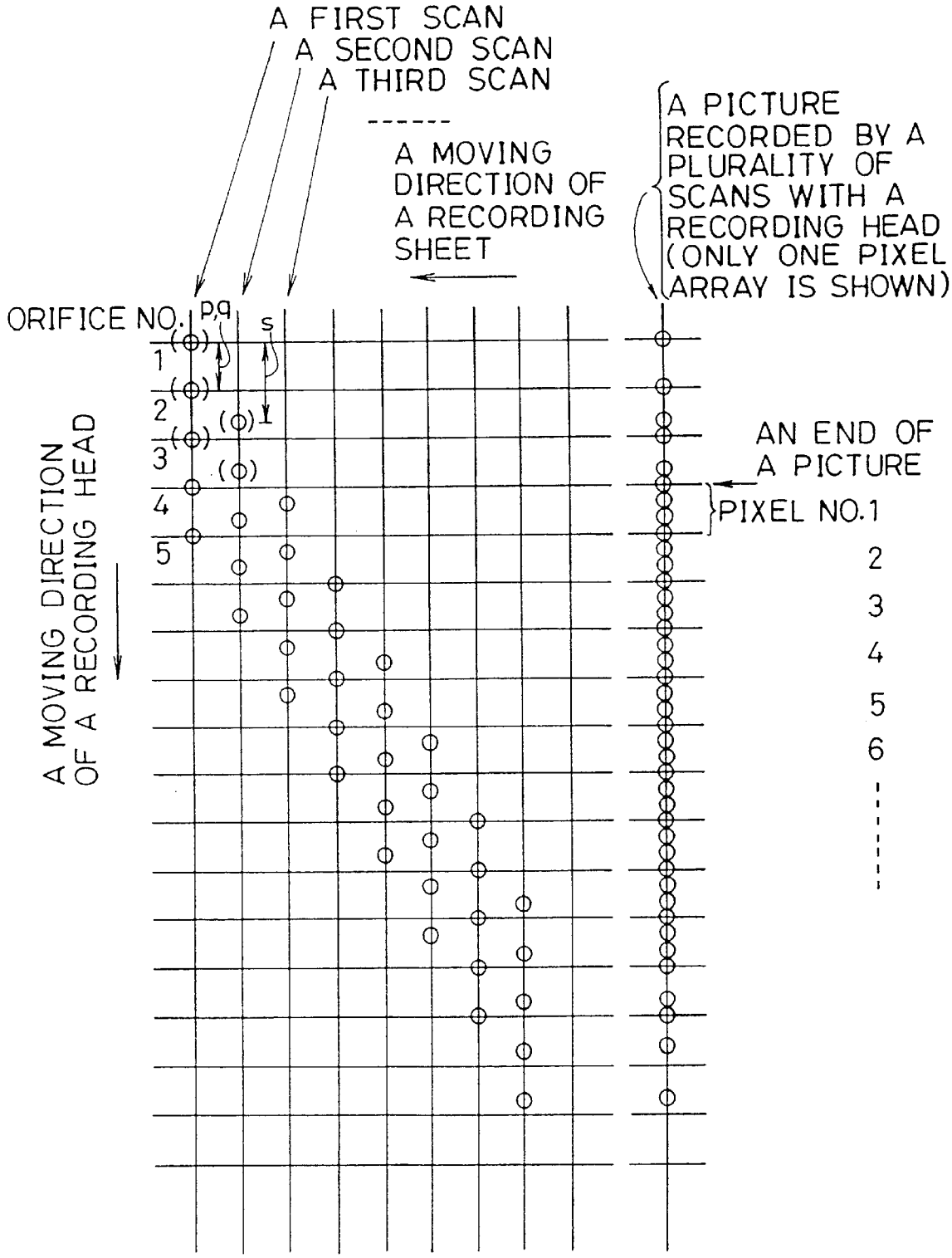
FIG. 6 is a schematic illustration illustrating dot formation of embodiment 1A of the present invention.

FIG. 6 is a diagram illustrating a recording method in this embodiment.

At first, the recording head is located in the right end side of the drum 3 in FIG. 5, and using only two orifices No. 4 and 5, images are recorded on the recording sheet 2 while the drum 3 rotates for 360°. Next, the recording head is moved in the left direction by 5/3 pixel unit (a=5/3), and using three orifices No. 3, 4 and 5, images are recorded on the recording sheet 2 while the drum 3 rotates for 360°. Images are recorded on the whole face of the recording sheet 2 by repeating sequentially the lateral movement of the recording head by 5/3 pixel unit every time after the main-scanning operation while the drum 3 rotates for 360°. As a result, for example, the pixel No. 1 is formed by orifices No. 1, 3 and 4, and images can be recorded with 4 gray levels by using 3 or less number of ink droplets.

In the result of several attempts to record various kinds of images with the above described recording method, it is concluded that clear recorded images without stripe-noises and shading can be obtained.

Embodiment 1B

What is explained below is the case that, using the similar apparatus and recording head to those in the embodiment 1 where the number of orifices is 4 and the pitch q of orifices is 79.4 μm, images are recorded by the different method from that in the embodiment 1. In this embodiment, the pitch p of pixels is 79.4 μm and the number of gray levels is 5.

Figure 7:
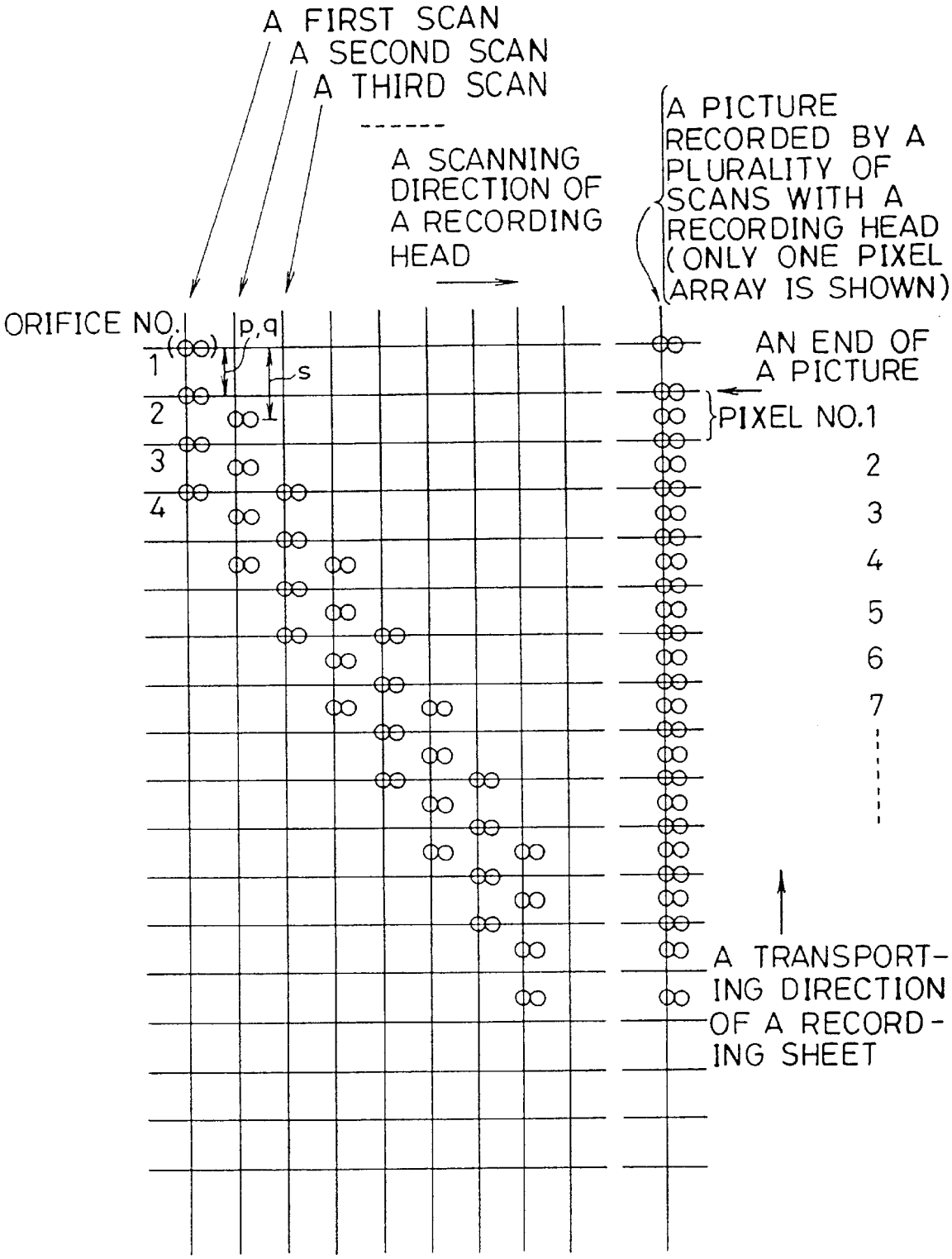
FIG. 7 is a schematic illustration illustrating dot formation of embodiment 1B of the present invention.

FIG. 7 is a diagram illustrating a recording method in this embodiment.

At first, images are recorded using three orifices No. 2, 3 and 4 while the carriage is moved. At this time, 0, 1 or 2 ink droplets are ejected per single pixel in accordance with gray level data. In this embodiment, the maximum number of ink droplets which can be ejected from a single orifice to a single pixel per single scan is 2. (K=2). Next, the recording sheet is moved in the upward direction by 7/4 pixel units (a=7/4), and using four orifices No. 1, 2, 3 and 4, images are recorded on the recording sheet. By repeating this recording operation sequentially, recorded images with 5 gray levels can be obtained by recording each pixel with 4 or less number of ink droplets. As found in FIG. 7, for example, 6 or less ink droplets in all can be projected to pixel No. 3 or 4 respectively. With respect to these pixels to which 5 or more ink droplets can be ejected, few ink droplets are not necessary but somehow redundant, and hence, the sum of ink droplets projected to pixels is controlled to be 4 or less in responsive to gray level data. It is also found that recorded images with 5 gray levels are obtained even if either the orifice No. 1 or No. 4 fails to eject ink droplets.

Though the maximum number of ink droplets to be ejected to a single pixel per single scan is taken to be 2 in this embodiment, this number can be selected to be 3 or more, in which a higher gray level and clearer recorded images can be obtained.

Embodiment 1C

Figure 8:
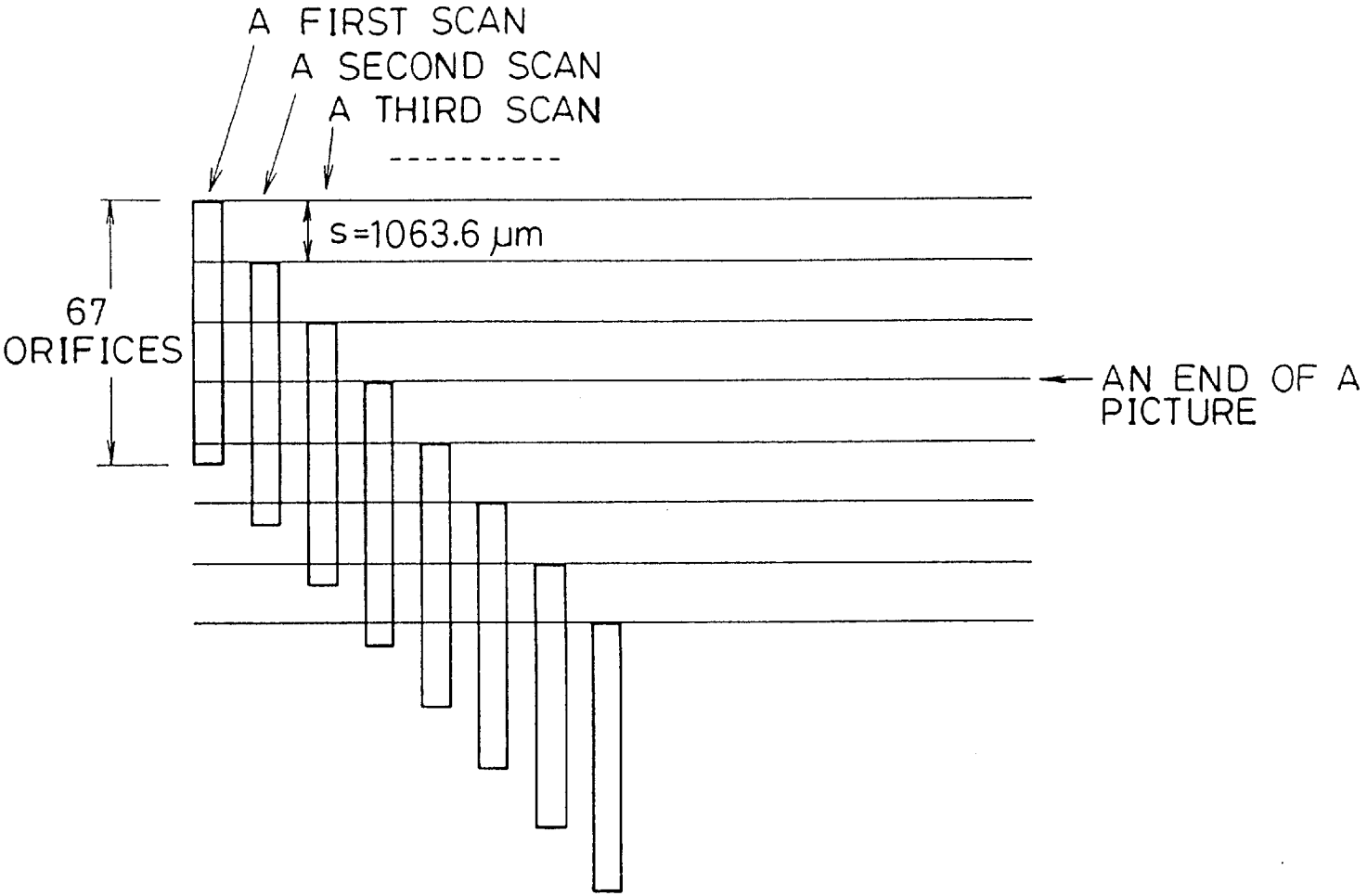
FIG. 8 is a schematic illustration illustrating recording operations of embodiment 1C of the present invention.

Using the similar apparatus and recording head to those in the embodiment 1 except that the number of orifices is 67, the pitch q of orifices is 70.6 μm and the paper feed unit displacement s is 1063.6 μm, images are recorded with the pitch p of pixels being 65.5 μm and the number of gray levels being 5. A diagram illustrating a recording method in this embodiment is shown in FIG. 8.

In the result of several attempts to record various kinds of images with the above described recording method, it is concluded that clear recorded images without stripe-noises and shading can be obtained.

Embodiment 2

In the above described embodiments 1A, 1B and 1C, the number of dots recorded per single pixel is m. On the other hand, the number of dots being able to be formed is NK/a which is greater than or equal to m. However, if compensation of failed or damaged orifices from which ink droplets may not be ejected effectively could be neglected, the excess amount of dots which may be wasted or not used for developing images should be eliminated so as to record pixels with dots efficiently. In order to perform this efficiency, the above defined condition given by the equation (2)' may be specified to be NK/a=m.

In feeding a paper sheet, for example, there may be a case that the lower end of the images recorded before feeding the paper sheet and the upper end of the images to be recorded after feeding the paper sheet cannot be exactly met to each other due to position errors in feeding the paper sheet. In such a case, by defining Nq/s not to be an integer so that the dot pattern in each pixel may not be uniformly distributed, the effect of position errors in feeding a paper sheet may be reduced.

In the followings, the embodiment 2 of the present invention is described with a case that, using a recording apparatus shown in FIGS. 1 and 2, images are recorded with the pitch q of pixels is 63. 5 μm and the number of gray levels is 4. In this case, the sum of ink droplets per single pixel is varied between 0 and 3.

Figure 9:
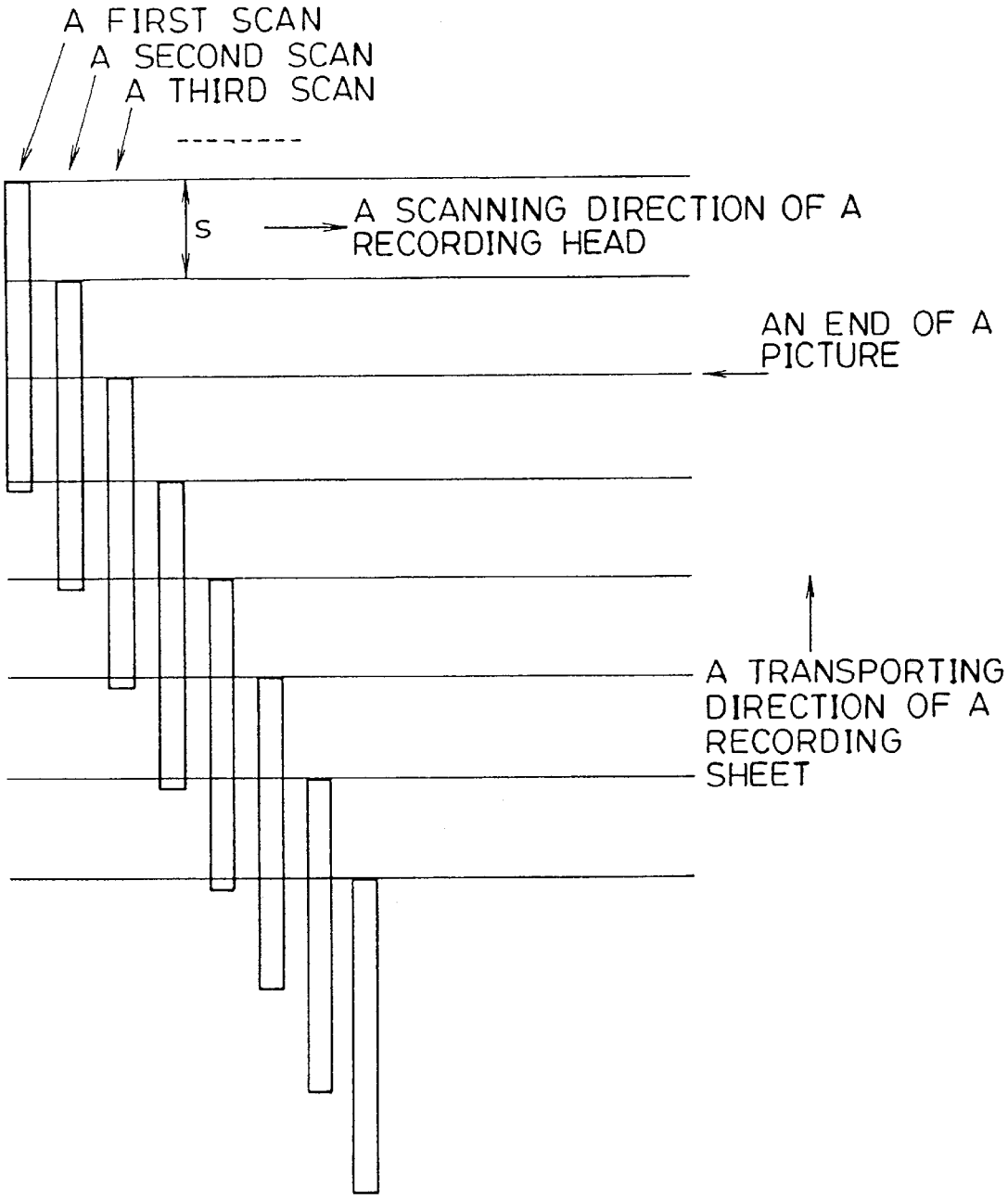
FIG. 9 is a schematic illustration illustrating recording operations of embodiment 2 of the present invention.
Figure 10:
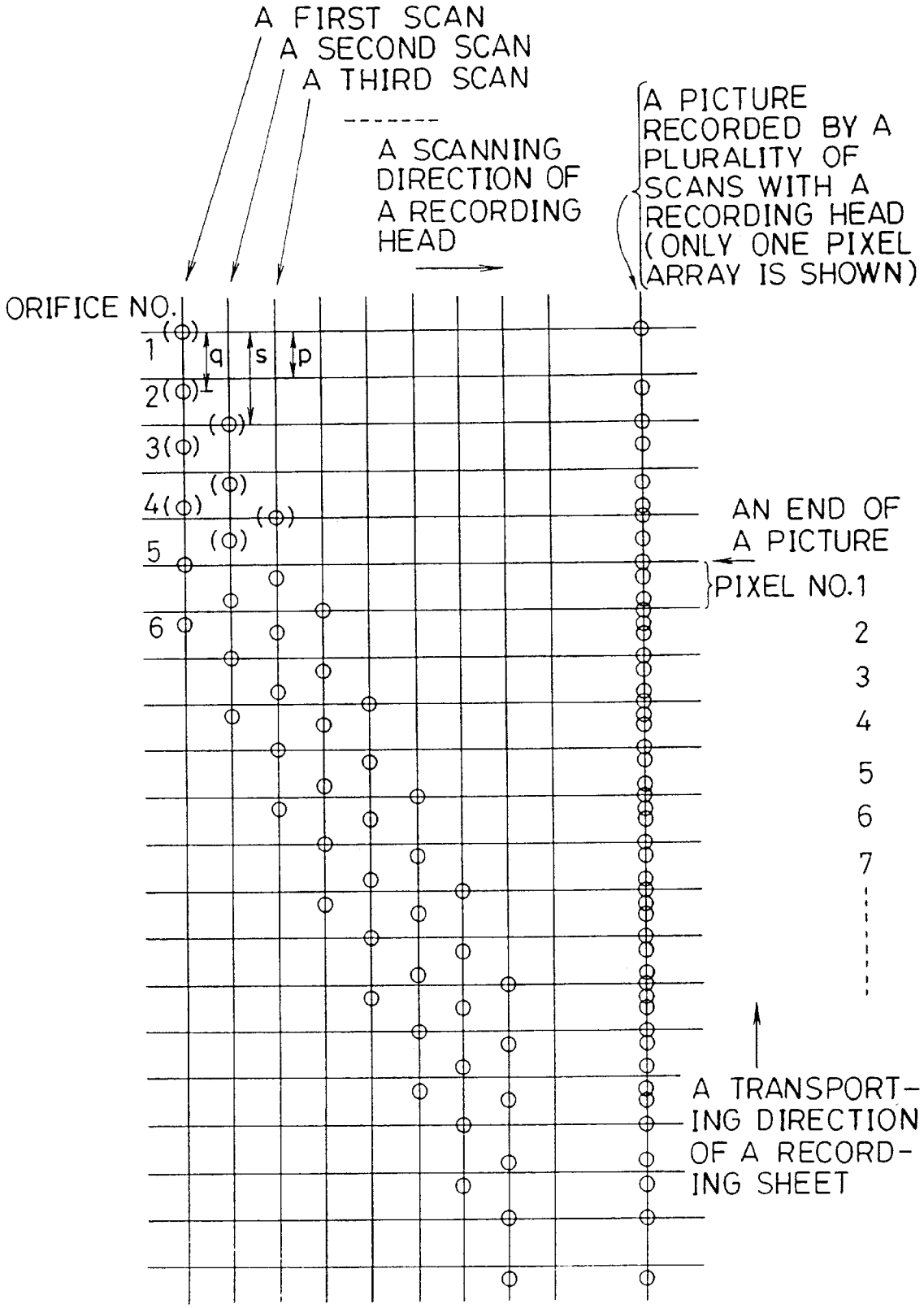
FIG. 10 is a schematic illustration illustrating dot formation of embodiment 2 of the present invention.

FIGS. 9 and 10 are diagrams illustrating a recording method in this embodiment. The recording head 1 has 6 orifices arranged on an identical line extended in the vertical direction on FIGS. 9 and 10. The orifice ID number increases from 1 to 6 from the top to the bottom on these figures.

At first, in the first scan, using only two orifices No. 4 and 5, images are recorded on the recording sheet while the carriage is moved and consequently, 1 or less number of ink droplet is projected onto the pixels No. 1 and 2. Next, in the second scan, the recording sheet is transported by two pixel units (a=2) in the upward direction, and three orifices No. 4, 5 and 6 are used for recording images. In FIGS. 9 and 10, notated is that the recording head is moved in the downward direction relatively to the recording sheet. So far, two or less ink droplets in all are projected to the pixel No. 1 and one or less ink droplets is projected to the pixels No. 2, 3 and 4. And next, in the third scan, after transporting the recording sheet by two pixel units in the upward direction, images are recorded using orifices No. 2, 3, 4, 5 and 6. So far, three or less ink droplets in all are projected to the pixel No. 1, two or less ink droplets in all is projected to the pixels No. 2 and 3, and at most one ink droplet is projected to the pixels No. 4, 5 and 6. And finally, after transporting the recording paper by two pixel units in the upward direction, in the fourth scan, images are recorded using orifices No. 1 to 6, and in every consecutive scan after the fourth scan, recording images using orifices No. 1 to 6 is repeated every time after transporting the recording paper by two pixel units in the upward direction. As a result, the maximum number of dots formed at each pixel is 3 and recorded images with 4 gray levels can be developed. This maximum number of dots is equal to each pixel so that all ink droplets being capable of being projected to a pixel are used to form dots of that pixel.

Embodiment 2A

Figure 11:
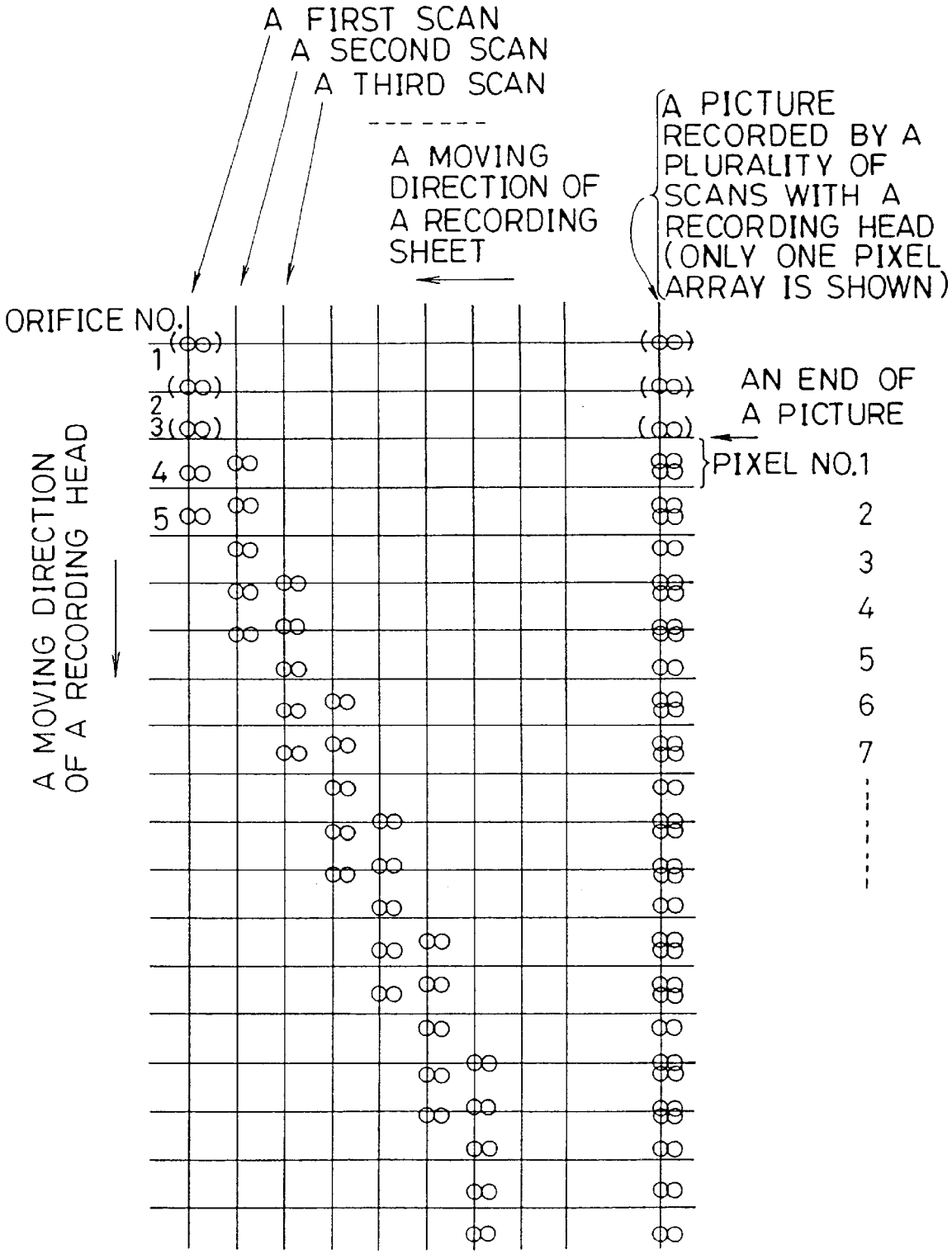
FIG. 11 is a schematic illustration illustrating dot formation of the embodiment 2A of the present invention.

FIG. 11 is a diagram illustrating a recording method in this embodiment. This embodiment can be applicable to a recording apparatus having the similar structure to that shown in FIG. 5.

At first, the recording head is located in the right end side of the drum 3 in FIG. 5, and using only tow orifices No. 4 and 5, images are recorded on the recording sheet while the drum 3 rotates for 360°. At this time, 0, 1 or 2 ink droplets are ejected per single pixel in accordance with gray level data (K=2). Next, the recording head is moved in the left direction by 2.5 pixel units (a=2.5), and using five orifices No. 1 to 5, images are recorded on the recording sheet while the drum 3 rotates for 360°. Images are recorded on the whole face of the recording sheet 2 by repeating sequentially the horizontal movement of the recording head by 2.5 pixel units every time after the main scanning operation during the drum 3 rotation for 360°. As a result, for example, the pixel No. 1 is formed by orifices No. 1 and 4, and images can be recorded with 5 gray levels by using 4 or less number of ink droplets.

Embodiment 2B

Figure 12:
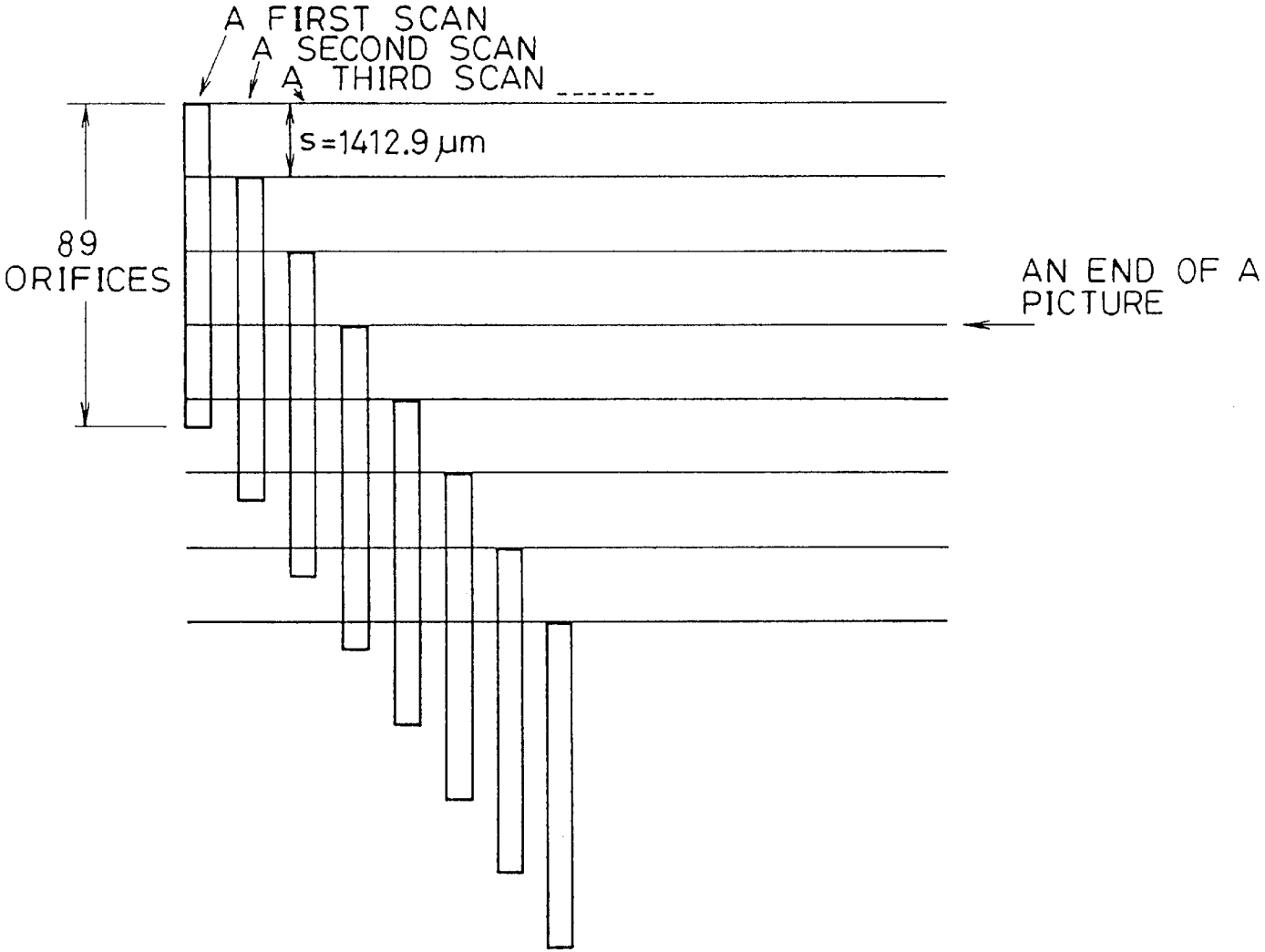
FIG. 12 is a schematic illustration illustrating recording operations of embodiment 2B of the present invention.

FIG. 12 is a diagram illustrating recording operations in the case that the recording method described with the embodiment 2 is applied to an recording head in which the number of orifices is 89 and the pitch q of orifices is 70. 6 μm. In this embodiment, using the similar apparatus and recording head to those in the embodiment 2 except that the paper feed unit displacement s is 1412.9 μm, images are recorded with the pitch p of pixels being 63.5 μm and the number of gray levels being 5.

In the result of several attempts to record various kinds of images with the above described recording method, it is concluded that clear recorded images without stripe-noises and shading can be obtained.

Embodiment 3

In the above described embodiments 1, 2 and their modifications, what are explained are several conditions for forming dots of each pixel by ink droplets ejected from different orifices in a plurality of scans so that each dot is shifted from another dot within a pixel by determining adequately the pitch q of orifices and the relative displacement s between the recording head and the recording sheet.

The embodiment 3 refers to conditions that the number of dots formed within a pixel and its dot pattern uniquely correspond to each other and that dots within a pixel are never overlapped and distributed uniformly within a pixel. By applying a recording method so determined as to be based on such conditions, the optical density of recorded images and their recording quality can be controlled more easily with respect to pixels.

These conditions in the embodiment 3 are described below in detail.

Let x be the coordinate in the sub-scanning direction with respect to dots formed on the recording sheet, and $x_{ij}$, being defined as the position of the dot formed of ink droplets from the i-th orifice at the j-th scan, is given by $$x_{ij}=qi+sj=(bi+aj)p, \tag{4}$$

where the origin of the coordinate may be determined arbitrarily.

Now, the condition for generating a uniform dot pattern composed of a plurality of dots in a single pixel is that both a and b in the equation (4) are rational numbers. By notating that $b=\beta/\alpha$ and $a=\eta/\xi$, where $\alpha$ and $\beta$, and $\eta$ and $\xi$, all of which are natural numbers, are relatively prime numbers, respectively, the equation (4) can be expressed as to be $$x_{ij}=\left(\frac{\beta}{\alpha}i+\frac{\eta}{\xi}j\right)p \tag{5}$$

With the greatest common measure g of $\alpha$ and $\xi$, and the greatest common measure f of and $\beta$ and $\eta$, the equation (5) becomes $$x_{ij}=\frac{f}{g}p\left(\frac{\beta'}{\alpha'}i+\frac{\eta'}{\xi'}j\right)=\frac{fp}{g}\cdot\frac{\beta'\xi'i+\alpha'\eta'j}{\alpha'\xi'}, \tag{6}$$

$$\text{where } \alpha'=\frac{\alpha}{g},\ \xi'=\frac{\xi}{g},\ \beta'=\frac{\beta}{f} \text{ and } \eta'=\frac{\eta}{f}.$$

As $\alpha$ and $\beta$ are relatively prime numbers, $\alpha'$ and $\beta'$ are also relatively prime numbers, and as $\eta$ and $\xi$ are relatively prime numbers, $\eta'$ and $\xi'$ are also relatively prime numbers. In addition, $\alpha'$ and $\xi'$ are relatively prime numbers, and $\beta'$ and $\eta'$ are relatively prime numbers. Therefore, $\beta'\xi'$ and $\alpha'\eta'$ are relatively prime numbers. Hence, by selecting natural numbers i and j appropriately, $(\beta'\xi'i+\alpha'\eta'j)$ can take every integer values greater than a designated value. The value of $x_{ij}$ with $(\beta'\xi'i+\alpha'\eta'j)$ taking this designated value may be the coordinate of the dot at the edge of recorded images.

It can be interpreted that the integer part N of $x_{ij}/p$ represents the sequential order of pixels in the sub-scan direction which contains the dot corresponding to the given value $$(f/g)\cdot\frac{(\beta'\xi'i+\alpha'\eta'j)}{\alpha'\xi'}.$$

The average number of $x_{ij}$ values which satisfy $Np\leqq X_{ij}<(N+1)p$ is $$\frac{g\alpha'\xi'}{f}.$$

This means that $$\frac{g\alpha'\xi'}{f}$$

dots are formed in the Nth is pixel. Assuming that $f\neq 1$, as f and $\alpha(=g\alpha')$ are relatively prime numbers and f and $\xi'$ are relatively prime numbers, $$\frac{g\alpha'\xi'}{f}$$

not an integer. Therefore, the number of $x_{ij}$ corresponding to the range between Np and (N+1)p is not the number of $x_{ij}$ corresponding to the range between (N+1)p and (N+2)p. For example, with q=4/5p and s=8/5p, the equation (4) leads to $$x_{ij}=4/5p\ (i+2j) \tag{7}$$

With various combinations of natural numbers i and j for the equation (7), in case that N=4M where M is an integer, in the range between 4M and 4M+1, $$\frac{x_{ij}}{p}$$

can take two distinctive values in a respective single range, such as (0, 0.8) and (4.0, 4.8), but in the range outside the above range between 4M and 4M+1, $$\frac{x_{ij}}{p}$$

takes a single distinctive value in a respective single range, such as (1, 6), (2, 4), (3, 2) and (5, 6). So far, in the case that $f\neq 1$, the number of dots depends on the position of the pixel. On the other hand, in the case that f=1, the number of ink droplets being able to be ejected in a designated range (pixel) is always constant. Therefore, in order to maintain the number of dots formed in each pixel to be identical, f must be 1. The condition that f=1 leads to the conclusion (condition 1) that $\beta$ and $\eta$ are relatively prime numbers.

Under the condition 1, a single pixel is composed of ink droplets, all of which are ejected from different orifices each other and the maximum number of which is $g\alpha'\xi'$.

Now, by substituting 1 into f, which leads to results that $\beta'$=and $\eta'=\eta$ in the equation (6), what is obtained is $$x_{ij}=\frac{\beta\xi'i+\alpha'\eta j}{g\alpha'\xi'}\cdot p \tag{8}$$

Next, what is considered is the case that two dots are located in an identical position with the following relationship $$x_{i+\Delta i\ j-\Delta j}=x_{ij} \tag{9}$$

This equation assumes that the position $x_{ij}$ of one dot is equivalent to the position $x_{i+\Delta i\ j-\Delta j}$ of the other dot which is formed by an ejection from an orifice shifted by Δi from the i-the orifice to the position $x_{ij}$ and is formed at the scan Δj times before the j-th scan to the position $x_{ij}$. In this case, equation (8) and (9) give $$\beta\xi'(i+\Delta i)+\alpha'\eta(j-\Delta i)=\beta\xi'i+\alpha\eta j$$

which comes to $$\beta\xi'\Delta i=\alpha'\eta\Delta j \tag{10}$$

As βξ' and α'η in the equation (10) are relatively prime numbers, the minimum positive solution with respect to (Δi, Δj) satisfying the equation (10) is $$\Delta i=\alpha'\eta$$

$$\Delta j=\beta\xi' \tag{11}$$

In this case, the position $x_{ij}$ of one dot is equivalent to the position of the other dot which is formed by an ejection from an orifice shifted by α'η from the i-th orifice corresponding to the position $x_{ij}$ and at the scan βξ' times before the j-th scan corresponding to the position $x_{ij}$. So far, in order to prevent from projecting a plurality of dots on an identical point even by repeating scans, the orifice shifted by α'η from the i-th orifice must be eliminated. This condition can be established by that the number of orifices, N, satisfies that N≦α'η, which leads to no existence of dots on an identical position.

On the other hand, N>1 is the condition that the recording head has a plurality of orifices. According to the above described two conditions, the following condition can be established.

$$N=\alpha'\eta>1 \text{ (Condition 2)} \tag{12}$$

In every pixel, by scanning βξ' times, dots can be formed with ink droplets ejected from different orifices each other the maximum number of which is gα'ξ'. The conditions for making this possible are $$g\alpha'\xi'>1 \text{ (Condition 3)}$$

and $$\beta\xi'>1 \text{ (Condition 4)} \tag{13}$$

The condition for the embodiment 3 is to establish the above defined conditions 1 to 4 simultaneously.

In the case that α, β, ξ and η are determined so as to satisfy the above conditions 1 to 4, $x_{ij}$, defined by $$p\frac{(\beta\xi' i+\alpha'\eta j)}{g\alpha'\xi'},$$

represents a point with which the line segment between the pixel corresponding to $x_{ij}$ and its adjacent pixel in the sub-scan direction in the ratio defined by the following equation;

$$\text{mod}(\beta\xi'i+\alpha'\eta j,\ g\alpha'\xi'):$$

$$g\alpha'\xi'-\text{mod}(\beta\xi'i+\alpha'\eta j,\ g\alpha'\xi') \tag{14}$$

In the equation (14), mod (βξ'i+α'ηj, gα'ξ') is the remainder when (βξ'i+α'ηj) is divided by gα'ξ'. Suppose that the gray level of a designated pixel is k, that is, the designated pixel is formed with ink droplets ejected from k different orifices, the number of combinations of i and j is given by $g\alpha'\xi^{C}k$.

In this embodiment, in order to select k couples of i and j among these combinations, a designated set $M_k$ composed of k natural numbers where k is from 1 to gα'ξ'−1 is prepared priorly, and among these sets, what are selected are k sets of i and j which satisfy mod (βξ'i+α'ηj, gα'ξ') ϵ$M_k$. $M_k$ is a subset having k elements out of a set having elements {0, 1, . . . , gα'ξ'−1}. As described above, only if combinations of i and j are selected from $M_k$ being prepared priorly, a common dot layout pattern can be used for forming a pixel where the number of ink droplets projected to the pixel is identical.

In the followings, a recording method specific to the above described embodiment 3 is explained.

In this embodiment, using an ink jet recording apparatus similar to that shown in FIG. 1, images are recorded. For explanation, the number of orifices in the recording head 1 is 9, and the pitch q of orifices is 84.67 μm and the pitch p of pixels is 63.5 μm. Thus, q=(4/3)·p and hence b=4/3. In this embodiment, the number of gray levels is 4 for recording images, that is, the number of dots projected to a single pixel, which is called image level in the rest of explanations, is varied to be between 0 and 3 for recording images.

Figures 13A, 13B:
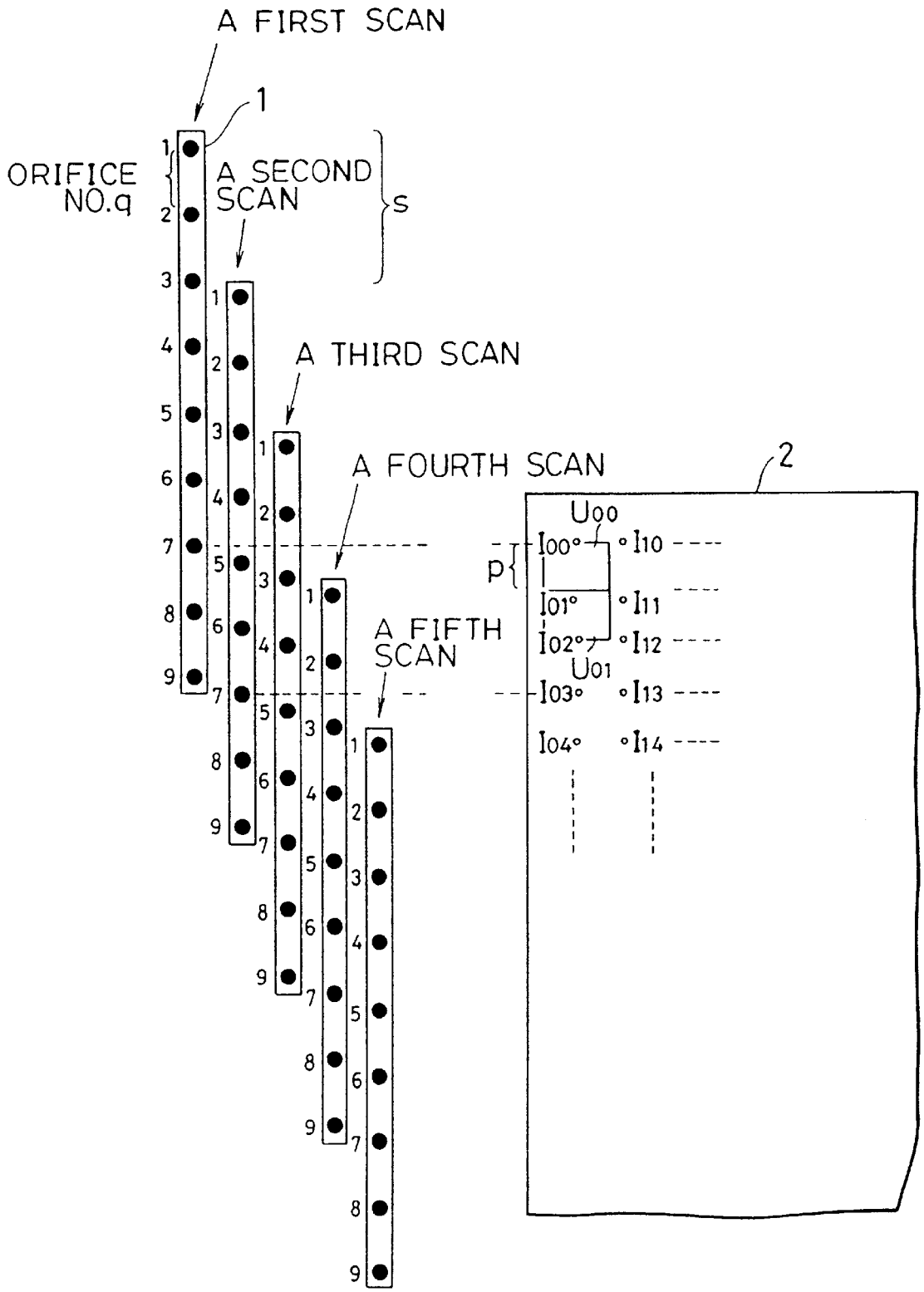
FIGS. 13A and 13B are schematic illustrations illustrating dot formation of embodiment 3 of the present invention.

FIGS. 13A and 13B are diagrams illustrating recording operations in this embodiment and a diagram illustrating the recording results, respectively.

At first, in the first scan, the scan is performed so that the orifice No. 7 may pass through the top point $I_{00}$ of the pixel $U_{00}$. As the pitch q of orifices is (4/3)p, the orifice No. 8 passes through the pixel $U_{01}$ between $I_{01}$ and $I_{02}$, and the orifice No. 9 passes through the pixel $U_{02}$ between $I_{02}$ and $I_{03}$. Orifices No. 1 to 6 are not used for recording images because they do not pass through the pixels on the recording sheet 2.

Next, in the second scan, the recording sheet 2 is transported in the upward direction by three pixel units, that is, s=3p or a=3, in other words, the recording head 1 is relatively displaced in the downward direction by three pixel units before recording images. Therefore, the orifice No. 5 passes through the point which exists within the pixel $U_{00}$ and with which the segment between $I_{00}$ and $I_{01}$ is divided in the ratio 1:2, the orifice No. 6 passes through the point which exists within the pixel $U_{01}$ and with which the segment between $I_{01}$ and $I_{02}$ is divided in the ratio 2:1, the orifice No. 7 passes through the point $I_{03}$ within the pixel $U_{03}$, the orifice No. 8 passes through the point within the pixel $U_{04}$ and the orifice No. 9 passes through the point within the pixel $U_{05}$, respectively. In the second scan, orifices No. 1 to 4 are not used.

And next, after moving the recording head 1 relatively in the downward direction by three pixel units, the third scan is performed. At every scan, the recording head 1 is moved relatively by three pixel units. Thus, while these repetitive scan operations continue, the maximum number of multiple scan operations per each pixel is 4 and an orifice passes through over each pixel three times.

For example, an orifice passes through over the pixel $U_{00}$ during the first, second and third scans. An orifice passes through over the pixel $U_{01}$ during the first, second and fourth scans, but in the third scan, the recording head passes through over the pixel $U_{01}$ and no orifice passes through over the pixel $U_{00}$. Similarly, an orifice passes through over the pixel $U_{02}$ during the first, third and fourth scans except the second scan. The positions of the orifice when passing through over each pixel three times are the point $I_{ij}$, the point with which the segment between $I_{ij}$ and $I_{ij+1}$ is divided in the ratio 1:2 and the position with which the segment between $I_{ij}$ and $I_{ij+1}$ is divided in the ratio 2:1.

FIG. 14 summarizes the above described relationship between the scan order and the pixels to which ink droplets are projected. As found in FIG. 14, with respect to each of three dots forming each pixel, a combination of the scan number and the orifice number is uniquely determined. Therefore, gray level data of each pixel are converted to drive data corresponding to its scan times and orifice ID and stored in the drive data RAM 100M priorly. FIG. 15 shows the contents of the drive data RAM 110M.

As shown in FIG. 15, each drive datum is stored in correspondence with scan number and orifice number, that is, in accordance with a position of the dot to be formed in the pixel. For example, the drive datum of the orifice No. 4 at the third scan refers to the second dot of the fourteenth pixel and its stored value is 1 or 0, representing ejection or non-ejection mode, respectively.

The drive data in responsive to designated gray level, that is, image level, are defined in the following manner.

In FIG. 14, the positions in the pixel included in drive data, for example, 1/3 and 2/3, represent positions obtained by dividing the segment between adjacent pixels in the ratio 1:2 and 2:1, respectively. In developing the pixel $U_{01}$, the orifice NO. 8 is assigned in the first scan, the orifice No. 6 is assigned in the second scan, and the orifice No. 1 assigned in the fourth scan. Therefore, recorded images with image level 3 can be established by ejecting ink droplets to a designated pixel in all the three scans. If ink droplets are ejected in the two scans arbitrarily selected out of these three scans, recorded images with image level 2 can be obtained. Similarly, if ink droplet are ejected only in one scan arbitrarily selected out of these three scans, recorded images with image level 1 can be obtained.

However, for example, with image level 1, it is desirable for reducing shading in recorded images and for increasing evenness of recorded images that positions on which dots are projected in the pixel $U_{ij}$ are identical to one another on every pixel $U_{ij}$. For example, in the case that all the image levels of $U_{00}$, $U_{01}$, $U_{02}$ and so on are 1, and that the orifice No. 7 is assigned at the first scan in developing the pixel $U_{00}$, the orifice No. 1 is assigned at the fourth scan in developing the pixel $U_{01}$, the orifice No. 4 is assigned at the third scan in developing the pixel $U_{02}$ and so on, which is called method A, in every pixel, dots are formed at the top edge of the pixel and uniform recorded images can be obtained. In contrast, in the case that, for recording images with image level 1, dots are projected in pixels $U_{00}$, $U_{01}$, $U_{02}$ in the first scan, dots are formed at the top edge point $I_{00}$ in the pixel $U_{00}$, at the point with which the segment between $I_{01}$ and $I_{02}$ is divided in the ratio 1:2 in the pixel $U_{01}$, and at the point with which the segment between $I_{02}$ and $I_{03}$ is divided in the ratio 2:1 in the pixel $U_{02}$, the point closer to the pixel $U_{03}$. In recording images in such a manner, even if an identical image level can be established at every pixel, the intervals between adjacent dots are not uniform which may lead to uneven recorded images.

In forming even images with image level 1, positions on which dots are projected in each pixel are not limited to the top edge of the pixel as described above but taken to be arbitrarily. For example, aiming to select always the position on which the segment between adjacent pixels is divided in the ratio 1:2, it is allowed that the orifice No. 5 is assigned at the second scan in developing the pixel $U_{00}$, the orifice No. 8 is assigned at the first scan in developing the pixel $U_{01}$, and the orifice No. 2 is assigned at the fourth scan in developing the pixel $U_{02}$, which is called method B.

In this embodiment, the pitch q of orifices is (4/3)p or b=(4/3)·a, the paper feed unit-displacements is 3p or a=3, and as $\alpha=3$, $\beta=4$, $\xi=1$, $\eta=3$ and g=1, $\alpha'=3$, $\xi'=1$. Therefore, $\beta$ and $\eta$ are relatively prime numbers, and $\alpha'\eta=\alpha\eta/g=9$ ($\geqq 2$) is coincident with the number N of orifices used in this embodiment. It is also effective that $g\alpha'\xi'=\alpha\xi=3>g$, and that $\beta\xi'=\beta\xi=4>g$. In the above described method A, the value of mod ($\beta\xi'i+\alpha'\eta j$, $g\alpha'\xi'$) is 1 with mod (4i+3j, 3)=mod (4×7+3×1, 3)=mod (4×1+3×4, 3)=mode (4×4+3×3, 3)= . . . . =1.

With $M_1=\{1\}$ defined priorly, combinations of i and j are selected so as to satisfy mod ($\beta\xi'i+\alpha'\eta j$, $g\alpha'\xi'$) $\epsilon M_1$. This way of calculation can be effective in the method B.

In this embodiment, it is no need that the relation between values q, s and p is determined exactly and is allowed that there may be errors in these values. These errors lead a position on which an ink droplet is projected to deviate only a fraction of a pixel width p.

Embodiment 3A

Figure 16:
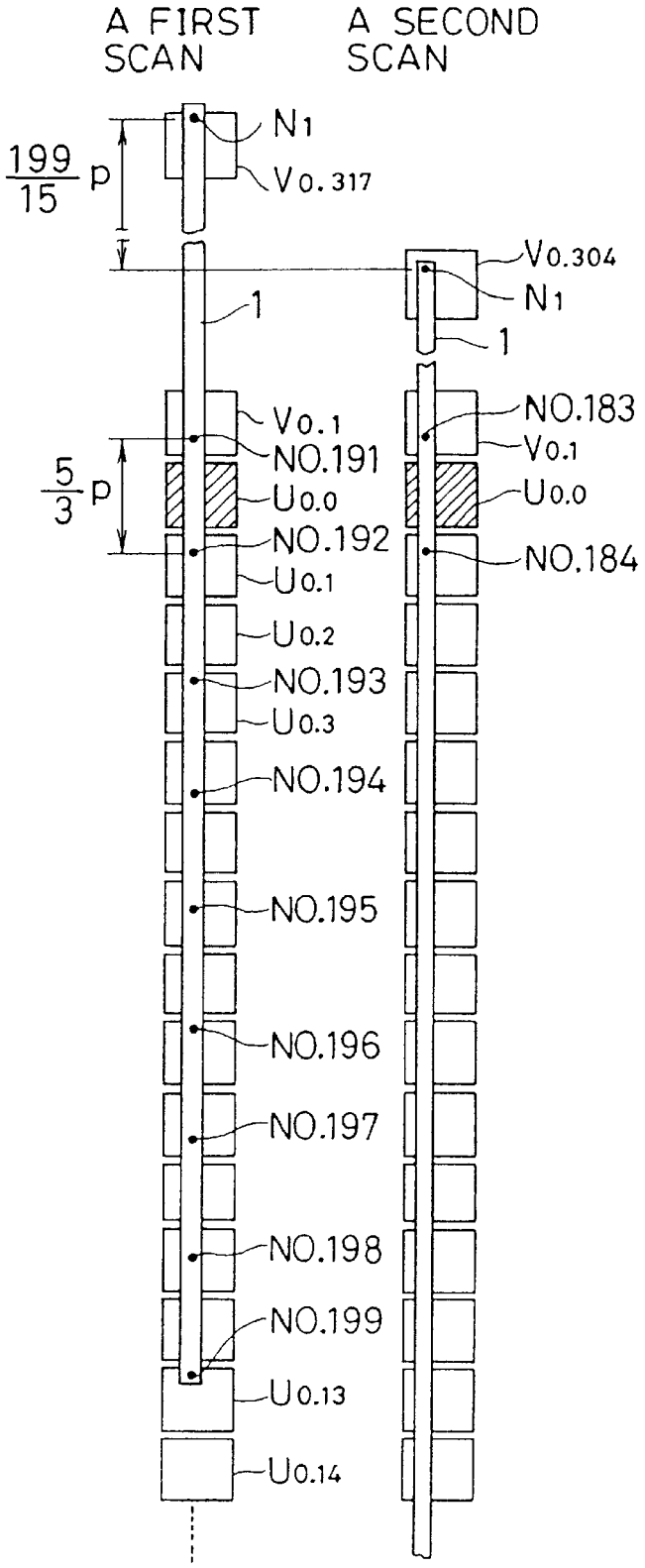
FIG. 16 is a schematic illustration illustrating dot formation of embodiment 3A of the present invention.

FIG. 16 is a diagram illustrating embodiment 3A.

In the embodiment, the pitch p of pixels is (25.4/300) mm, the pitch q of orifices is (5/3) p which is (25.4/180) mm, and the paper feed displacement unit s is (199/15)p. The pixel $U_{0,0}$ refers to the pixel located in the left and upper edge on the recording sheet, which is shown in hatched area in FIG. 16. The number of orifices is 199.

At first, in the first scan, images are recorded by assigning the orifice No. 1 to the upper edge of the virtual pixel $U_{0,317}$ which is located at the 317th pixel upward from the pixel $U_{00}$. Next, in the second scan, before recording images, the recording head 1 is moved in the sub-scan direction by s=199p/15. The maximum number of multiple scans to every pixel is 25, and an orifice passes through over the designated pixel 15 times. So far, recorded images have 16 gray levels between 0 and 15.

Figure 17:
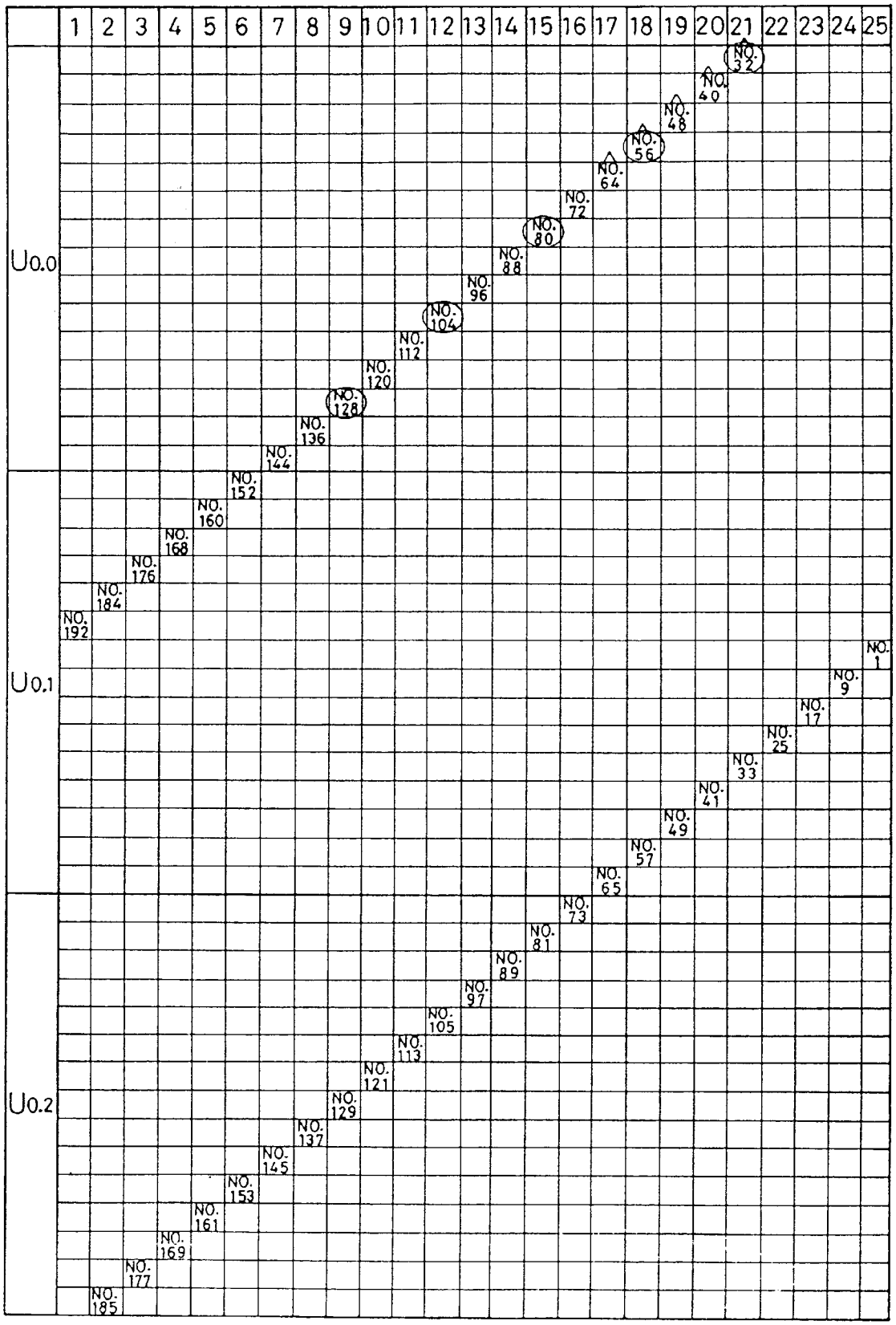
FIG. 17 is a schematic illustration illustrating a relationship among pixels, the number of scanning operations and orifice indices in embodiment 3A.

FIG. 17 shows this state that 16 gray levels can be developed. In FIG. 17, the horizontal axis represents the scan number and the vertical axis represents the order of pixels. For example, dots can be formed in the pixel $U_{0,0}$ and its number can be up to 15 by ink droplets ejected from orifices at designated scans such that the orifice No. 114 is assigned at the 7th scan, the orifice No. 136 is assigned at the 8th scan, the orifice No. 128 is assigned at the 9th scan and that the orifice No. 32 is assigned at the 21st scan.

As described above, in the case that the image level is 1 or over and less than 14, it can be arbitrarily selected which scan is used for ejection, and specifically in this embodiment, in accordance with materials used for the recording sheet, in order to obtain an optical optical density, combinations of the scan number and the orifice ID are selected. This selection is based on data stored in the drive data RAM shown in FIG. 2.

For example, consider the case that the image level of the pixel $U_{0,0}$ is 5. That is, in the case that 5 dots are projected to the pixel $U_{0,0}$ and that materials used for the recording sheet absorb relatively small amount of ink fluids, a higher optical density can be obtained by distributing 5 dots uniformly within a pixel. In order to establish such recorded images in the pixel $U_{0,0}$, the orifice No. 128 is assigned at the 9th scan, the orifice No. 104 is assigned at the 12th scan, the orifice No. 80 is assigned at the 15th scan and that the orifice No. 32 is assigned at the 21st scan. In contrast, in the case that materials used for the recording sheet absorb relatively large amount of ink fluids, recorded images containing excessive high optical density dots can be avoided by reducing the occupational area by dots projected on the recording sheet. In order to establish such recorded images in the pixel $U_{0,0}$, the orifice No. 64 is assigned at the 17th scan, the orifice No. 56 is assigned at the 18th scan, the orifice No. 48 is assigned at the 19th scan, the orifice No. 40 is assigned at the 20th scan, and the orifice No. 40 is assigned at the 21st scan. As the ink-absorption property of materials used for the recording sheet is subject to recording environmental factors such as humidity, it is allowed that dot projection layout in a pixel can be determined in responsive to detected humidity and so on.

According to this embodiment, using a recording head having the (25.4/180) mm pitch of orifices, im ages can be recorded with the (25.4/300) mm pitch of optical and with 16 gray levels and the optical density can be controlled in responsive to materials used for the recording sheet.

Embodiment 3B

Figure 18:
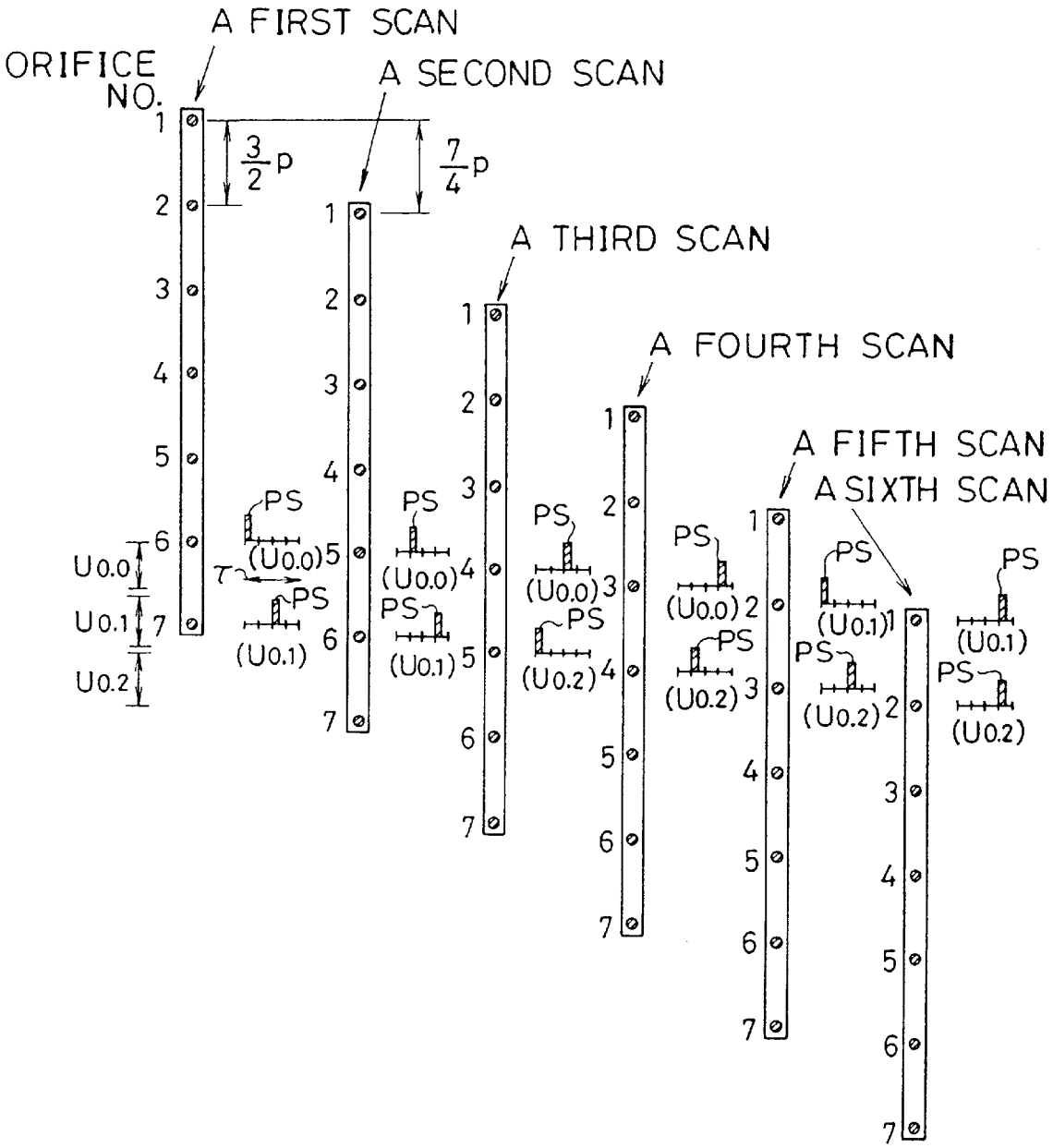
FIG. 18 is a schematic illustration illustrating recording operations of embodiment 3B of the present invention.
Figure 19:
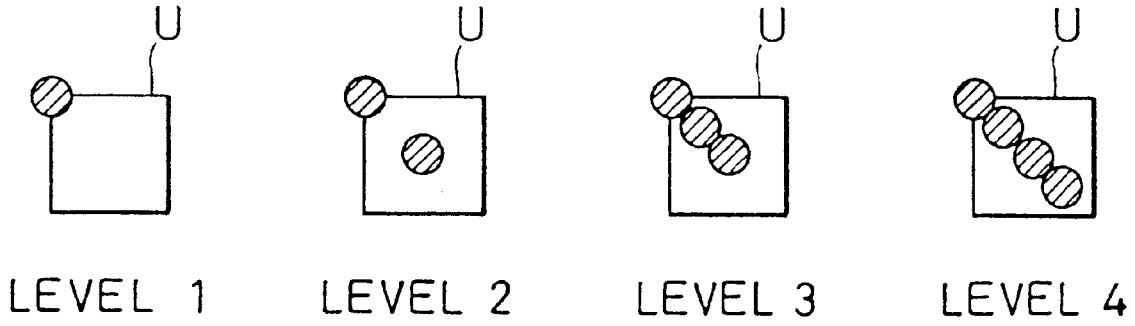
FIG. 19 is a schematic illustration illustrating dot formation of embodiment 3B.
Figure 20:
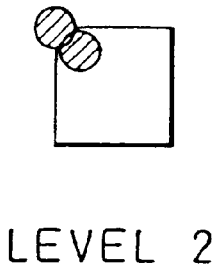
FIG. 20 is a schematic illustration illustrating another dot formation of embodiment 3B.

FIGS. 18, 19 and 20 are diagrams with the embodiment 3B, respectively.

In this embodiment, the pitch of pixels, p, is (25.4/400) mm, the pitch of orifices, q, is (3/2) p=(25.4/200)mm, the paper feed displacement unit s is (7/4)p, a the number of orifices, N, is 7 and the maximum number of dots projected on each pixel is 4.

At first, in the first scan, the orifice No. 6 passes through over the upper edge of the pixel $U_{0,0}$. As found in FIGS. 18, dots to be projected on the pixel $U_{0,0}$ are selected from four dots ejected from the orifice No. 6 at the first scan, the orifice No. 5 at the second scan, the orifice No. 4 at the third scan and the orifice No. 3 at the fourth scan, in accordance with the image level of the pixel $U_{0,0}$. Similarly, dots to be projected the pixel $U_{0,1}$ are selected from four dots ejected from the orifice No. 2 at the fifth scan, the orifice No. 1 at the sixth scan, the orifice No. 7 at the first scan and the orifice No. 6 at the second scan. Similarly, dots to be projected the pixel $U_{0,2}$ are selected from four dots ejected from the orifice No. 5 at the third scan, the orifice No. 4 at the fourth scan, the orifice No. 3 at the fifth scan and the orifice No. 2 at the sixth scan.

In FIG. 18, PS shown by an hatched rectangle is a drive pulse to its corresponding orifice. $\tau$ is the maximum interval of driving the recording head, which is 400 $\mu$sec in this embodiment.

The drive timing for the recording head is determined in the following manner in case of ejecting ink droplets from the orifice No. i at the j-th scan. That is, the drive timing is determined based on the position on which dots are formed on each pixel.

If the position (i, j) satisfies that mod (6i+7j, 4)=3, the drive timing is at the beginning of the drive cycle.

If the position (i, j) satisfies that mod (6i+7j, 4)=0, the drive timing is 100 $\mu$sec after the beginning of the drive cycle.

If the position (i, j) satisfies that mod (6i+7j, 4)=1, the drive timing is 200 $\mu$sec after the beginning of the drive cycle.

If the position (i, j) satisfies that mod (6i+7j, 4)=2, the drive timing is 300 $\mu$sec after the beginning of the drive cycle.

Additionally, the position of the dot projected to each pixel is determined in the following manner in responsive to the image level required.

For the image level 1, the positions (i, j) is allowed, which satisfies mod (6l+7j, 4)=3.

For the image level 2, the positions (i, j) is allowed, which satisfies mod (6l+7j, 4)={1,3}.

For the image level 3, the positions (i, j) is allowed, which satisfies mod (6l+7j, 4)={0, 1,3}.

With elections of the drive timing and its corresponding orifice ID as described above, at each image level, dot layouts within a pixel are shown in FIG. 19.

According to this embodiment, at each image level, dots are placed in a pixel so as to occupy the area within the pixel as effectively as possible. This is specifically effective in using recording sheets composed of materials with relatively lower ink-absorption property and in recording images with higher optical density. In contrast, in the case of recording images with lower gray levels of a pixel so as to develop clear images with lower optical density, the above described method for combinations of i and j should be modified in the following manner.

Specifically, in case of image level 2, the positions of dots are selected which satisfies mod (6l+7j, 4)={0, 3}. Owing to this method, the dot layout in a pixel is as shown in FIG. 20 which reduces the occupational area of dots in a pixel and can establish clear images with the lower optical density.

So far, with this embodiment, it is allowed that the dot layout in a pixel is modified for changing gray levels in responsive to materials used for the recording sheet, environmental recording conditions and processing of images.

Embodiment 3C

Figure 21:
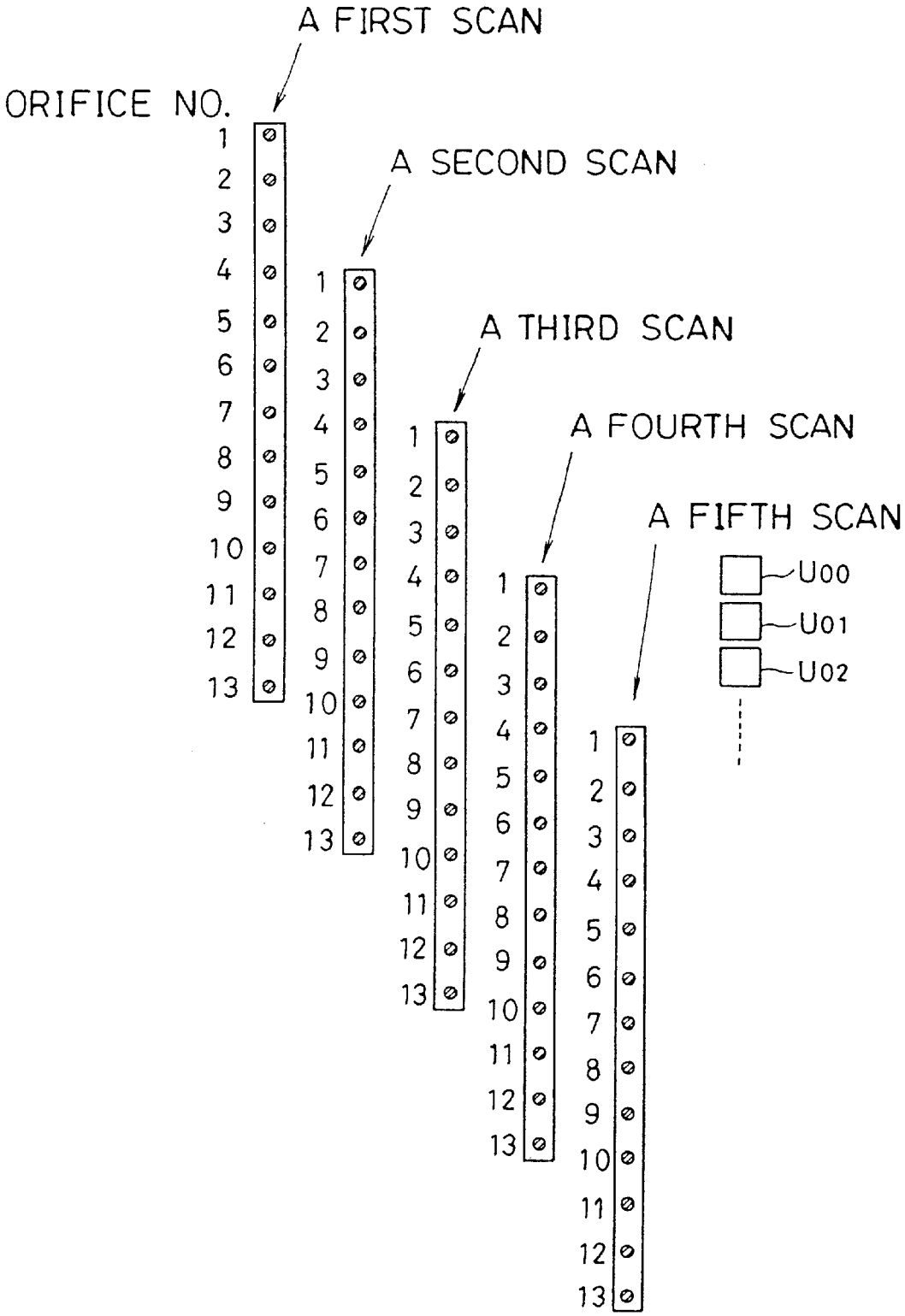
FIG. 21 is a schematic illustration illustrating recording operations of embodiment 3C of the present invention.

FIG. 21 is a diagram with the embodiment 3C.

In this embodiment, the pitch of orifices and the pitch of pixels are equivalent to each other, that is, p=q=63.5 $\mu$m and the paper feed displacements unit s is (13/4)p. Therefore, $\alpha=\beta=1$, $\xi=4$, $\eta=13$, g=1, $\alpha'=1$ and $\xi'=4$. And the number of orifices, N, is $\alpha'\eta=13$.

In this embodiment, the orifice No. 10 passes through over the upper edge of the pixel $U_{0,0}$. Next, the recording sheet is move in relative to the recording head by s=(13/4)p in the sub-scan direction before the next scan. As scans of the recording head and ejections of ink droplets continue in a repetitive manner, in the end, up to 4 dots can be formed in each pixel and images with 5 gray levels can be recorded.

In the above described embodiments 3, 3A, 3B and 3C, in forming dots in a single pixel, a single dot is ejected from only one orifice. It is also allowed that a plurality of dots can be ejected from an orifice for forming dots in a single pixel.

Figure 22:
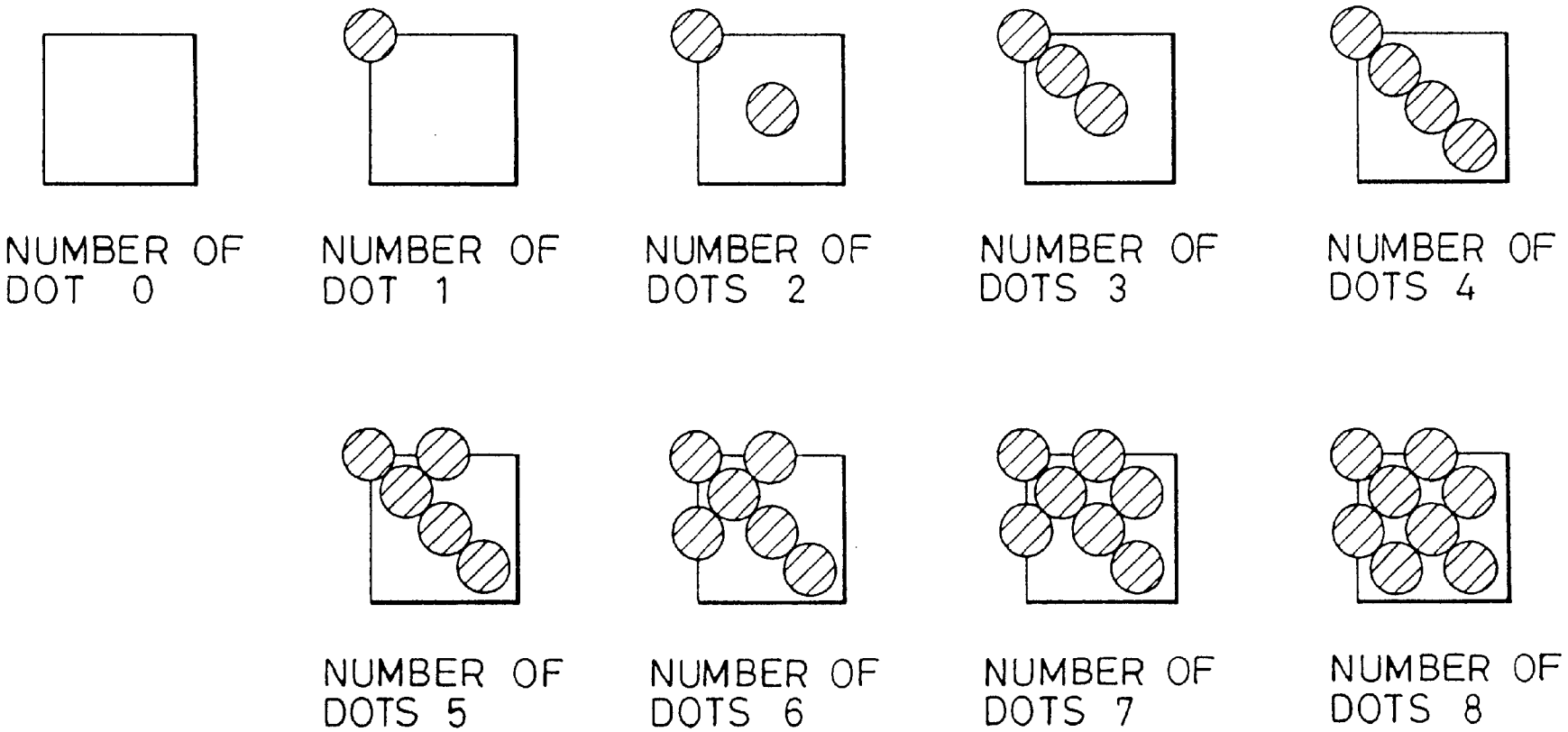
FIG. 22 is a schematic illustration illustrating dot formation of embodiment 3C.

For example, in the embodiment 3C, assuming that up to two ink droplets from an identical orifice can be projected to an identical pixel, images with 9 gray levels having dots between 0 and 8 per single pixel can be recorded as shown in FIG. 22. In this case, it is of course that the maximum drive frequency of the recording head should be increased as twice as that in the embodiment 3C.

In the above embodiments 1, 1A to 1C, 2, 2A, 2B, 3 and 3A to 3C, what is explained is that a plurality of dots formed in a pixel are shifted in the sub-scanning direction by making the ratio of at least two of the pitch of orifices, q, the pitch of pixels, b, and the paper feed displacement unit, s, to be non-integral value. In the following embodiments 4, 5, 5A, 5B, 6, 7, 7A, 8 and 8A, without shifting a plurality of dots in the sub-scanning direction, a plurality of dots are shifted in the main-scanning direction by changing timing for ejecting an ink droplet in accordance with scanning operations.

Embodiment 4

Figure 23:
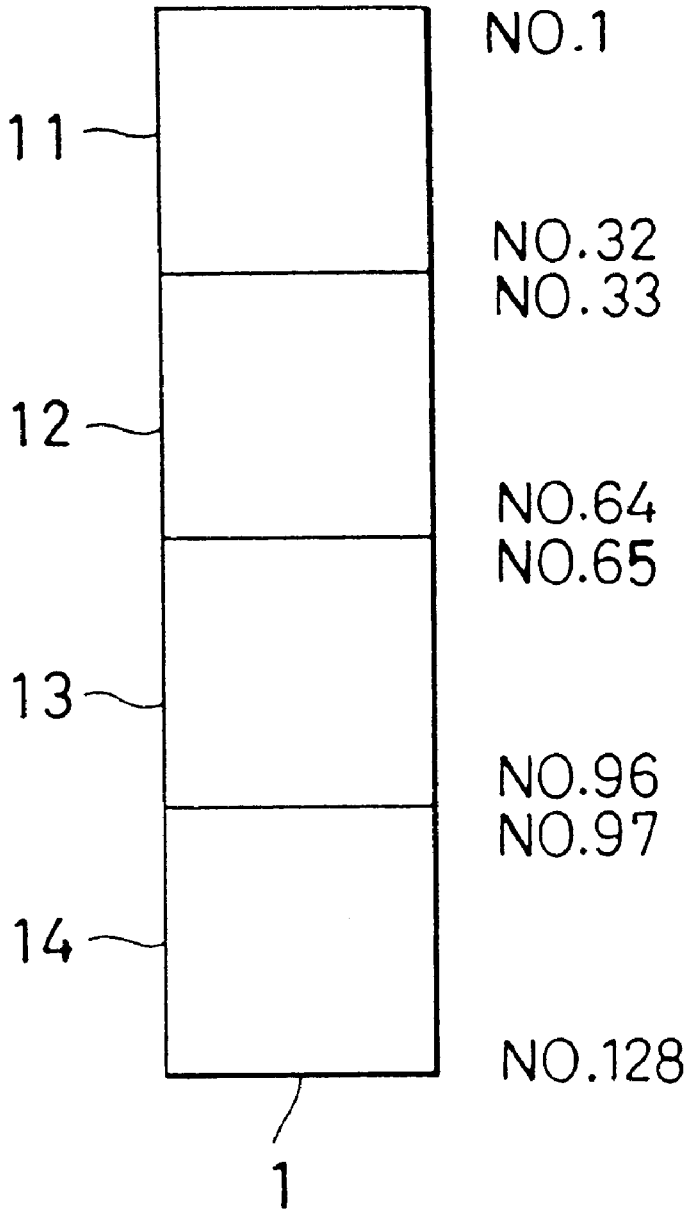
FIG. 23 is a diagrammatic view illustrating a recording head of embodiment 4 of the present invention.
Figure 24:
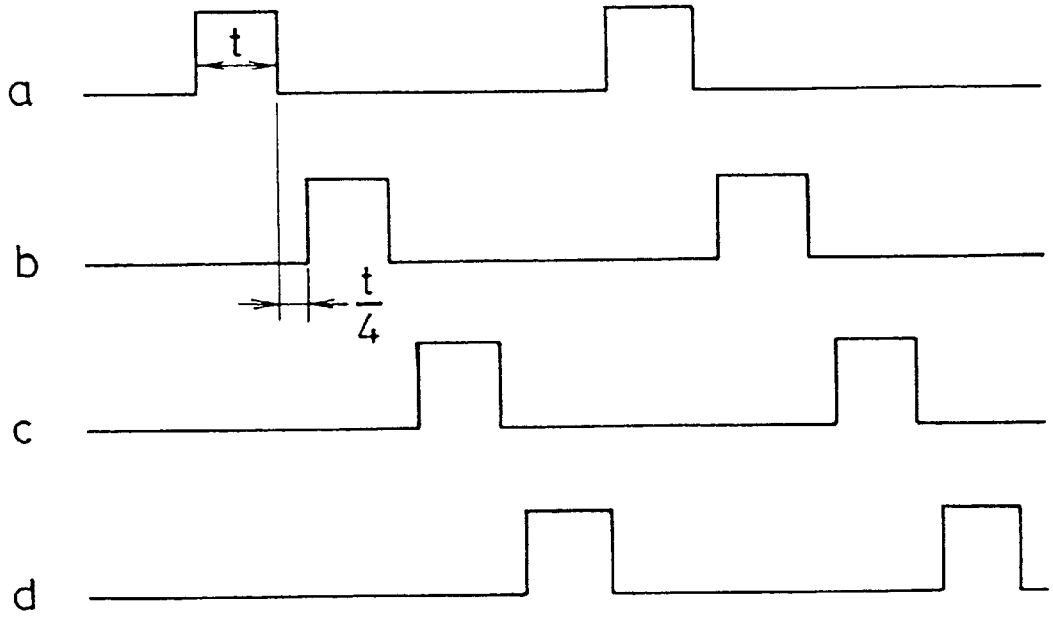
FIG. 24 is a timing chart for recording head driving pulses of embodiment 4.
Figure 25:
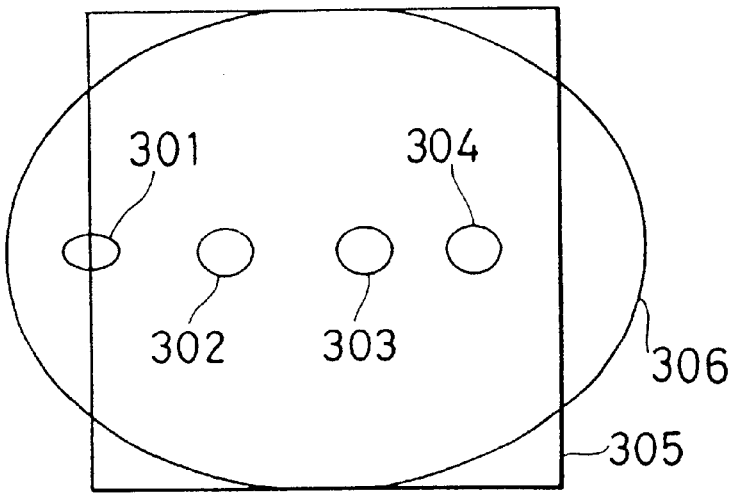
FIG. 25 is a schematic illustration illustrating dot formation of embodiment 4.

FIGS. 23, 24 and 25 are diagrammatic pictures illustrating the embodiment 4 of the present invention.

In this embodiment, for simplifying explanations, a dot density of a pixel is expressed by dots formed by ejecting ink droplets from four different orifices. That is, this embodiment explains a case that images with 5 gray levels are recorded. In addition, a recording apparatus used in this embodiment is similar to that shown in FIGS. 1 and 2.

FIG. 23 shows a recording head 1 having 128 orifices, which are divided into four blocks 11, 12, 13 and 14, each of which contains 32 orifices. FIG. 24 is a timing chart showing temporal behaviors of the drive pulses at each block shown in FIG. 23. FIG. 25 shows a pattern for forming dots in the pixel on the recording sheet by ejecting ink droplets from different orifices.

Switching waveform a in FIG. 24 shows a drive signal to the orifice block 14, and switching waveform b is with the orifice block 13, switching waveform c is with the orifice block 12 and switching waveform d is with the orifice block 11, respectively. Each drive pulse shown in FIG. 24 corresponds to a drive signal applied to each orifice of each block, and the pulse width of the drive pulse is t. The time difference between drive pulses in adjacent blocks is made to be t/4. In FIG. 24, the recording head is driven when the drive pulse is 1 or high, the pulse width t can be selected appropriately in accordance with electronic properties of the recording head.

The position 301 in FIG. 25 is the dot projected on the pixel 305, the dot on which is formed by the ink droplet ejected from an orifice included in the orifice block 14. After recording the dot 301, the recording paper is transported in the vertical (sub-scanning) direction by the width corresponding to a single block, and the ink droplets from orifice included in the orifice block 13 are projected on the pixel 305 to be formed as a dot 302. In the similar manner, ink droplets from orifices in the orifice blocks 12 and 11 are projected on the pixel 305 to be formed as dots 303 and 304, respectively. In FIG. 25, 306 is a set of dots projected to the pixel 305 in the above described manner.

In the followings, what is explained is the case that while the recording head 1 performs the main scanning and the recording sheet is fed by a designated amount at every main scanning, a pixel is formed by ejection ink droplets from a plurality of different orifices, for example, the pixel 305 is formed with dots by using orifices No. 100, 68, 36 and 4.

At first, at the first scan, a part of the pixel 305 is formed by dot ejected from the orifice No. 100. The orifice No. 100 is included in the block 14 and driven by the drive signal having switching waveform a. In this case, an ink droplet is projected to the position 301 in the pixel 305. In the similar manner, the orifice 68 included in the block 13 is driven by drive signal having switching waveform b. In this case, as the drive pulse b is shifted by t/4 from the drive pulse a, the ink droplet from the orifice 68 is projected to the position 302 shifted from the position 301 on the pixel 305. Next, the orifice 36 included in the block 12 is driven by drive signal having switching waveform c. In this case, as the drive pulse c is shifted by t/4 from the drive pulse b, the ink droplet from the orifice 36 is projected to the position 303 on the pixel 305. Finally, the orifice 4 included in the block 11 is driven by drive signal having switching waveform d. In this case, as the drive pulse d is shifted by t/4 from the drive pulse c, the ink droplet from the orifice 4 is projected to the position 304 on the pixel 305. So far, all the ink droplets for composing the pixel 305 are sequentially projected on the recording sheet and a set of dots 306 is established. The set of dots 306 covers almost all the area within the pixel 305.

In this embodiment, drive pulses defined as shown in FIG. 24 are one example of the condition that drive pulses of each block have their peaks at different positions from one another. In addition, though, in this embodiment, the number of blocks is taken to be 4, it is allowed that the number of blocks is not limited to be 4 if the timing of drive pulses is shifted by t/4 from one another. By driving the recording head by parts, there is an advantage for reducing the load of power supply to driving the recording head.

Embodiment 5

Figure 26:
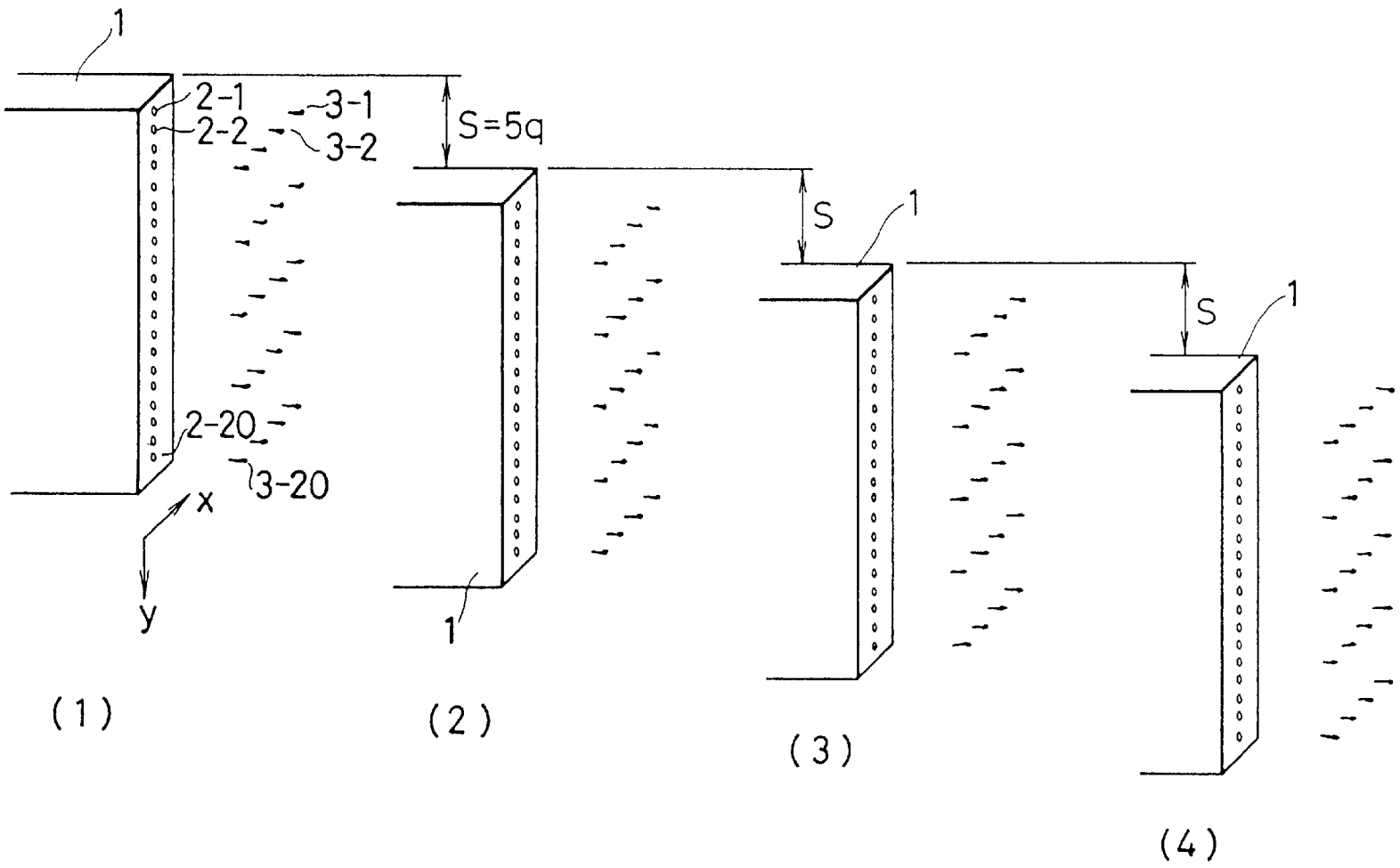
FIG. 26 is a diagrammatic view of recording heads and ejected ink droplets for explaining a recording method in embodiment 5 of the present invention.

FIG. 26 is a diagrammatic picture illustrating a recording method of the embodiment 5. In this embodiment, the timing of ejecting ink droplets from a plurality of orifices in each of blocks into which orifices of the recording head are divided, is shifted continuously.

The recording head 1 show in FIG. 26 is the similar to that shown in FIG. 1 and has 20 orifices marked by 2-1 to 2-10, the distance between which, q, is 63.5 $\mu$m. Ink droplets ejected from these orifices are designated 3-1 to 3-20. In this embodiment, images with 5 gray levels are recorded with 0 to 4 ink droplets per single pixel.

At first, the recording head is scanned in the x direction at 0.212 m/sec for recording images at the position (1) shown in FIG. 26. Next, the recording head is shifted down in the y direction by 5 pitches of orifices and the recording head is scanned in the x direction at the position (2) shown in FIG. 26. Similarly, after shifting the recording head in the y direction, respectively, the recording head is scanned in the x direction for recording images at positions (3) and (4).

So far, each pixel is recorded by four individual scans. Therefore, at every scan, by ejecting 0 or 1 ink droplet per each pixel in responsive to recording data, images with 5 gray levels can be recorded.

Figure 27:
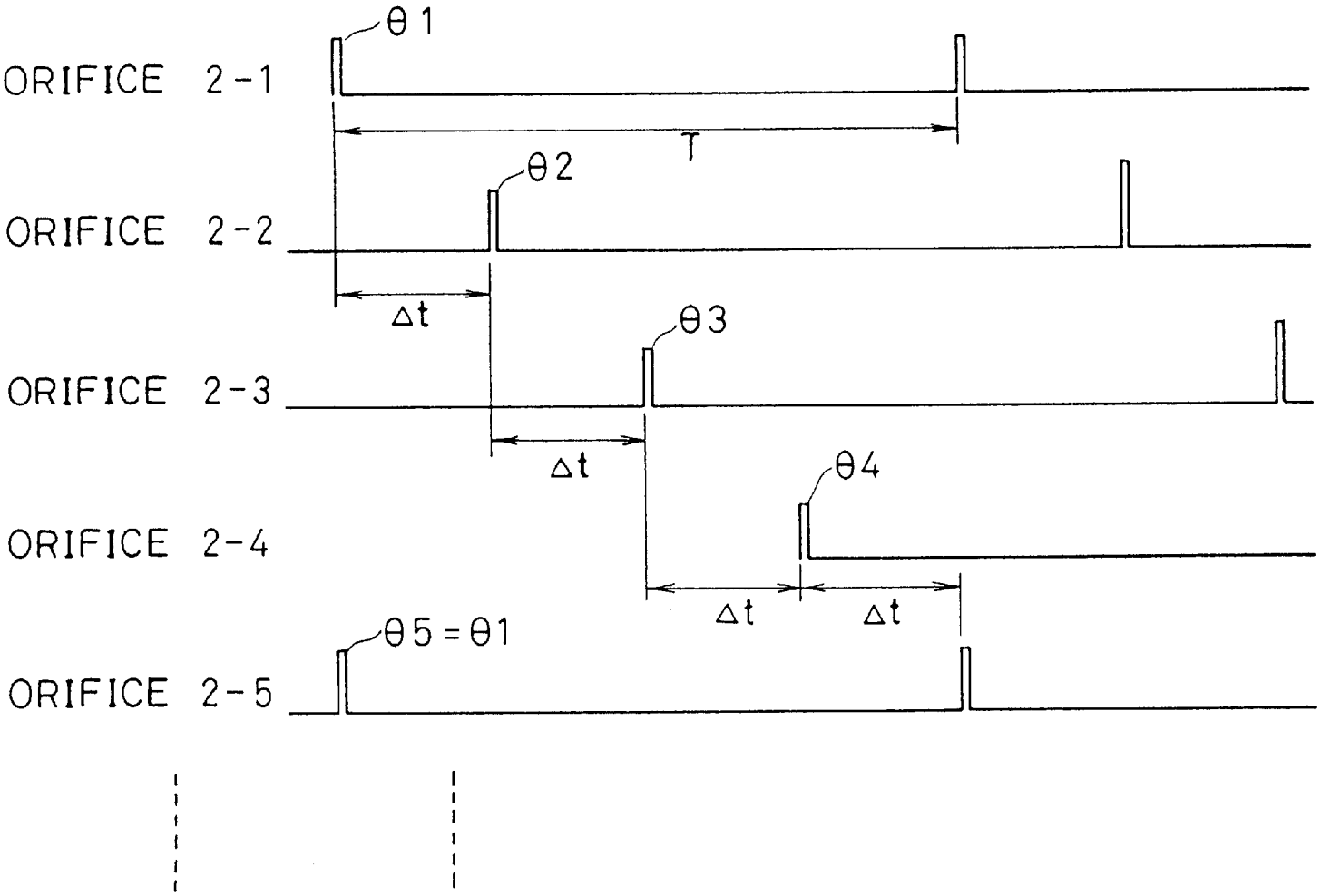
FIG. 27 is a timing chart of recording head driving pulses in embodiment 5.

What is described next is a method for selecting the drive timing and the orifice for ejecting ink droplets in responsive to gray level data. FIG. 27 is a timing chart of the driving pulses to the recording head in this embodiment. In FIG. 27, θ1, θ2, θ3, . . . are driving pulses to make orifices of the recording head eject ink droplets, each corresponding to each of orifices, 2-1, 2-2, 2-3, 2-4, . . . The pulse θ5 has the same timing as the pulse θ1, and after the pulse θ5, pulses θ1 to θ4 are repeated with in the same timing. Δt is the time difference between adjacent driving pulses, θ1 and θ2, η2 and θ3, θ3 and θ4 and so on, each of which is commonly 75 $\mu$sec. T is the ejection cycle of ejecting ink droplets from each orifice, which is 300 $\mu$sec. Table 1 shows the driving pulse and its corresponding driving timing in each of scans in the main-scan direction and the position of pixels.

TABLE 1

| LINE WHERE | ORDER OF DRIVING TIMING | | | |
|---|---|---|---|---|
| A PIXEL IS FORMED (PIXEL UNIT) | 1ST SCAN | 2ND SCAN | 3RD SCAN | 4TH SCAN |
| 4n + 1 | θ1 | θ4 | θ3 | θ2 |
| 4n + 2 | θ2 | θ1 | θ4 | θ3 |
| 4n + 3 | θ3 | θ2 | θ1 | θ4 |
| 4n + 4 | θ4 | θ3 | θ2 | θ1 |

Figure 28:
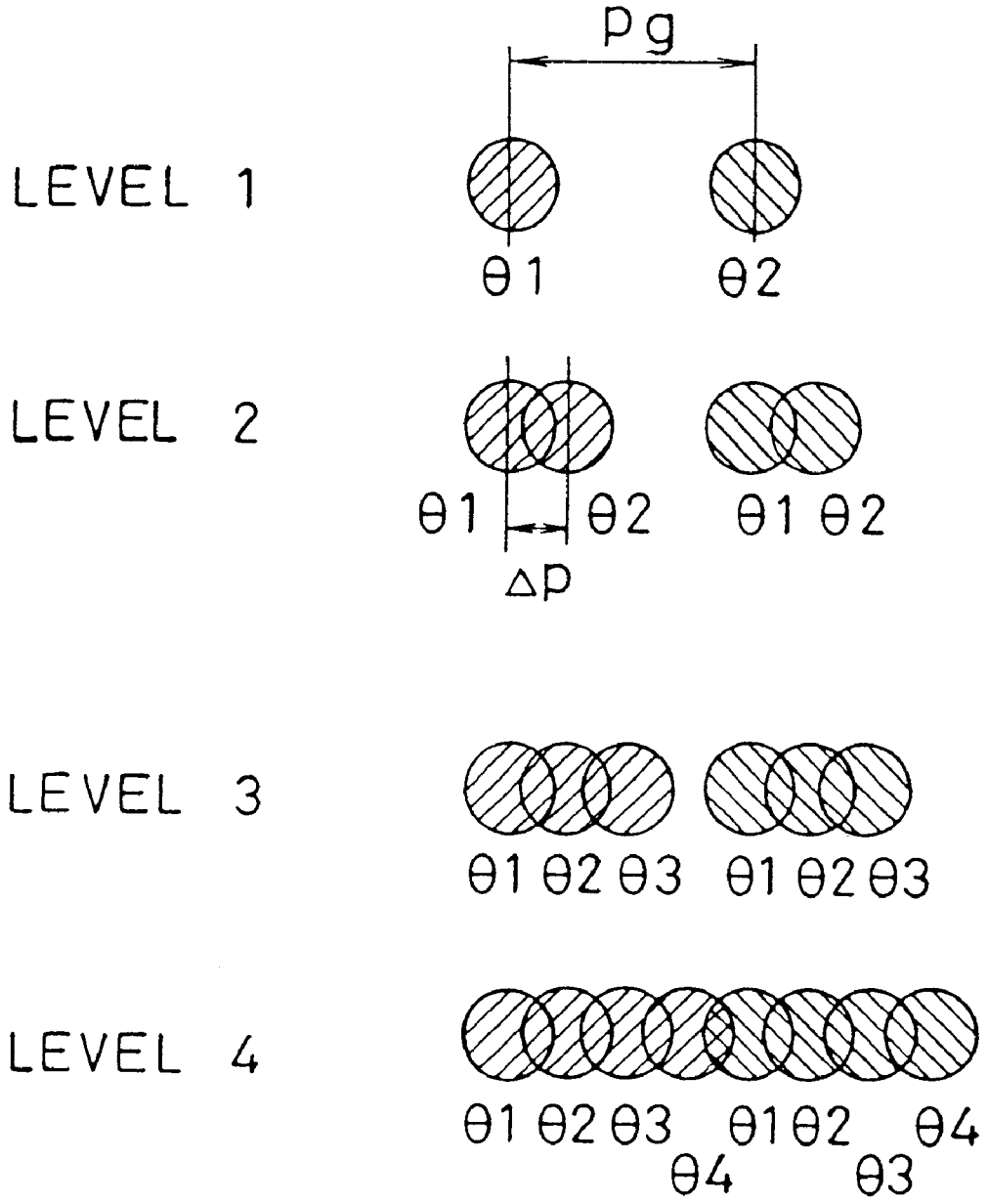
FIG. 28 is a diagrammatic view showing a layout of dots in a pixel in embodiment 5.

For example, if a pixel is located in the (4n+2)-th line, where n is an integer greater than or equal to 0, the first ink droplet is ejected by the pulse θ2 at the first scan, the second ink droplet is ejected by the pulse θ1 at the second scan, the third ink droplet is ejected by the pulse θ4 and the fourth ink droplet is ejected by the pulse θ3. So far, the maximum number of dots forming each pixel is 4. In the case that the image level is from 1 to 3, the driving timing is so selected as to eject ink droplets as promptly as possible. For example, if the image level is 1, ink droplet is ejected only by the pulse θ1, and if the image level is 2, ink droplets are ejected by the pulses θ1 and θ2, and if the image level is 3, then, as described above, ink droplets are ejected by the pulses a θ1, θ2 and θ3. The dot layouts in the pixel formed on the recording sheet with a designated driving timing are diagrammatically shown in FIG. 28. A hatched circle is a dot projected on the recording sheet. In FIG. 28, Pg is the distance between adjacent pixels which is 63.5 μm, and Δt is the distance between adjacent dots, each of which correspond to each of adjacent driving pulses, for example, θ1 and θ2, in this embodiment, which is 0.212 m/s·75 μsec=16 μm. In FIG. 28, θ1, θ2 and so on, each written under the dot, represent the pulse which drives the orifice to eject an ink droplet in order to form its corresponding dot.

Figure 43:
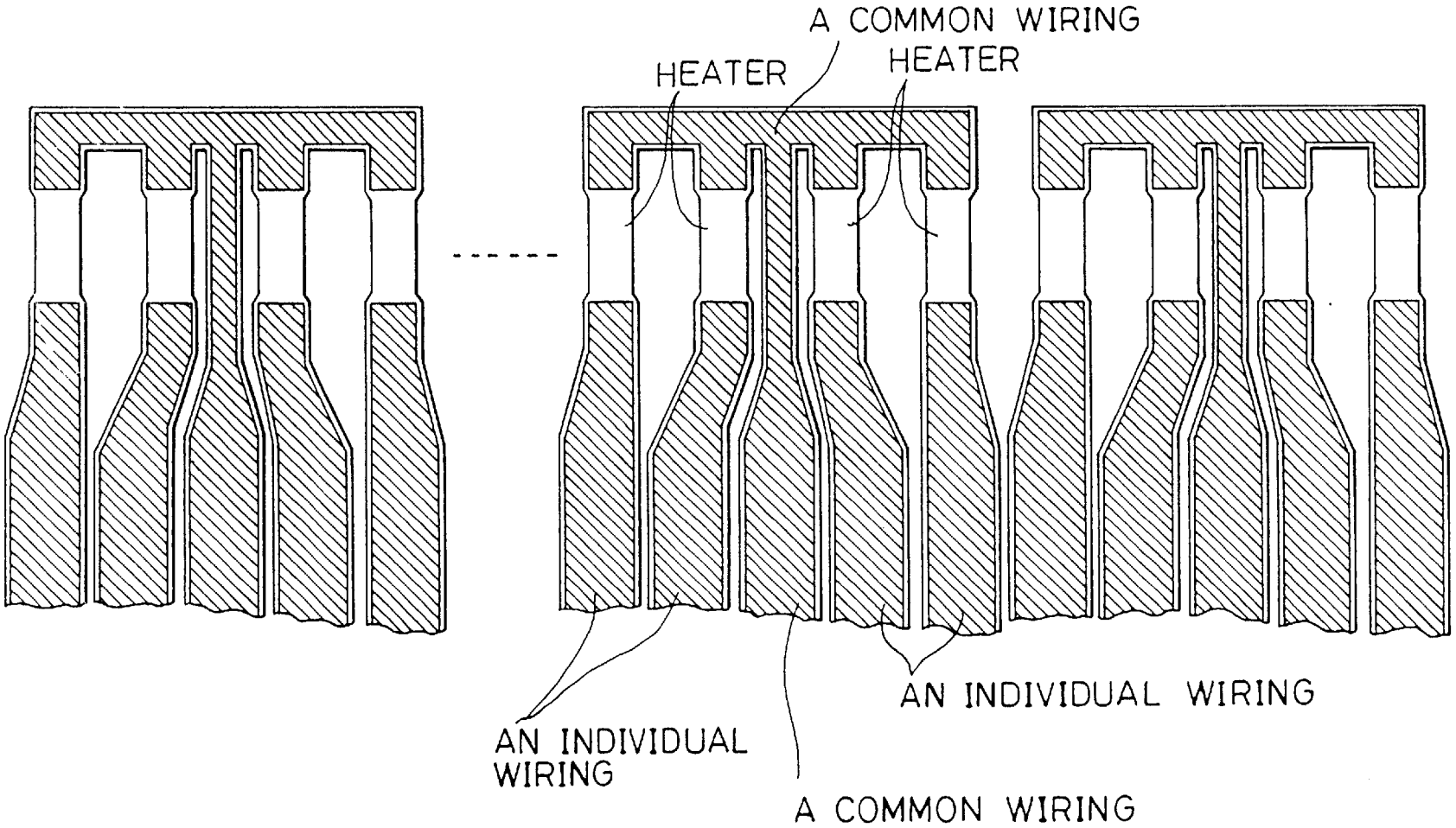
FIG. 43 is a diagrammatic view showing an ejection heater (electro-thermal conversion element) and wirings for driving the ejection heater, both being able to be used in embodiment 5.

In this embodiment, in forming a single pixel on the recording sheet with a plurality of ink droplets, a plurality of ink droplets ejected from different orifices are converged into the area within a single pixel. Owing to this method, even if there is a deviation in the amount of an individual ink droplet from an individual orifice, shading and stripe-noise prints can be avoided. In addition, as a plurality of ink droplets projected on a pixel are uniformly distributed within the pixel, an occupation rate of the area occupied by dots formed by ink droplets to the overall area of the pixel can be increased in comparison with the case that a plurality of ink droplets are projected on an identical position in the pixel so that a desirable optical density can be obtained with a less volume of ink fluids. And furthermore, as found in FIG. 27, the heating resistances of adjacent four orifices are not driven concurrently, a single set of power supply lines can be shared and commonly used to all the four resistances as shown in FIG. 43. With this configuration, the wiring density can be reduced, and the resistance due to wiring resistance can be reduced, which can ultimately save energy. As for such wirings, an example is disclosed in Japanese Patent Application Laid-open No. 208251/1985 by the assignee of the present invention.

In the case that ink droplets are ejected simultaneously from adjacent orifices, there may occur two major problems. In the first problem, owing to the reactive force developed by ejecting ink droplets simultaneously from a plurality of adjacent orifices, the amount of reflux flow in the upward direction in the ink fluid path is a few time multiplied and a high pressure occurs in the ink fluid path near the ink fluid reservoir in comparison with the case that ink droplets are ejected separately from adjacent orifices. It may occur that the high pressure generated in the above described manner may affect the ink fluid path not used for ejection temporarily and that the amount of ink droplets ejected from orifice communicating to this ink fluid path may increase or decrease excessively. Due to this problem, recorded images may contain shading or the drive frequency of the recording head must be reduced. In the second problem, for example, in case of using thermal energy generated by heat resistances (electro-thermal converting elements) for ejecting ink droplets, as electric current should be supplied to a plurality of adjacent heat resistances simultaneously, the wiring pattern density should be limited to a certain level or the wiring resistance becomes higher. In this embodiment, by avoiding that ink droplets are not ejected simultaneously from adjacent orifices, the above described two problems can be solved, and as a result, a method for driving recording heads which have a various kind of design alternatives with respect to hydrodynamics and electric properties can be provided.

Next, as one embodiment without ejecting ink droplets simultaneously from adjacent orifices, what is described is a condition that a plurality of ink droplets forming a single pixel can be ejected from each orifice with an individually different timing within the ejection cycle.

Suppose that N is the number of orifices, q is the pitch between adjacent orifices, the cyclic distance between orifices from which ink droplets are ejected simultaneously is bp where b is a natural number 2 or over, a transporting displacement unit of the recording head in the sub-scan direction is sq where s is a natural number 2 or over, and that g is a greatest common divisor of s and b, then images are recorded with b, N and s satisfying $$b/g>(N/s)-1. \tag{15}$$

The equation (15) is a necessary and sufficient condition that all the plurality of ink droplets forming a single pixel can be ejected at individually separated timings within a single ejection cycle.

All the orifices of the recording head are labeled sequentially with 1 to N, and the orifices used for forming a specific pixel are j, j+s, j+2s, . . . , j+ms, where j is an arbitrary integer between 1 and s, and m=(N/s)−1. In the embodiment 1, s=5, N=20 and m=3. As the orifices from which ink droplets are ejected simultaneously are arranged with distance bq, for example, in FIG. 27, b=4, if the remainders of the labeled numbers of a couple of orifices divided by b are equivalent to each other, ink droplets are ejected simultaneously from these two orifices, but if the remainders calculated in this manner are not identical to each other, ink droplets are not ejected simultaneously from these two orifices. In order to eject a plurality of ink droplets forming a single pixel at individual different timings within a single ejection cycle, it is a necessary and sufficient condition that all the remainders of above described j, j+s, j+2s, . . . , j+ms, divided by b are different values from one another.

This condition can be stated that the minimum value of positive integer solutions of the following equation for an integer x, $$\text{mod}\ (j,\ b)=\text{mod}\ (j+xs,\ b), \tag{16}$$

is greater than m.

The equation (16) means that xs is a multiple of b. Suppose that g is the maximum common divisor of s and b, s=gs' and b=gb', where s' and b' are relatively prime numbers. Therefore, the equation (16) is equivalent to the condition that xs' is a multiple of b' and s' and b' are relatively prime numbers. The minimum value of positive integer solutions of the equation (16) is b'. Therefore, if b' is greater than m, that is, the condition given by the equation (15) is satisfied with this solution, all the remainders of above described j, j+s, j+s, j+2s, . . . , j+ms, divided by b are different values from one another, which means that all the plurality of ink droplets forming a single pixel cannot be ejected at an identical timing within a single ejection cycle. In this embodiment, as described above, the condition given by the equation (15) is satisfied with s=5, N=20, m=3 and b=4.

Embodiment 5A

Figure 29:
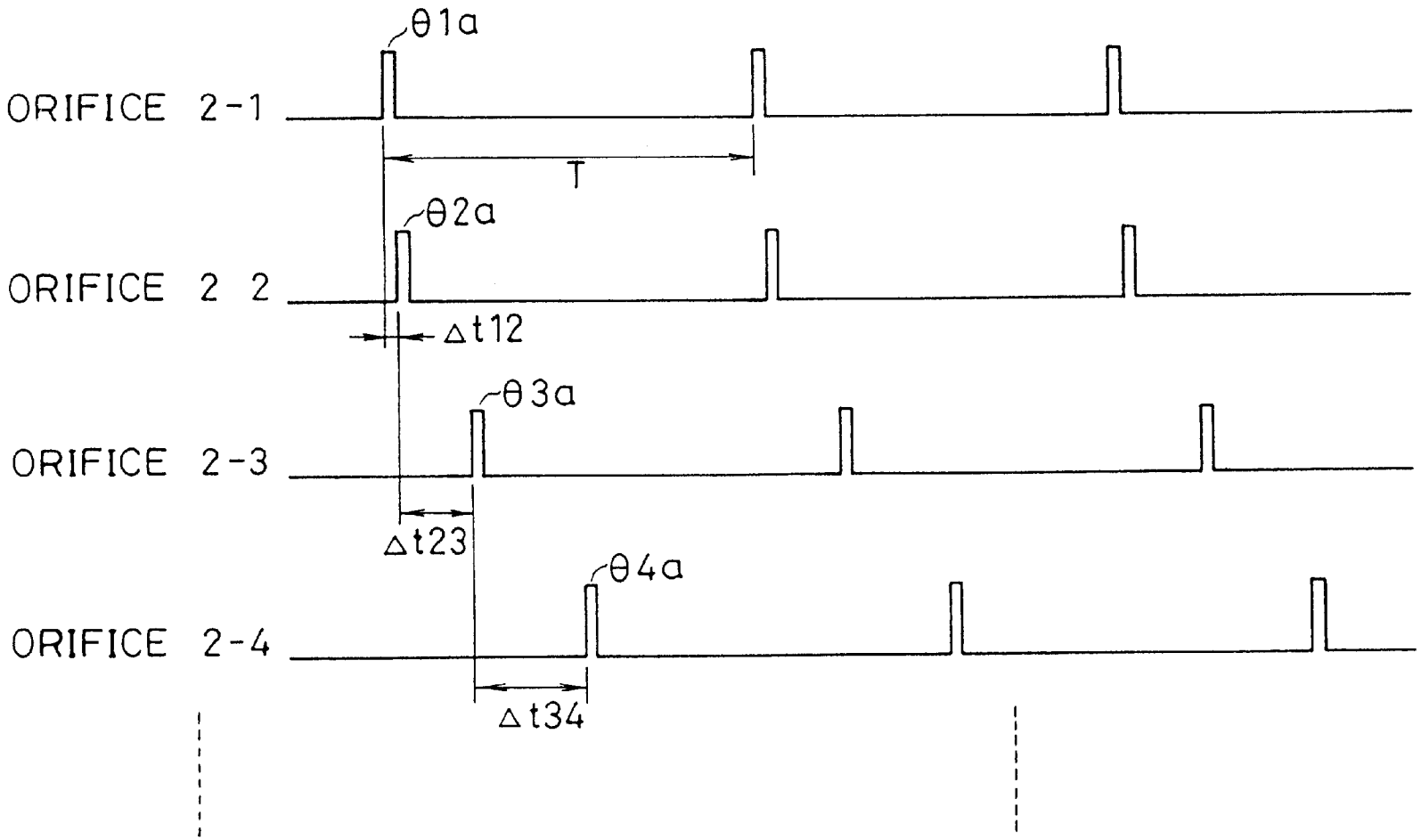
FIG. 29 is a timing chart of recording head driving pulses in embodiment 5A.

This embodiment is a modification of the embodiment 5 with respect to driving timing, and the relationship between the image level data and the optical density of the recorded images is made to be more proportional. FIG. 29 is a timing chart of driving pulses to the recording head of this embodiment. θ1*a*, θ2*a*, θ3*a*, θ4*a*, . . . are driving pulses to make orifices of the recording head eject ink droplets, each corresponding to each orifices, 2-1, 2-2, 2-3, 2-4, . . . $\Delta t_{12}$ is the time difference between θ1*a* and θ2*a*, $\Delta t_{23}$ is the time difference between θ2*a* and θ3*a*, $\Delta t_{34}$ is the time difference between θ3*a* and θ4*a*, and $\Delta t_{12}$ is 25 μsec, $\Delta t_{23}$ is 75 μsec and $\Delta t_{34}$ is 125 μsec. A method for selecting driving timings with respect to designated image levels and the displacement unit in the scanning direction are the same as those used in the embodiment 5.

Figure 30:
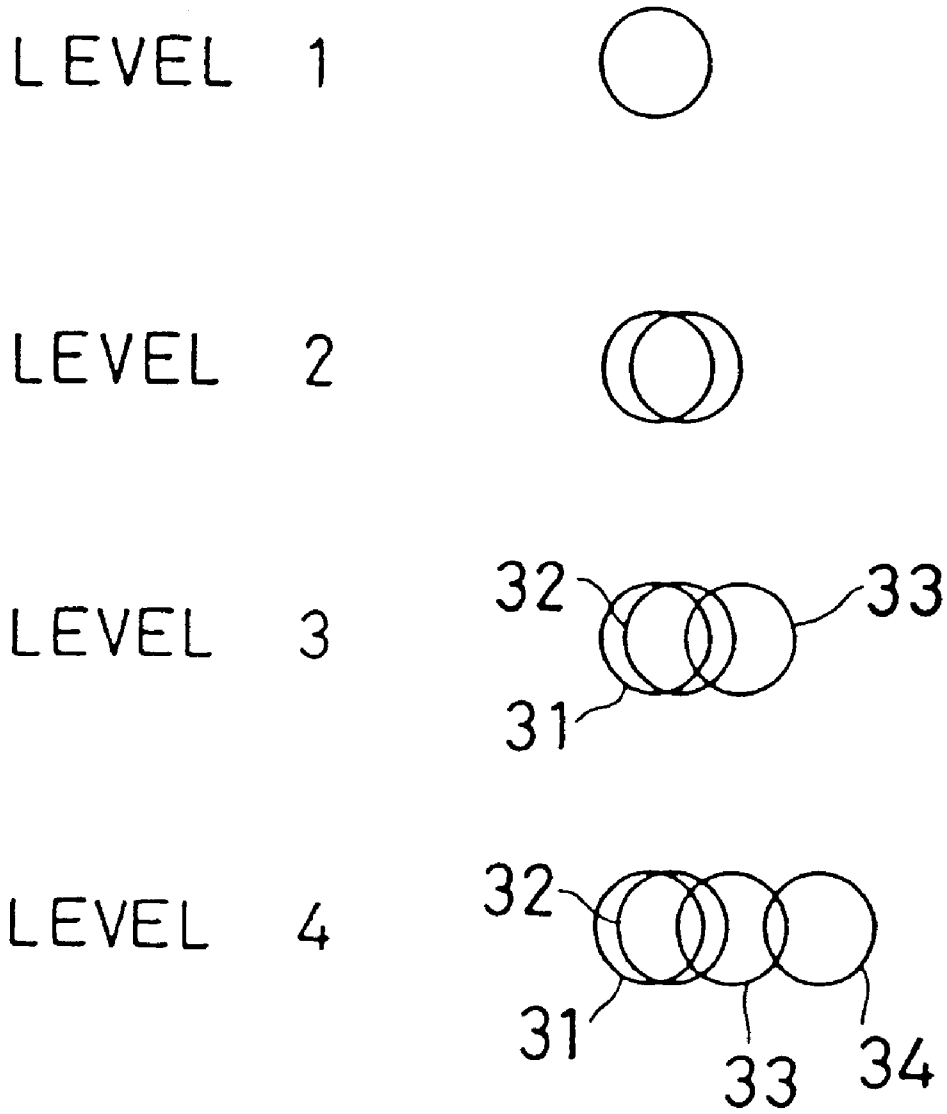
FIG. 30 is a diagrammatic view showing a layout of dots in a pixel in embodiment 5A.
Figure 31:
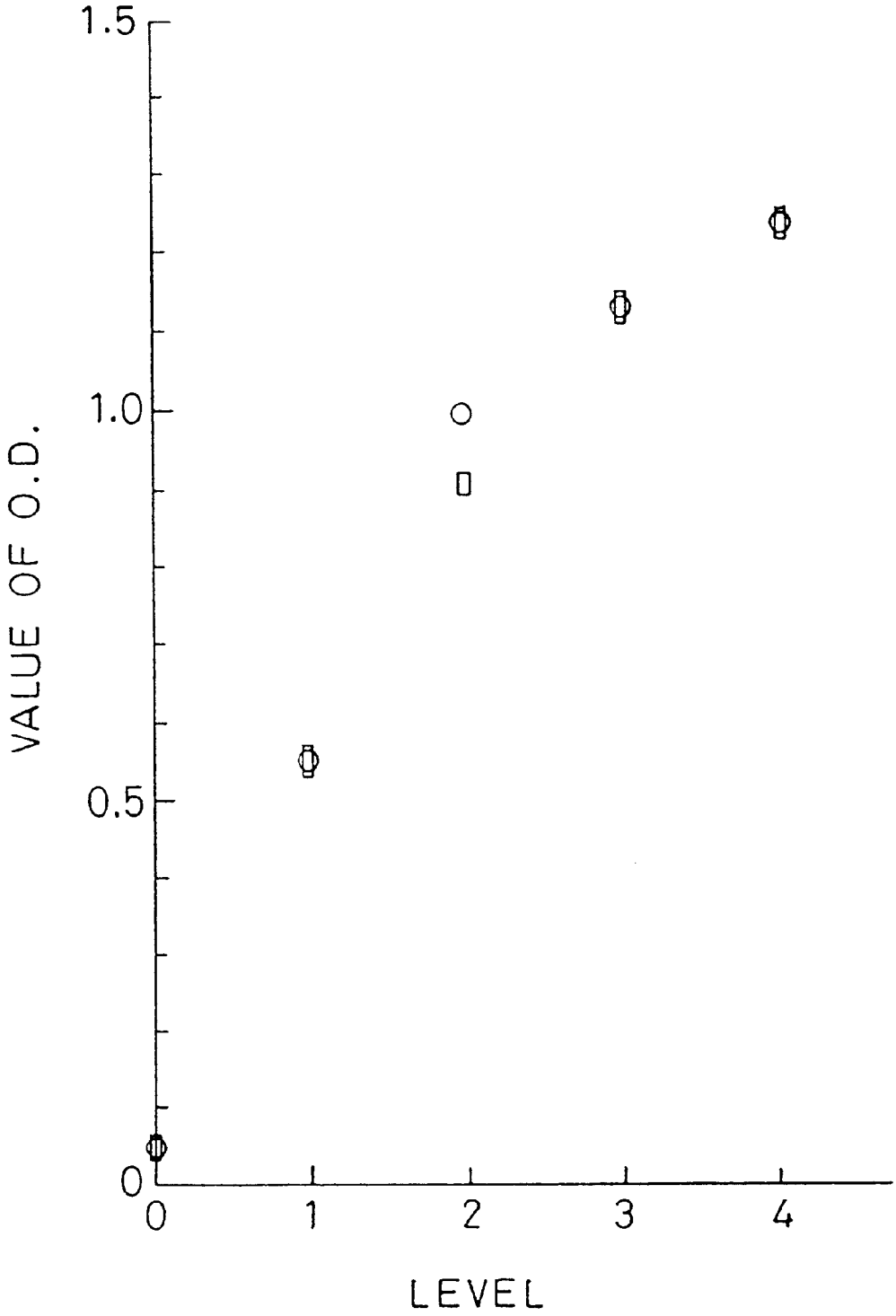
FIG. 31 is a diagram illustrating a relationship between a layout of dots in a pixel and optical density of a recorded image in embodiment 5A.

The dot layouts in the pixel formed on the recording sheet with a designated driving timing are shown in FIG. 30. As found in FIG. 30, at the image level 2, the distance between two adjacent dots is about 5.3 μm, and at the image level 3, the third dot 33 is apart more than 16 μm from the first dot 31 and the second dot 32. AT the image level 4, the fourth dot 34 is far apart 26.5 μm from the third dot 33. When a plurality of ink droplets are projected within an area for a single pixel, the optical density is lower in the case that a plurality of ink droplets are projected on an identical position rather than the case that a plurality of ink droplets are projected on distributed positions. In particular, at the image level 2, the optical density given by this embodiment is lower than that of the embodiment 1. As for the image levels 3 and 4, the optical density given by this embodiment is indifferent from that of the embodiment 5. In FIG. 31, the relationship between the image level data and the optical density. In FIG. 31, circle symbols represent cases of the embodiment 5, and box symbols represent cases of this embodiment. In this embodiment, the proportionality between the image level and the OD value increases and it will be appreciated that gray-scale images can be precisely recorded.

In this embodiment, it may be also allowed that the OD value at high image level data is increased with keeping the OD value at lower image level by changing the time differences between θ1*a* and θ2*a*, θ2*a* and θ3*a*. The time difference between θ1*a* and θ2*a*, for example, is shorten in the case of image level being low, and is enlarged in the case of image level being high.

Embodiment 5B

Figure 32:
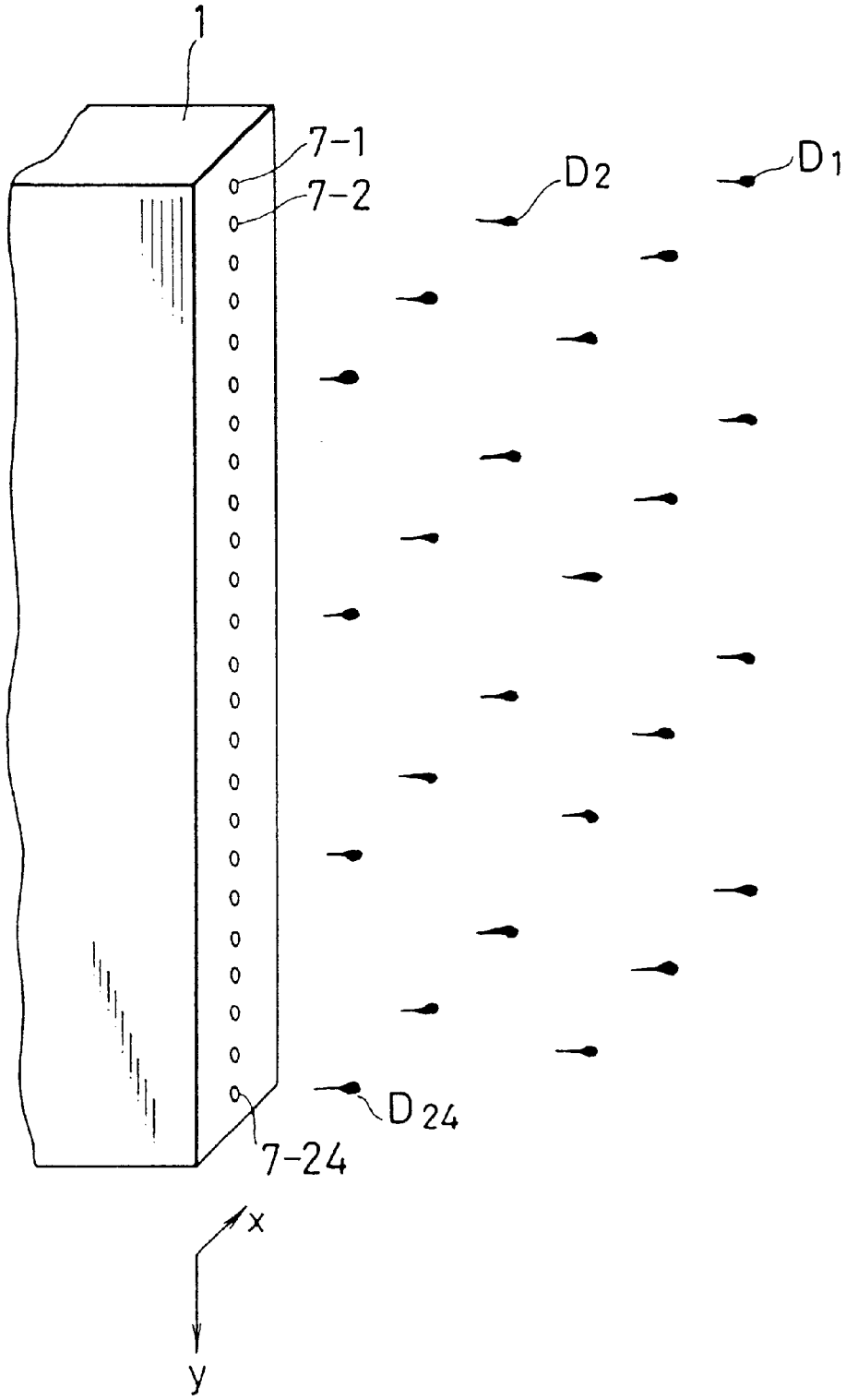
FIG. 32 is a diagram of recording heads and ejected ink droplets for explaining a recording method in embodiment 5B of the present invention.

FIG. 32 is a diagrammatic picture illustrating a recording method of the embodiment 5B. In FIG. 32, the recording head 1 has 24 orifices No. 7-1 to 7-24. $D_1$ to $D_{24}$ are ink droplets ejected from all the orifices at a moment picture.

Figure 33:
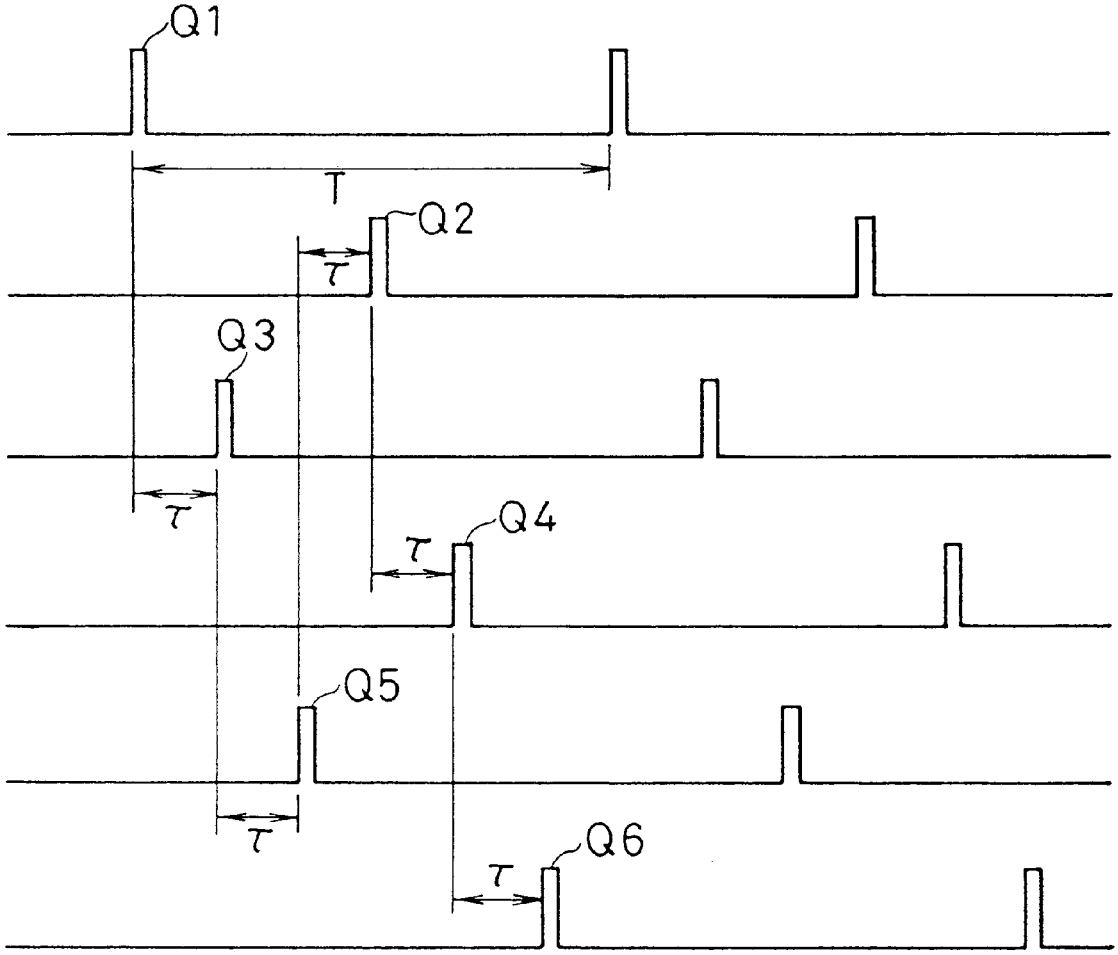
FIG. 33 is a timing chart of recording head driving pulses in embodiment 5B.

FIG. 33 is a timing chart of driving pulses to the recording head of this embodiment. In FIG. 33, $Q_1$, $Q_2$, and so on are electric pulses applied to heat resistances not shown, each of which correspond to orifices 7-1, 7-2 and so on. T is a driving cycle of each heat resistance, which is 300 μsec.

Time differences, τ, between Q1 and Q3, between Q3 and Q5, between Q5 and Q2, between Q2 and Q4 and between Q4 and Q6, are 50 μsec. As found in FIG. 33, the minimum time difference between ejections from a couple of adjacent orifices is 2τ=100 μsec. In this embodiment, the pitch of orifices is 70.7 μm and the scan speed of the recording head is 0.236 m/sec. Every after the main scanning, the recording head is moved 565.6 μm (=70.7 μm×8) in the sub-scanning direction, which is the y direction in FIG. 32 and the next main scan is prepared. One ink droplet can be projected on a pixel every scanning, that is, up to 3 ink droplets can be projected by three scans, and images with 4 gray levels can be recorded with up to 3 ink droplets. Table 2 shows the driving pulse and its corresponding driving timing in each of scans in the main-scanning direction and the position of pixels.

TABLE 2

| LINE WHERE | ORDER OF DRAWING TIMING | | |
|---|---|---|---|
| A PIXEL IS FORMED (PIXEL UNIT) | 1ST SCAN | 2ND SCAN | 3RD SCAN |
| 6n + 1 | Q1 | Q5 | Q3 |
| 6n + 2 | Q2 | Q6 | Q4 |
| 6n + 3 | Q3 | Q1 | Q5 |
| 6n + 4 | Q4 | Q2 | Q6 |

TABLE 2-continued

| LINE WHERE | ORDER OF DRAWING TIMING | | |
|---|---|---|---|
| A PIXEL IS FORMED (PIXEL UNIT) | 1ST SCAN | 2ND SCAN | 3RD SCAN |
| 6n + 5 | Q5 | Q3 | Q1 |
| 6n + 6 | Q6 | Q4 | Q2 |

As found in Table 2, for the image level 1, when recording images on odd lines, the recording head is driven by the pulse Q1, and when recording images on even lines, the recording head is driven by the pulse Q2. For the image level 2, when recording images on odd lines, the recording head is driven by the pulses Q1 and Q3, and when recording images on even lines, the recording head is driven by the pulses Q2 and Q4. For the image level 3, the recording head is driven by all the pulses shown in Table 2.

Figure 34B:
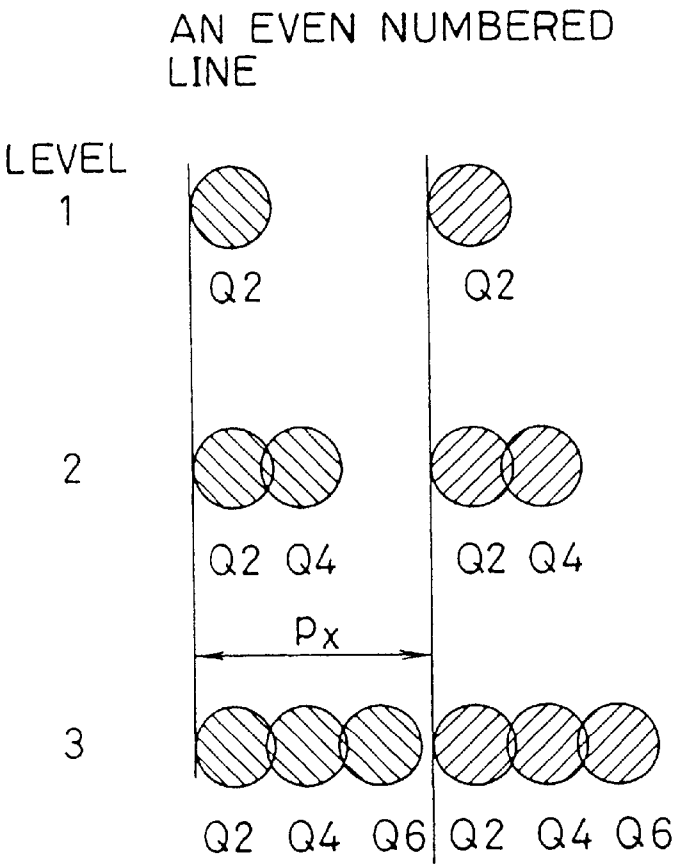
FIGS. 34A and 34B are diagrammatic views showing a layout of dots in a pixel in embodiment 5B.
Figure 34A:
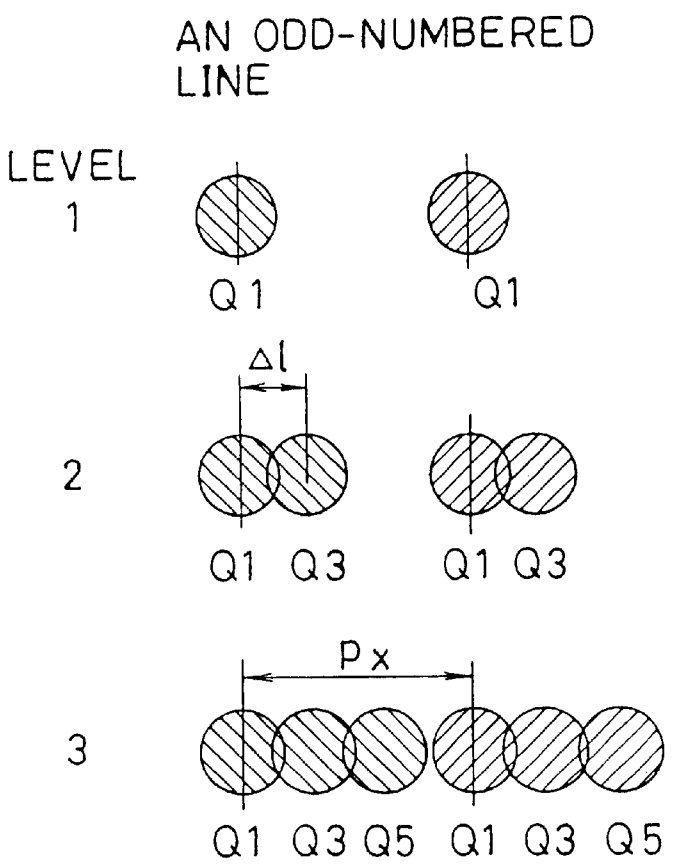

The dot pattern layouts in the pixel formed on the recording sheet with a designated driving pulses are shown in FIGS. 34A and 34B. Dot patterns are shown separately with respect to recording images on odd lines and even lines, where hatched circle symbols represet dots, and letters such as Q1 and Q2 assigned to each dot are pulses for ejecting an ink droplet in order to form its corresponding dot on the recording sheet. Px is the pitch of pixels in the scan direction, 70.7 μm, Δ1 is the distance between the centers of adjacent dots, 23.6 μm. As found in FIGS. 34A and 34B, although the positions of dots in both cases of recording images on even lines and odd lines are slightly different by about 12 μm, this difference is far smaller than the pitch of pixels and hence, this makes no effect on actual recording operations.

Unlike the embodiments 5 and 5A, in this embodiment, the relative position of dots in relative to the pixel changes in responsive to on what line the pixel is formed, even if the gray level is not altered. If the amount of shift of dot positions is small enough in comparison with the pitch of pixels, this shift may not affect the quality of recorded images. For example, even if ink droplets are ejected from all the orifices with individual different timings, an effect similar to this embodiment can be obtained.

In this embodiment, as the ejection cycle is longer than that in the embodiments 5 and 5A, electric wirings can be formed more efficiently. In addition, the time difference between ejections from two adjacent orifices is longer than that in the embodiments 5 and 5A, and ejections of ink droplets can be stable from the hydraulic standpoint. The condition defined by the equation (15) is also satisfied in this embodiment.

Embodiment 6

This embodiment is an example of a method of driving recording heads for recording colored images while, in the above described embodiments 5, 5A and 5B, described is a method for driving recording heads for recording monochromatic gray-scale images.

Figure 35:
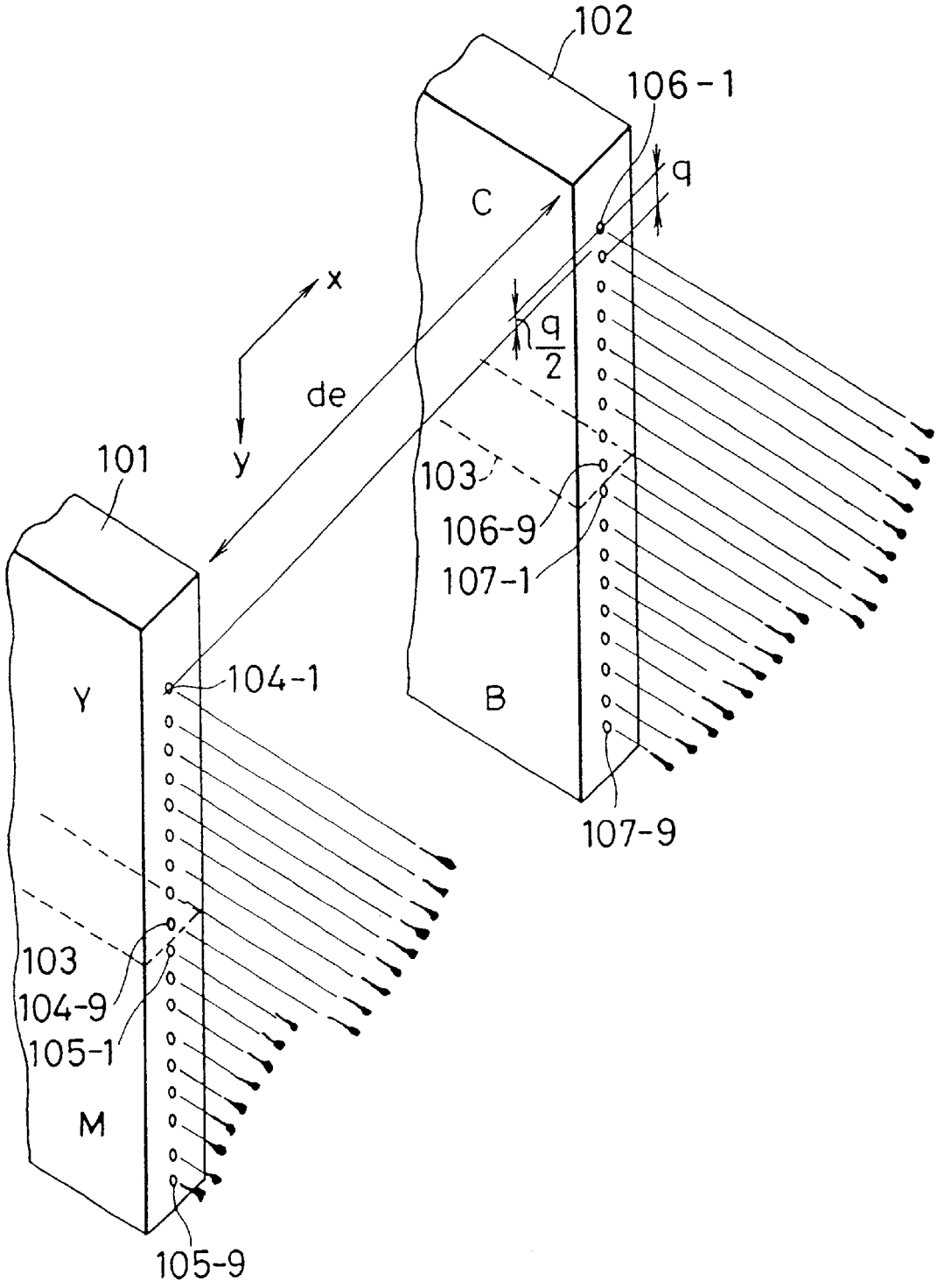
FIG. 35 is a diagrammatic view of recording heads and ejected ink droplets for explaining a recording method in embodiment 6 of the present invention.

FIG. 35 is a diagrammatic picture illustrating a recording method of this embodiment. In FIG. 35, components 101 and 102 are recording heads, which are mounted parallel to each other on a carriage not shown so that they can scan in the x direction and record images. Their y-directional positions are shifted by q/2, where q is the pitch of orifices. Inside of each of recording heads 101 and 102 is separated by the wall 103 and each of separated ink reservoirs inside the recording head contain a designated color ink fluid. An ink reservoir installed inside the upper part of the recording head 101 contain an yellow (Y) ink fluid, an ink reservoir installed inside the lower part of the recording head 101 contains a magenta (M) ink fluid, an ink reservoir installed inside the upper part of the recording head 102 contains a cyan (C) ink fluid and an ink reservoir installed inside the lower part of the recording head 102 contains a black (B) ink fluid. Nine orifices are formed for each of ink reservoirs for individual colored ink fluids, such as 104-1 to 104-9 for (Y), 105-1 to 105-9 for (M), 106-1 to 106-9 for (C) and 107-1 to 107-9 for (B). The pitch of orifices, q, is 63.5 $\mu$m, and the distance between the recording heads 101 and 102, de, is 12.70 mm. Every time after scanning the recording heads at 0.132 m/sec in the x direction (main-scanning direction), the recording heads are shifted by 9q=570.5 $\mu$m in the y direction (sub-scanning direction) and prepared for the next main-scan operation, and these operations are repeated. During these operations, ink droplets having different color from that ejected in the previous scans are projected on an identical pixel.

Figure 36:
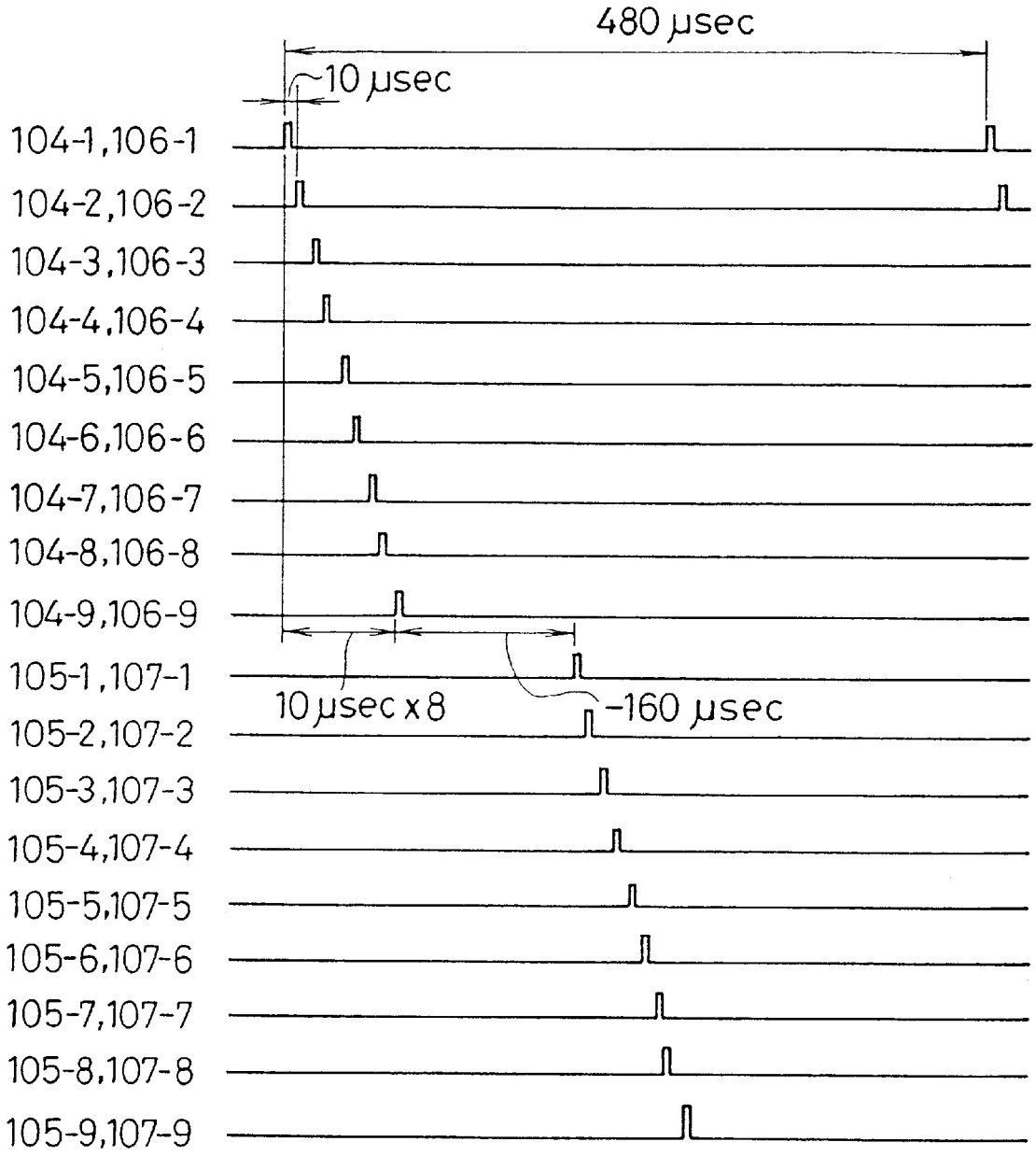
FIG. 36 is a timing chart of recording head driving pulses in embodiment 6.

FIG. 36 is a timing chart of driving pulses driving heat resistances not shown, each corresponding to each orifice for ejecting ink droplets. The time difference between ejections from orifices ejecting an identical color ink fluid is 10 $\mu$sec. The time difference between ejections from orifices ejecting difference color ink fluids is 160 $\mu$sec. Owing to this timing difference between ejections of yellow (Y) ink fluids and magenta (M) ink fluids, the positions of dots projected on the recording sheet are shifted by the half of the pitch of orifices, about 32 $\mu$m, in the x direction. Dots of Cyan (C) ink fluids and black (B) ink fluids projected on the recording sheets are also shifted in the same manner. As shown in FIG. 35, the position of dots of yellow (Y) and magenta (M) and the position of dots of cyan (C) and black (B) have a difference by the half of the pitch of orifices. Therefore, these ink droplets are projected on each of four corners of a right square defined by a single pixel.

What have been recognized is a problem that, if an identical position within the pixel on which a plurality of ink droplets having different ink colors are projected, the chromaticness of recorded images cannot be attained to be high enough due to the mixture of colored ink fluids. In this embodiment, as individual different color ink fluids are projected on corners of a right square in order to define a pixel, the chromaticness of recorded images can be increased. In addition, also in this embodiment, as a single pixel is formed by ink droplets ejected from a plurality of different orifices, shading on recorded images and stripe-noise can be reduced. When recording images including three color ink fluids, this embodiment may be modified in order to define a pixel to be a triangle, each corner of which is occupied by an ink droplet having one of three ink colors.

Embodiment 7

Figure 37:
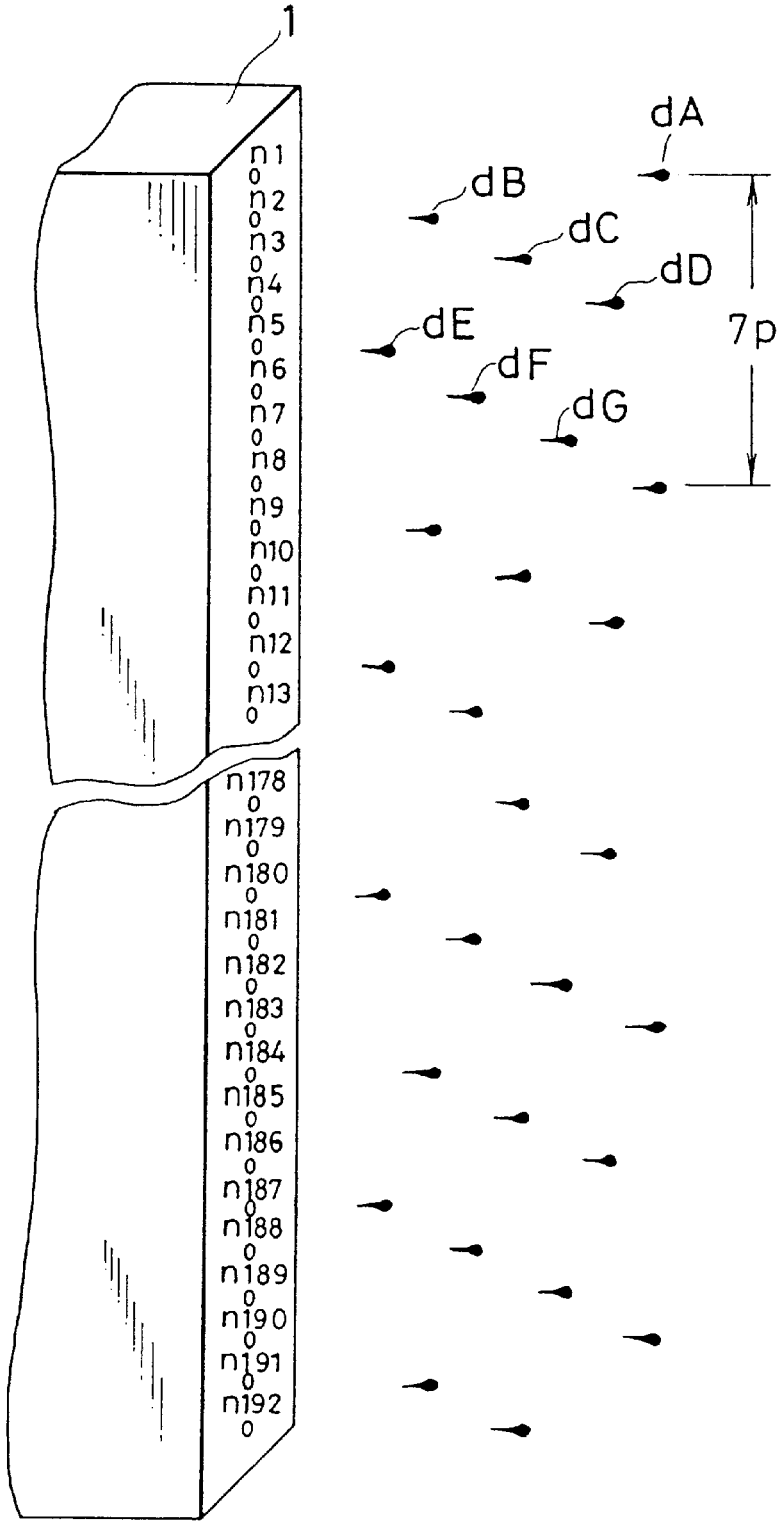
FIG. 37 is a diagrammatic view of recording heads and ejected ink droplets for explaining a recording method in embodiment 7 of the present invention.
Figure 38:
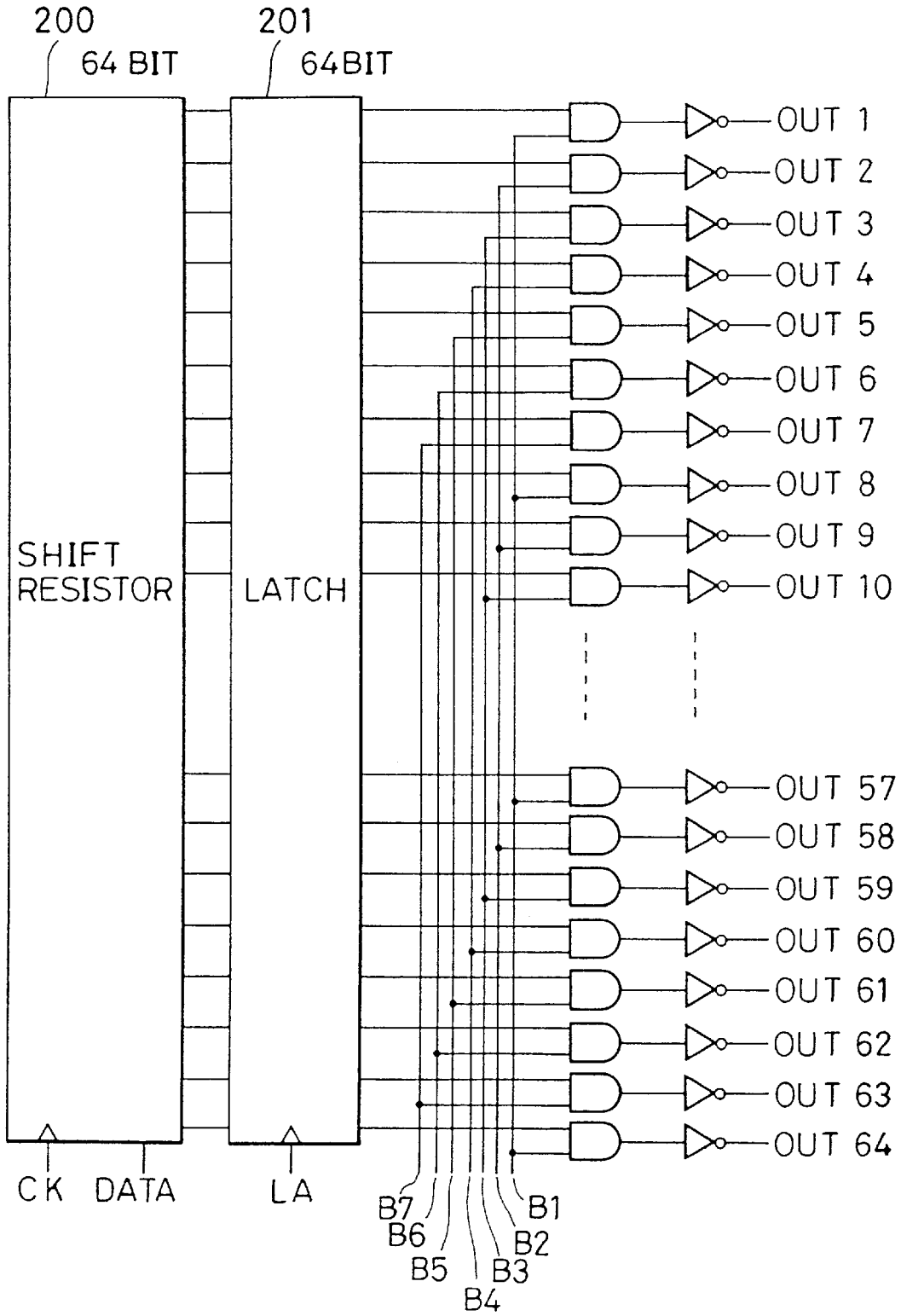
FIG. 38 is a circuit diagram of an IC for driving a recording head used in embodiment 7.
Figure 39:
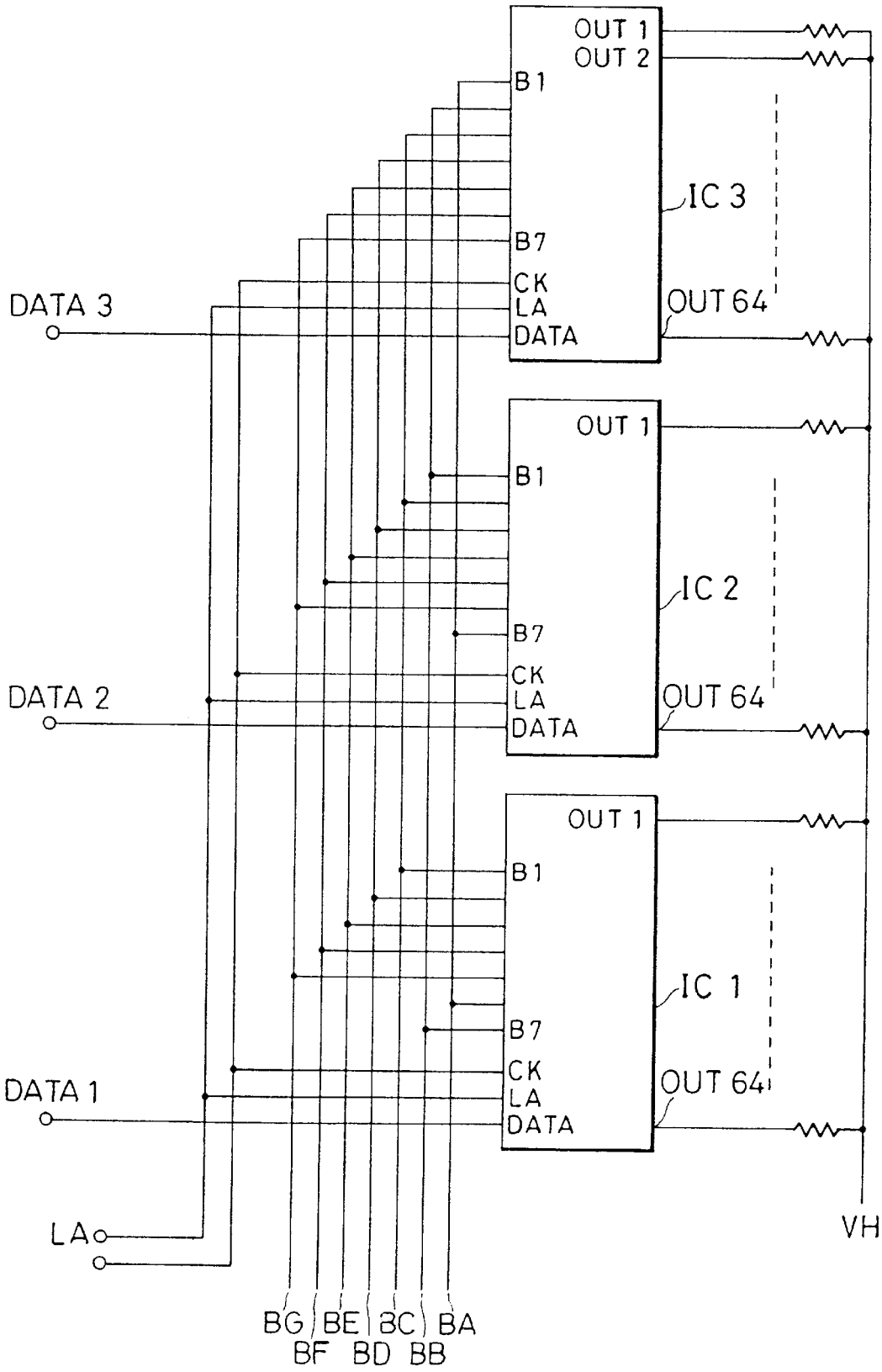
FIG. 39 is a circuit diagram of a recording head driving circuit using the IC shown in FIG. 38.
Figure 40:
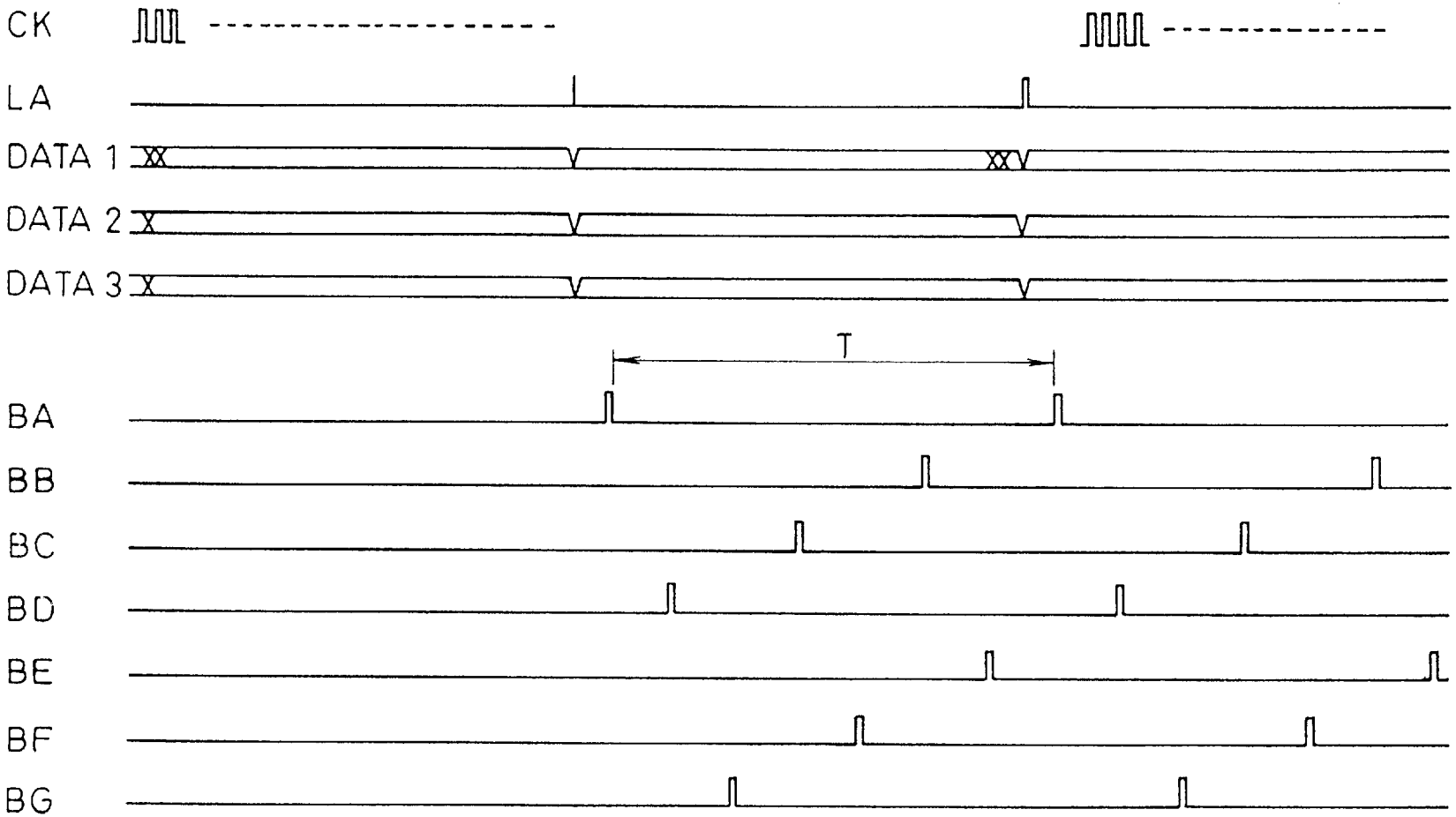
FIG. 40 is a timing chart of driving signals for a circuit shown in FIG. 39.

The embodiment 7 is described in FIGS. 37 to 40. FIG. 37 is a diagrammatic picture illustrating a method for recording images of this embodiment, where n1, n2, . . . n192 are orifices, and dA, dB, . . . dG are ejected ink droplets. That is, the recording head used in this embodiment has 192 orifices. FIG. 38 is a circuit diagram developed in the IC for driving recording heads shown in FIG. 37. FIG. 39 is a circuit diagram of the circuit for driving the recording head by using the IC with its circuit shown in FIG. 38. FIG. 40 is a timing chart of driving pulses for driving the circuit shown in FIG. 39.

In this embodiment, every after the main scanning with moving the recording head in the main-scanning direction once, the recording head is moved by 64 pitches of orifices in the sub-scanning direction, and the next main scanning operation is prepared. Three ink droplets can be projected on a pixel every scanning, and images with 4 gray levels can be recorded with up to 3 ink droplets. The minimum distance between orifices ejecting ink droplets simultaneously is 7 pitches of orifices. That is, enable signals BA, BB, BC, BD, BE, BF and BG shown in FIG. 40 having individual generating timings respectively within an identical ejection cycle are assigned sequentially to n1, n2, n3 . . . , and n192, respectively. In FIG. 38, CK is a clock signal, and LA is a latch signal, and when data containing 64 bit contents are fully stored in the shift resister 200, they are transferred to the latch 201.

B1, B2, B3, . . . , B7 shown in FIG. 38 are lines for transmitting recording signals to individual blocks and are assigned to each from the 1st bit to the 64th bit. Out 1 to Out 64 are output signal terminals.

In FIG. 39, IC3 control the ejection from orifices n1 to n64, IC2 controls the ejection from orifices n65 to n128 and IC1 controls the ejection from orifices n129 to 192. The drive enable signals, BA, BB, BC, BD, BE, BF and BG assigned to inputs of IC3, IC2 and IC1 sequentially and periodically. The last bit of IC3 is assigned with the drive enable signal BA. As the first bit line B1 of IC2 should be assigned with the enable signal BB, the enable signal BB is supplied to the line B1 of IC2. So far, the enable signal BC is supplied to the line B2, and the enable signal BD is supplied to the line B3. Therefore, the enable signal BB is supplied to the 64th bit of IC2. In order to supply the enable signal BC into the first bit of IC1, the enable signal BC is supplied to the line B1 of IC1. So far, the enable signal BD is supplied to the line B2, ad the enable signal BE is supplied to the line B3 and so on.

In the first scan, IC1 is driven, and in the second scan after 64 pitches sub-scanning, IC1 and IC2 are driven, and next, after 64 pitches sub-scan, in the third scan, IC1, IC2 and IC3 are driven. In the second scan from the last, IC3 and IC2 are driven, and finally in the last scan, IC3 is driven.

Table 3 shows what enable signal and what orifice form ink droplets to be projected a designated pixel.

TABLE 3

| LINE WHERE A PIXEL IS FORMED | ORIFICE FOR USE/ ENABLE SIGNAL | | | | |
|---|---|---|---|---|---|
| (PIXEL | FIRST | SECOND | THIRD | IMAGE LEVEL | |
| UNIT) | SCAN | SCAN | SCAN | 1 | 2 |
| 1 | 129/BC | 65/BB | 1/BA | 1 | 1,129 |
| 2 | 130/BD | 66/BC | 2/BB | 130 | 130,66 |
| 3 | 131/BE | 67/BD | 3/BC | 67 | 67,3 |
| 4 | 132/BF | 68/BE | 4/BD | 4 | 4,132 |
| 5 | 133/BG | 69/BF | 5/BE | 133 | 133,69 |
| 6 | 134/BA | 70/BG | 6/BF | 134 | 134,70 |
| 7 | 135/BB | 71/BA | 7/BG | 71 | 71,7 |
| 8 | 136/BC | 72/BB | 8/BA | 8 | 8,136 |
| 9 | 137/BD | 63/BC | 9/BN | 137 | 137,73 |
| : | : | : | : | : | : |

In Table 3, orifice ID's are also shown for ejecting ink droplets at image levels 1 and 2 to be projected a designated pixel. That is, at the intermediate image level, a desirable enable signal is selected sequentially from BA to BD, BG, BC, BF BB and to BE and its corresponding orifices are also selected. Thus, an orifice is so selected that the orifice may be driven as promptly as possible within a single ejection cycle T shown in FIG. 40. The information for ejecting an ink droplet at the second or the third main scan when passing through over a designated pixel is stored in a memory and, in the second and the third main scans, this information is loaded on DATA2 and DATA3 for drive designated orifices.

In this embodiment, orifices used in the above described manner are determined definitely according to Table 3. The advantages with this method include that the position of dots projected on a pixel are not changed too much from pixel to pixel with a specific image level given and hence, the evenness and sharpness of recorded images can be increased. The disadvantages with this method include that specific electro-thermal conversion elements are used so frequently when recording images including intermediate gray-scale colors. For example, electro-thermal conversion elements corresponding to orifices n1, n4, n8 and n130 and so on are included in, this case. These elements may come to fail to eject ink droplets or be damaged after a long term operation, and the life time of the recording head may be decreased. In order to solve this problem, though the evenness and sharpness of recorded images is sacrificed, in recording images with intermediate gray-scale colors such as image levels 1 and 2, it is effective to randomize the selection of orifices or to select orifices that the frequency of ejecting ink droplets is uniform from orifice to orifice which is disclosed in Japanese Laid-open Patent Application No. 361054/1992, which matured from Japanese Patent Application No. 136609/1991 by the assignee of the present invention.

In this embodiment, as N=192, s=61 and b=7, the condition given by the equation (15) can be satisfied by b/g=7 and N/s=3, where g=1.

In this embodiment, three IC's are used for drive 192 orifices, and OUTn's with n being between 1 and 64 from each IC can be controlled so as to satisfy the condition defined in the present invention without using various kinds of IC's, this embodiment gives advantages in reducing the fabrication cost. In addition, as data for the first, second and third scans can be stored separately as individual serial data, this embodiment gives advantages in forming a recording apparatus. That is, data including information on images to be recorded are converted into signals for ejecting ink droplets from orifices at the first, second and third scans in the image process circuit, the signals for ejecting ink droplets at the first scan are promptly forwarded to DATA1, and the signals for ejecting ink droplets at the second and third scans are stored in a memory temporarily so as to be forwarded to DATA2 and DATA3, respectively, in responsive to scanning signals in the consecutive scans.

In this embodiment, though an orifice corresponding to single ink droplet is driven by a single IC, a plurality of IC's may be used in case of using recording heads having more orifices. This modification can be possible by means that the number of orifices and driving timings are determined so that there may be no remainder when the number of orifices driven by a single IC, which is 64 in this embodiment, is divided by the number of driving timings, which is 7 in this embodiment.

Embodiment 8

Figure 41:
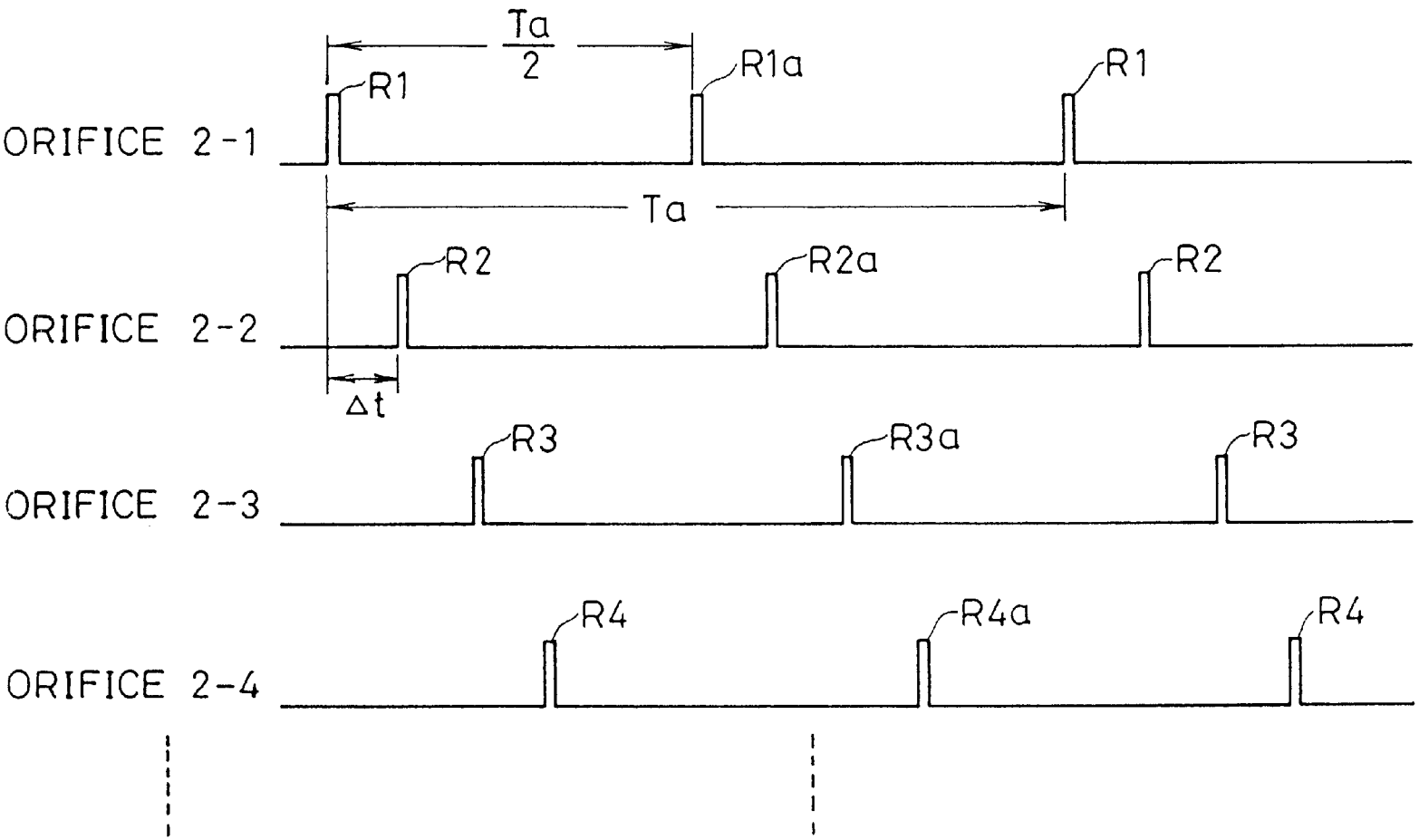
FIG. 41 is a timing chart of recording head driving pulses in embodiment 8 of the present invention.
Figure 42:
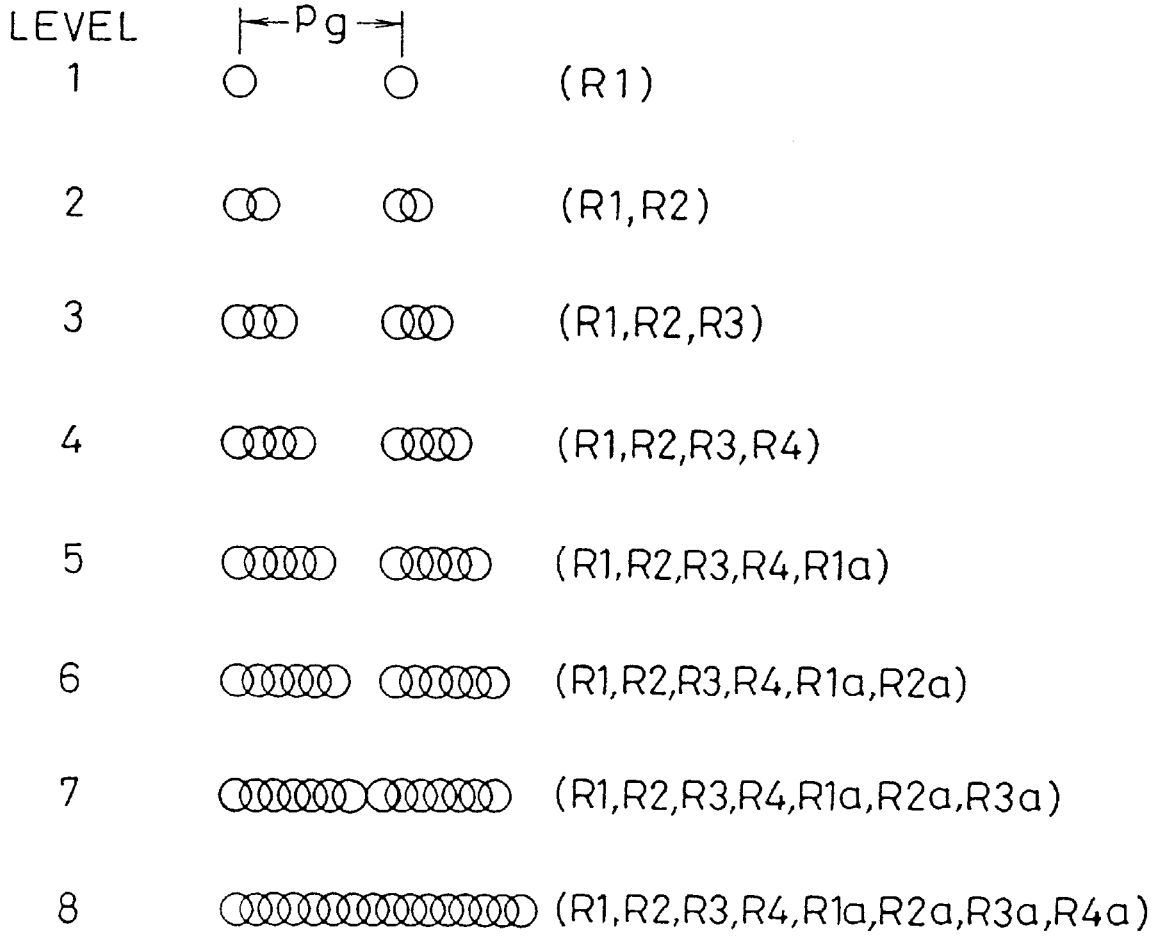
FIG. 42 is a diagrammatic view showing a layout of dots in a pixel in embodiment 8.

FIG. 41 is a timing chart of driving pulses of a recording head of the embodiment 8, and FIG. 42 is a dot pattern layout in a pixel in the embodiment 8. The recording head used in this embodiment is similar to that of the embodiment 5.

The advantageous feature of this embodiment is that there is a case that a plurality of ink droplets are projected on a single pixel with a single scan so that the number of gray levels more than the number of scans may be established. For example, with 4 scans per single pixel, images with nine gray levels can be recorded including up to 8 dots per pixel. The speed of scan in the main-scanning direction, the pitch of orifices, the pitch of pixels and the transporting displacement unit of the recording sheet in the sub-scanning direction are similar to those in the embodiment 5.

As shown in FIG. 41. Ta is the time difference between the ejection of an ink droplet to a designated pixel and the ejection of an ink droplet to a pixel next to the designated pixel in the scan direction, which is 300 μsec. With orifice ID's used in similar to those defined in FIG. 26, R1, R2, R3, R4 and so on in FIG. 41 are driving pulses with which ink droplets are ejected from orifices 2-1, 2-2, 2-3, 2-4 and so on, respectively, and R1*a*, R2*a*, R3*a*, R4*a* and so on are also driving pulses with which ink droplets are ejected from orifices 2-1, 2-2, 2-3, 2-4 and so on, respectively.

Δt is the time difference between pulses R1 and R2. This is equal to the time difference between pulses R3 and R4, the time difference between pulses R1*a* and R2*a*, the time difference between pulses R2*a* and R3*a*, and the time difference between R3*a* and R4*a*, which is 37.5 μsec.

FIG. 42 shows dot pattern layouts in a pixel at each of image levels between 1 and 8. Pg is the pitch of pixels. Symbols R1, R2 and so on in the parenthesis are driving pulses defined in FIG. 41 for ejecting ink droplets for forming dots in responsive to a designated image level. In this embodiment, though designated dots are formed as promptly as possible within a time interval Ta in responsive to driving signals, another method for selecting dots may be allowed. For example, in order to use orifices uniformly, it is also possible to use R2 for the image level 1, to use R1 and R3 for the image level 2, to use R1, R4 and R3*a* for the image level 3, to use R1, R2, R3 and R4 for the image level 4, to use R1, R2, R3, R4 and Ria for the image level 5, to use R1, R2, R3, R4 and R2*a* and R4*a* for the image level 5, to use R1, R2, R3, R4 and R2*a* and R4*a* for the image level 6, to use R1, R2, R3, R4 and R2*a*, R3*a* and R4*a* for the image level 7. With such a method, it will be appreciated that the life of driving elements can be uniformly defined.

In the further modification of this embodiment, instead of determining the image level and its associated driving timing priorly, it is allowed that orifices are used alternately within the ejection cycle sp.

In the above embodiment 1 to 8, what has been explained is that a single pixel is composed of a plurality of dots formed by ink droplets ejected from different orifices with a plurality of scans and that these dots are formed to be shifted to one another in the pixel.

In the following, another aspect and modification of the present invention are described.

Embodiment 9

In this embodiment, an ink jet recording apparatus similar to that shown in FIGS. 1 and 2. The number of orifices in the recording head is taken to be 523. What is explained is a case that, with this recording apparatus, images with 5 gray levels are recorded on a A4-sized recording sheet, that is, the number of ink droplets projected per single pixel is between 0 and 4.

Figure 44:
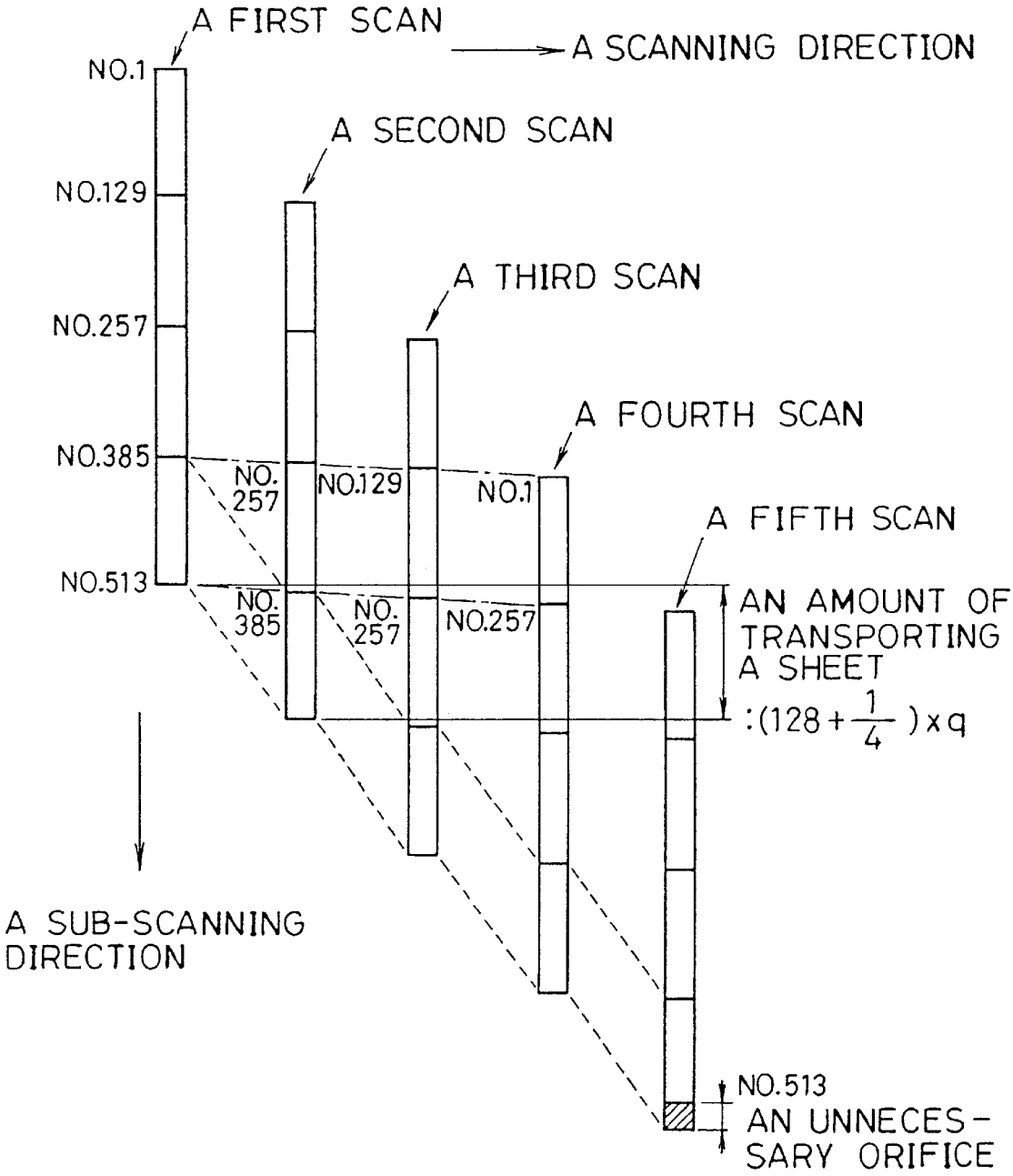
FIG. 44 is a schematic illustration illustrating recording operations of embodiment 9 of the present invention.
Figure 45:
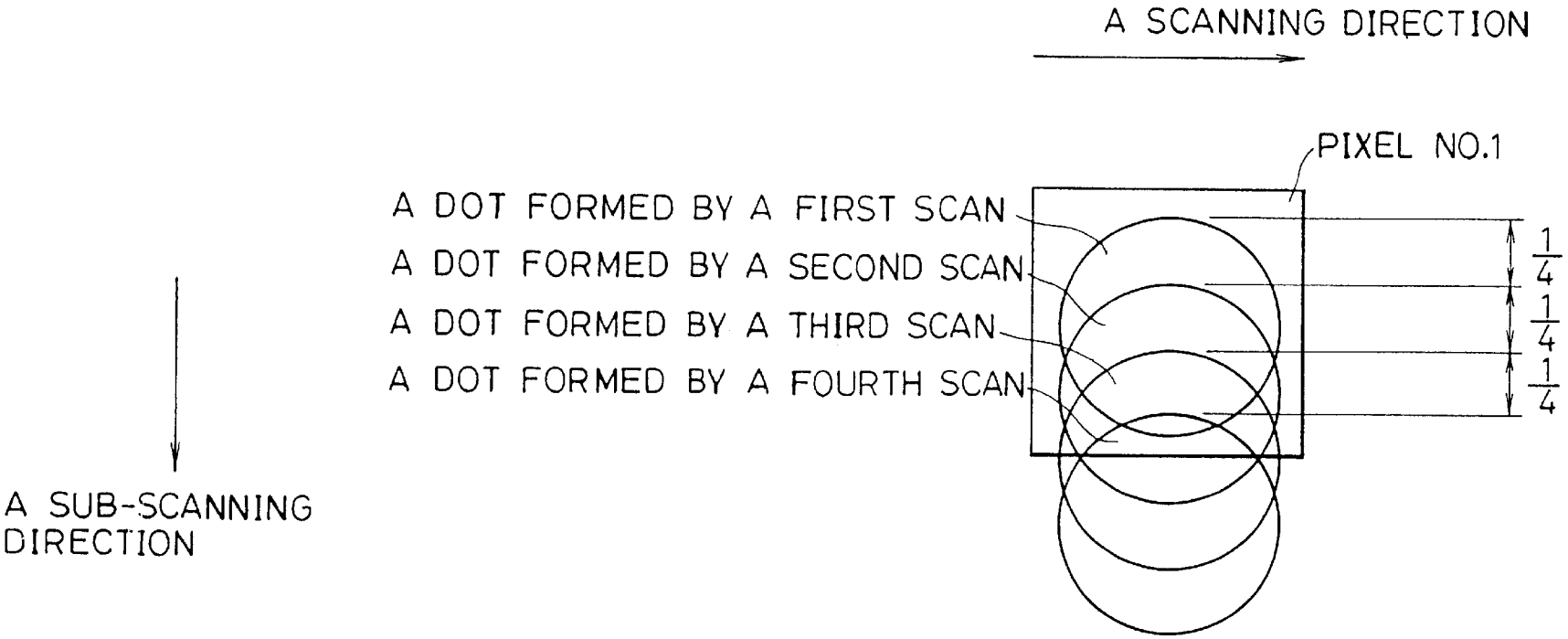
FIG. 45 is a schematic illustration illustrating dot formation of embodiment 9.

FIG. 44 is a diagram illustrating a recording method of this embodiment. FIG. 45 shows a dot pattern layout established in this embodiment.

The recording head 1 has 523 orifices. In recording images on a recording sheet, at first, in the first scan, images are recorded only with orifices No. 385 to 513 as the carriage is moved. As a result, pixels No. 1 to No. 129 on the recording sheet are recorded with 0 or 1 ink droplet.

Next, the recording sheet is moved in the upward direction by (128+¼) q pitches, where q is the pitch of orifices and is equivalent to a pitch of pixel p, and furthermore, in the second scan, images are recorded with orifices No. 257 to 513. As a result, dots formed by ejected ink droplets from orifices No. 257 to 347 are recorded ¼ q below the dots on the pixels No. 1 to 128 recorded by orifices No. 385 to 513 at first scan, and dots corresponding to pixels No. 130 to 257 of ink droplets ejected from orifices No. 385 to 513 are recorded on positions and one of which is shifted below by (¼)q from the dot on the pixel No. 129. Therefore, pixels No. 1 to 129 are recorded with up to 2 ink droplets, and pixels No. 130 to 257 are recorded with 0 or 1 ink droplet. And next, the recording sheet is moved again in the upward direction by (128+¼) q pitches, and in the third scan, images are recorded with orifices No. 129 to 513. At the end of recording images in the fourth scan by repeating above recording procedures, pixels No. 1 to 129 are recorded with up to 4 ink droplets which are projected every scan and shifted in the downward direction by ¼ pitch of pixel to one another and images with 5 gray levels can be obtained. By repeating the above procedures after the fifth scan, at the end of recording images in the 30th scan, images with 5 gray levels can be recorded on the whole area of the A4-sized recording sheet.

For recording the lower end part of images, orifices used for recording are made to stop sequentially every 128 orifices from the bottom of the recording head every one scan of the recording head.

As shown in FIG. 45, as a single pixel is formed by up to 4 ink droplets, the distance between which is ¼ unit of the pitch, q, of pixels in the sub-scan direction, there is not empty region between adjacent pixels in which an ink droplet is not projected. Owing to this dot pattern layout, images with a sufficiently high optical density can be obtained. In addition, as dots formed by sequential scannings in the sub-scanning direction overlaps each other, recorded images can include continuously painted segments extended in the sub-scanning direction.

The displacement unit, in this embodiment, equivalent to ¼ unit of the pitch of orifices, is defined in responsive to a single scanning, and at the beginning of recording in the fifth scan, the orifice is moved in the downward direction by a unit of the pitch orifices. That is, an orifice not used for ejection occur every 4 scans. In this embodiment, at thebeginning of the recording in the fifth scan, the orifice No. 513 is not required, and until the 4th scans, 7 orifices No. 507 to 513 are not used for ejection. Therefore, for example, as the orifice No. 513 is used in the first to fourth scans, if the driving data corresponding to the orifice No. 513 is 0 only during these scannings, recording operations with the orifice No. 513 after these scannings can be performed successfully even if the orifice No. 513 fails to eject ink droplets.

With such a recording method described above, the recording head may contain orifices not used for ejection, and hence, recording heads containing damaged orifices due to manufacturing failures can be used in the recording apparatus by controlling their ejection operation so far.

In addition, even in case of using necessarily damaged orifices for ejection, another well-conditioned orifices can compensate dots to be projected by the damaged orifices at the preliminary scannings in order to prevent the optical density from being lowered.

Embodiment 9A

In this embodiment, an ink jet recording apparatus shown in FIG. 5 is used. The number of orifices arranged in the recording head is 512 with the orifice density 16 orifices/mm. What is explained is a case that, with this recording apparatus, images with 4 gray levels are recorded on a recording sheet, that is, the number of ink droplets projected per single pixel is between 0 and 3.

Figure 46:
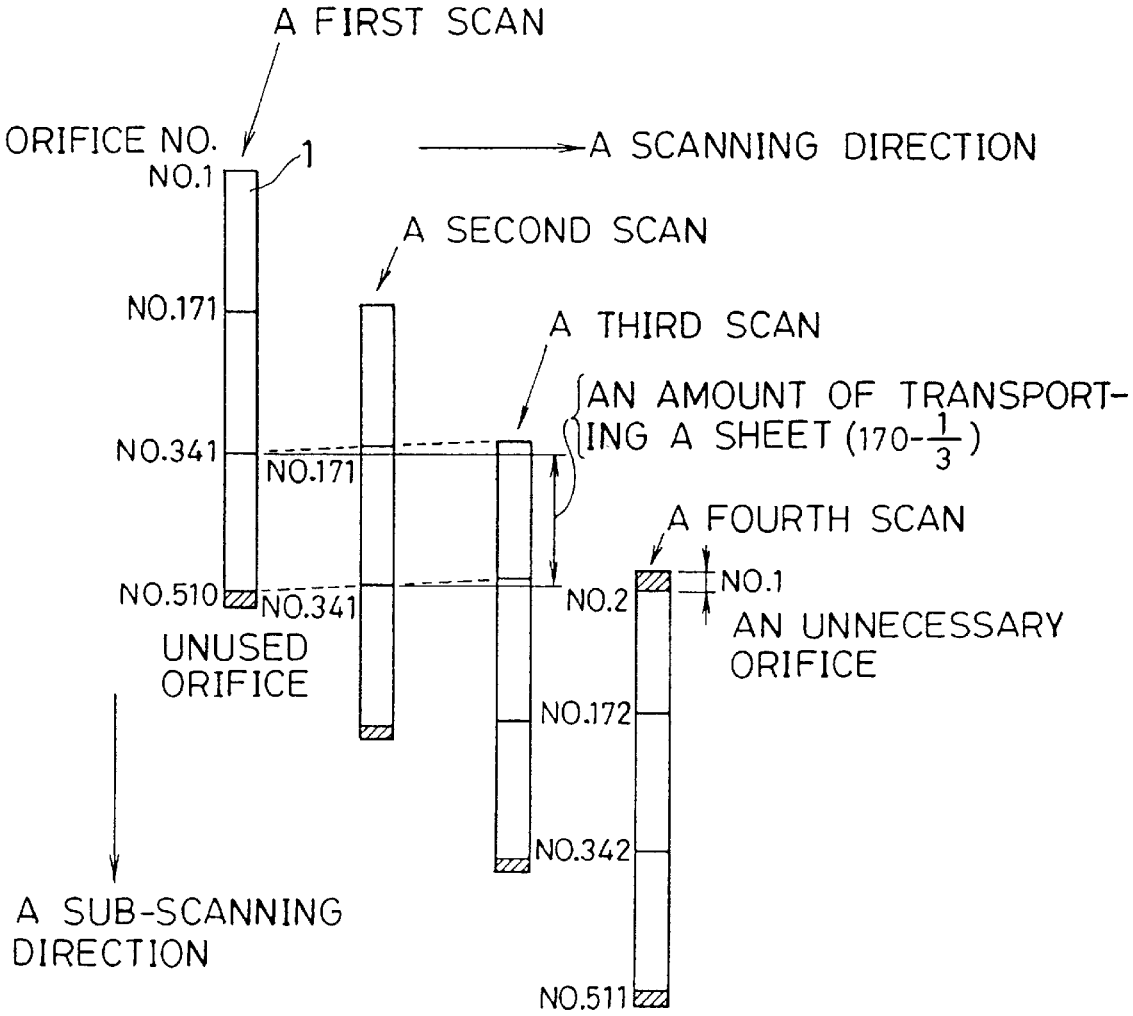
FIG. 46 is a schematic illustration illustrating recording operations of embodiment 9A of the present invention.
Figure 47:
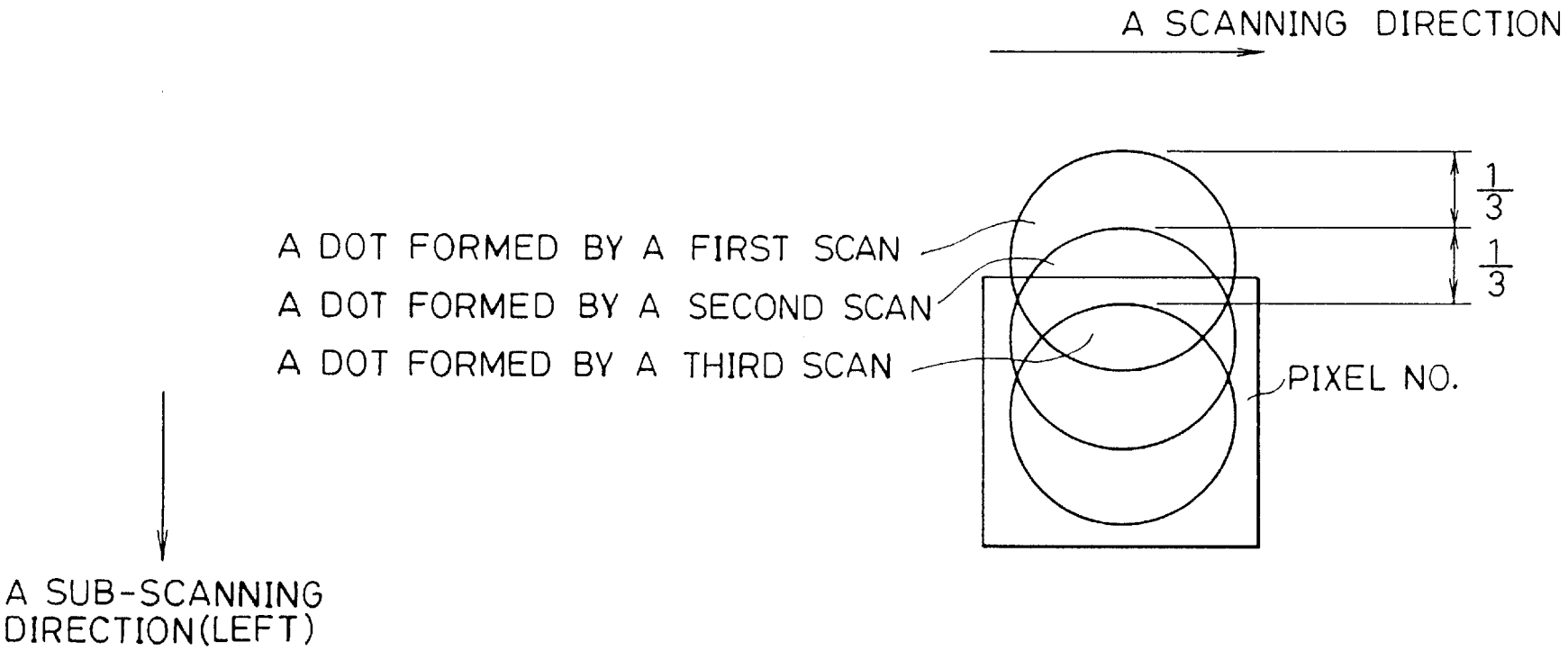
FIG. 47 is a schematic illustration illustrating dot formation of the embodiment 9A.

FIG. 46 is a diagram illustrating a recording method of this embodiment, and FIG. 47 shows a dot pattern layout established in this embodiment. At first, the recording head 1 is positioned in the left end side on FIG. 5 and, in the first scan, images are recorded only with 170 orifices No. 341 to 510 while turning the drum once. As a result, dots are formed on pixels No. 1 to 170 from the left side end of the recording sheet in responsive to driving data 0 or 1. Next, the recording head 1 is moved in the right direction with the displacement unit S of the recording head. Suppose that the total number of available orifices is 512, the maximum number of ink droplets projected per single pixel, m, is 3, and the shift of dots is (⅓)q where q is the pitch of orifices and is equivalent to the pitch of pixels, then S can be (170±⅓)q. In this embodiment, images are recorded in the case that the shift of dots is negative, that is, the displacement unit of the recording head is (170−⅓)q. In this case, with the above defined displacement unit S, the total number of scannings is 22 because the length of an array on which 512 orifices are placed is 32 mm and the maximum number of ink droplets projected per single pixel, m, is 3.

After moving the recording head by the above defined displacement unit S in the right direction, in the second scan, images are recorded with orifices No. 171 to 510 while turning again the drum once. As a result, dots formed by ejected ink droplets from orifices No. 171 to 340, in the pixels No. 1 to 170 are recorded on points which are shifted ⅓ unit of the pitch of pixels right to the points of the dots recorded by orifices No. 341 to 510, and orifices No. 341 to 510 eject 0 or 1 ink droplet to form dots on each of pixels No. 171 to 340 located in the ⅔ pixel unit right side of the dots in the pixel No. 170. Therefore, pixels No. 1 to 170 are recorded with up to 2 ink droplets. Finally, after moving the recording head by (170−⅓)q in the right side, in the third scan, images are recorded with orifices No. 1 to 510 while turning the drum once.

By repeating the above recording procedures, at the end of recording images in the third scan, 0 to 3 dots are formed in each of pixels No. 1 to 170, each dot being formed every scanning and shifted in the left side by ⅓ pixel unit form scan to scan, and thus images with 4 gray levels can be recorded. As orifices are shifted to the right by (170−⅓)q every scannings, in the fourth scan, orifices are shifted to the left by one pitch of orifices, and hence, the orifice No. 1 is not used for ejection but substituted by the orifice No. 511 used for ejection. Similarly, in the seventh scan, as orifices are shifted to the left by one pitch of orifices, the orifice No. 2 is not used for ejection but substituted by the orifice No. 512 used for ejection. And furthermore, in the tenth scan, the orifice No. 3 is not used for ejection, and the number of available orifices comes to 509, from orifice No. 4 to 512. By repeating this until the 22nd scan, images with 4 gray levels can be recorded on the whole area of the A4-sized recording sheet. AT this point, unused orifices are 7 orifices from No. 1 to 7. As the orifice No. 1 has not been used since the first scan, failures or damages of this orifice do not affect the quality of recorded images.

In recording the right end part of images to be recorded after the 20th scan, 166 orifices from the orifice No. 512 located in the right end are stopped at first, and next, every 170 orifices are stopped every time when the recording head is scanned.

As 0 to 3 dots are formed in each pixel, and each dot is formed ever, scan and shifted in the left side by ⅓ pixel unit from scan to scan, some orifices are remained to be unused. So far, failed or damaged orifices can be replaced by well-conditioned orifices to record images.

Embodiment 9B

In this embodiment, what is explained is another embodiment using an ink jet recording apparatus similar to that of the above embodiment 9A. With this recording apparatus, images with 5 gray levels are recorded on a recording sheet.

Figure 48:
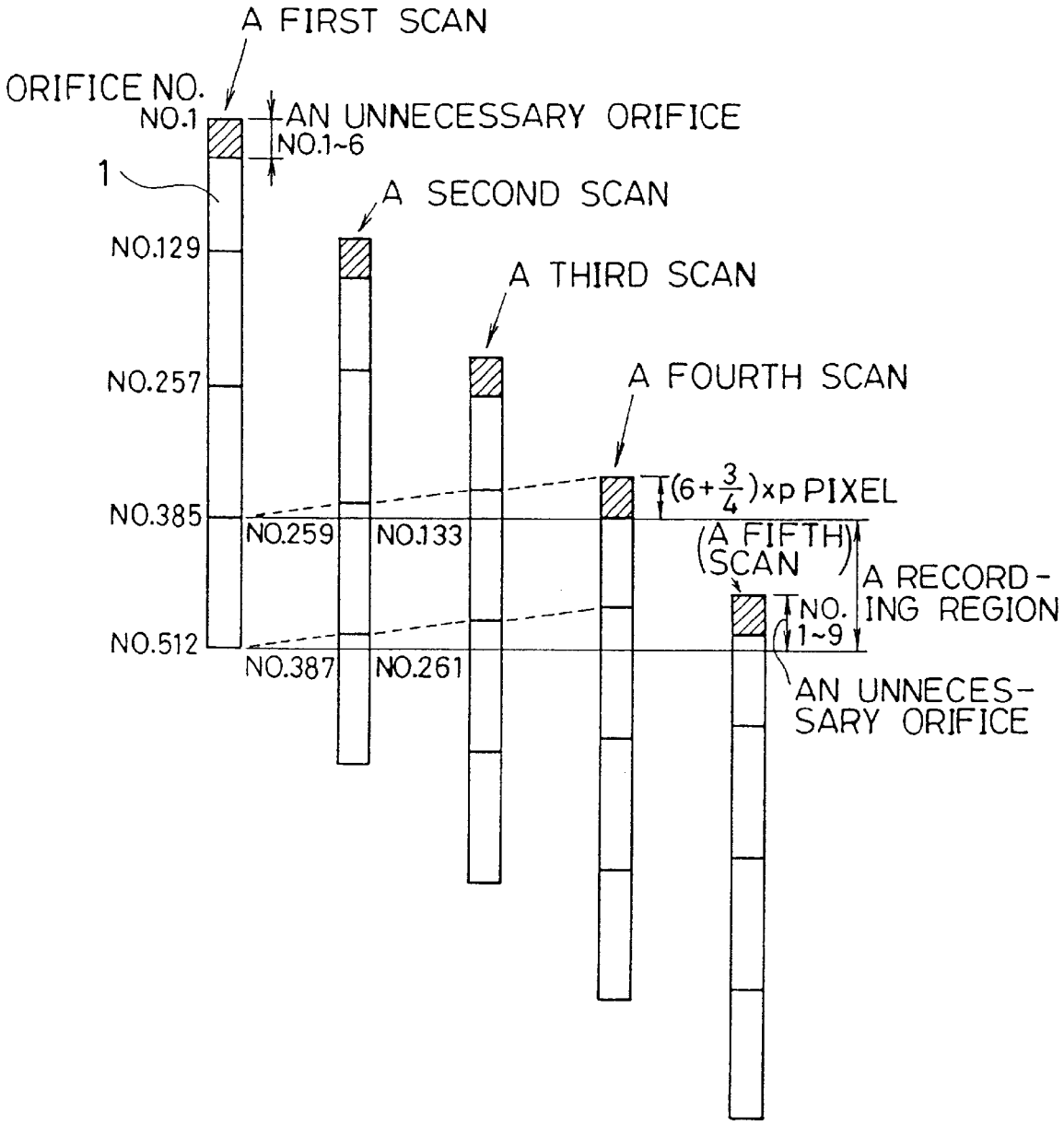
FIG. 48 is a schematic illustration illustrating recording operations of embodiment 9B of the present invention.
Figure 49:
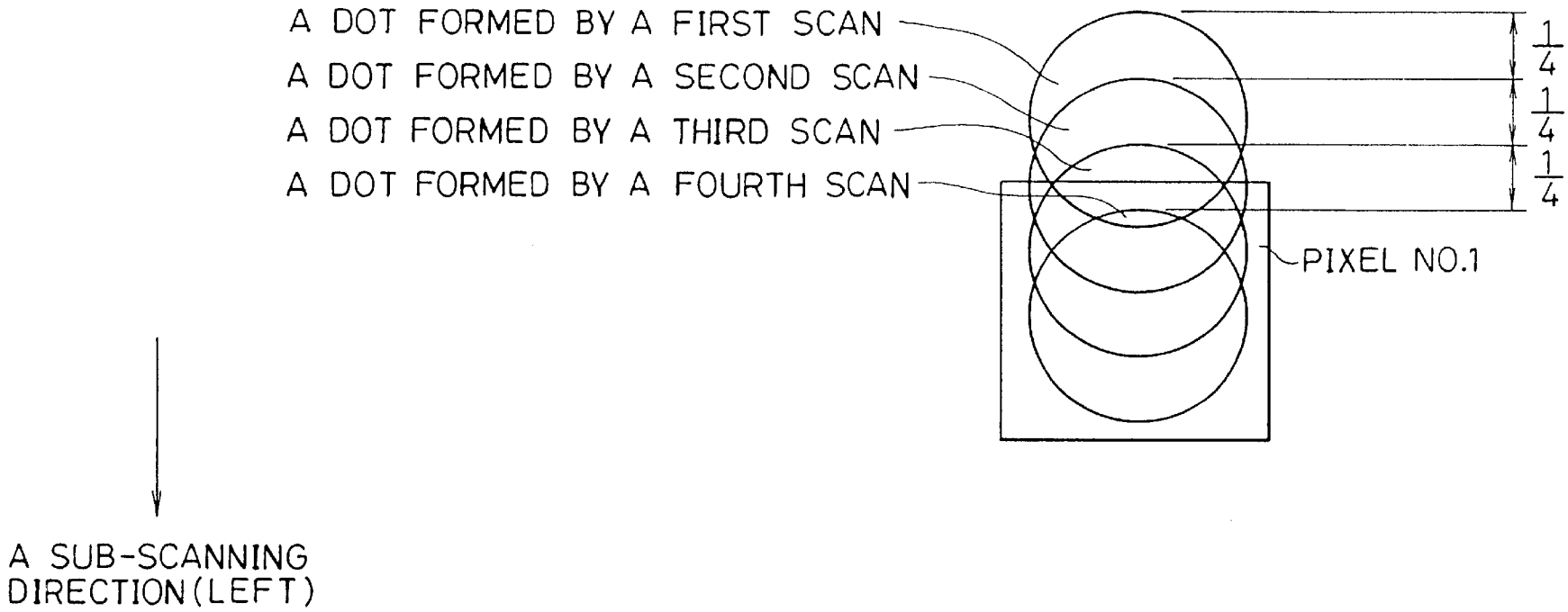
FIG. 49 is a schematic illustration illustrating dot formation of embodiment 9B.

FIG. 48 is a diagram illustrating a recording method of this embodiment, and FIG. 49 shows a dot pattern layout established in this embodiment. At first, the recording head 1 is positioned in the left end side on FIG. 5 and, in the first scan, images are recorded only with 128 orifices No. 385 to 512 while turning the drum once. As a result, dots formed on pixels No. 1 to 128 from the left side end of the recording sheet in responsive to driving data 0 or 1. Next, after the recording head 1 is moved in the right direction by {128−(2+¼)}q, in the second scan, images are recorded with orifices No. 259 to 512 while turning the drum once. As a result, dots formed by orifices No. 259 to 387, in the pixels No. 1 to 128, are recorded on positions which are shifted ¼ pixel unit left to the positions of dots formed by orifices No. 387 to 512, respectively, and each of orifices No. 387 to 512 ejects droplet to form 0 or 1 dot corresponding to respective pixels 129 to 254 in the ¾ pixel unit right side to the pixel No. 128. Therefore, each of pixels No. 1 to 128 contains up to 2 dots. And next, after moving the recording head in the right direction by {128−(2+¼)}q, in the third scan, images are recorded with orifices No. 133 to 512 while turning the drum once. By repeating the above recording procedures, at the end of recording images in the fourth scan, 0 to 4 dots are formed in pixels No. 1 to 128, each dot being formed every, scan and shifted in the left side by ¼ pixel unit from scan to scan, and thus images with 5 gray levels can be recorded. The total shift from the first scan to the fourth scan is equivalent to (6+¾) pixel units in the left direction. And at the fifth scan, each dot is shifted by 9 pixel units in the left direction in relative to the position at the first scan, and hence, positions of the dots formed at fifth scan coincide with that of the dots formed at first scan. In addition, at this point, unused orifices occur at orifices No. 1 to 9. This situation of the fifth scan comes up again at the ninth scan, the 13th scan and every 4 scans consequently. The number unused orifices increases by 9 orifices such as orifices No. 10 to 18 at ninth scan and orifices No. 19 to 27 at thirteenth scan. By repeating this until the 44th scan, images with 5 gray levels can be recorded on the whole area of the A4-sized recording sheet. At this point, unused orifices are 96 orifices from No. 1 to 96. In recording the right edge part of images to be recorded after the 41st scan, 38 orifices from the orifice No. 512 located in the right end are stopped at first, and next, every 128 orifices are stopped every time when the recording head is scanned.

In this recording method, by forming unused orifices, even if recording images with a recording head having failed or damaged orifices, for example, NO. 1 to 6, these orifices No. 1 to 6 can be replaced by well-conditioned orifices by shifting orifices in a designated distance and the recording head which could not be used due to its damaged orifices can be used for recording images.

Embodiment 10

Figure 50:
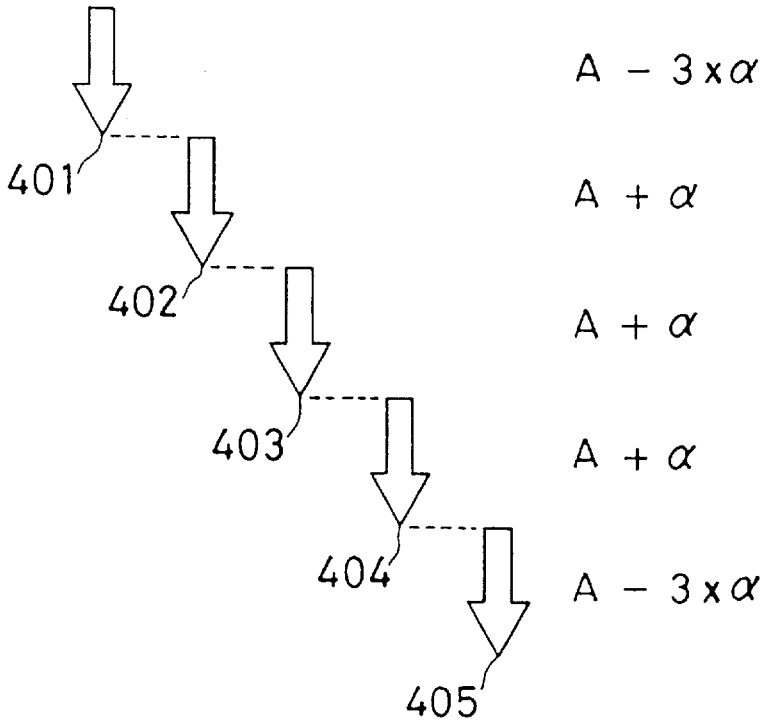
FIG. 50 is a schematic illustration illustrating a paper feed mechanism in embodiment 10 of the present invention.
Figure 51:
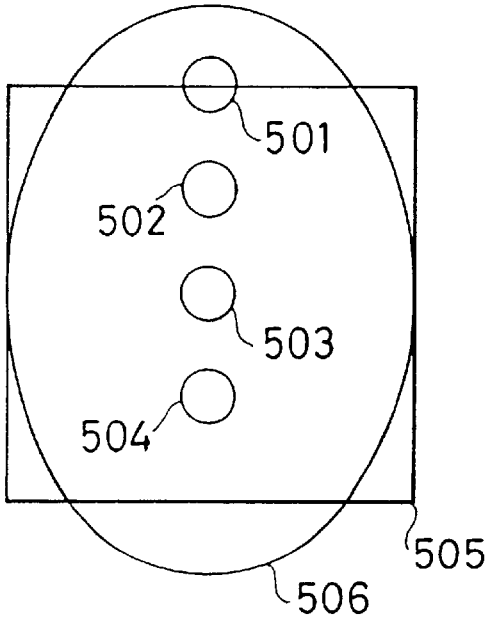
FIG. 51 is a schematic illustration illustrating dot formation of embodiment 10.

The embodiment 10 is explained with FIGS. 50 and 51. FIG. 50 illustrates scanning operations of the recording head and sheet feeding operations at each scanning. FIG. 51 is a diagrammatic picture showing dot patterns projected on the recording sheet by ejecting ink droplets from each orifice.

In FIG. 50, reference numeral 401 designates a certain unit feeding of the recording sheet which is performed in correspondence with a scanning, and the displacement amount of which is A−3×α. Reference numeral 402 designates the next unit feeding after the feeding 401, the displacement amount of which is A+α. Reference numeral 403 designates the next unit feeding after the feeding 402, the displacement amount of which is A+α. Reference numeral 404 designates the next unit feeding after the feeding 403, the displacement amount of which is A+α. Reference numeral 404 designates the next unit feeding after the feeding 403, the displacement amount of which is A−3×α. These four units of feeding the recording sheet are repeated, and the displacement amount of each of the three feeding of them is A+α and the displacement amount of the rest of them is A−3×α. The value of α is determined so that the value of 3×α may be equal to or smaller than the width of the pixel.

In FIG. 51, reference numeral 502 designates the position of the ink droplet projected on the recording sheet by the orifice No. 100 in the scanning performed between the feedings 401 and 402. Similarly, reference numeral 502 designates the position of the ink droplet projected on the recording sheet by the orifice No. 68 in the scanning performed between the feedings 402 and 403, reference numeral 503 designates the position of the ink droplet projected on the recording sheet by the orifice No. 36 in the scanning performed between the feedings 403 and 404, and reference numeral 504 designates the position of the ink droplet projected on the recording sheet by the orifice No. 4 in the scanning performed between the feedings 404 and 405. Reference numeral 505 designates a single pixel and reference numeral 506 designates a set of ink droplets formed on the recording sheet when all the ink droplets are projected on the recording sheet.

In the above structure, what is described below is a formation of images with this embodiment from the view point of forming a pixel.

As shown in FIG. 50, after the sheet feed 401, the recording head is scanned and the orifice No. 1 ejects an ink droplet on the position 501 within the pixel 505. After this scanning, the sheet feed 402 follows. In the next scanning after the sheet feed 402, the orifice No. 68 ejects an ink droplet on the position 502 within the pixel 505. As the amount of the sheet feed 402 is A+α, the distance between the position 501 defined by the ejection from the orifice No. 100 and the position 502 defined by the ejection from the orifice No. 68 is α. And next, in the scanning after the next sheet feed 403, the orifice 36 ejects an ink droplet to the position 503 α apart from the position 502. And next, in the scanning after the sheet feed 404, the orifice No. 4 ejects an ink droplet to the position 504 α apart from the position 503.

Figure 52:
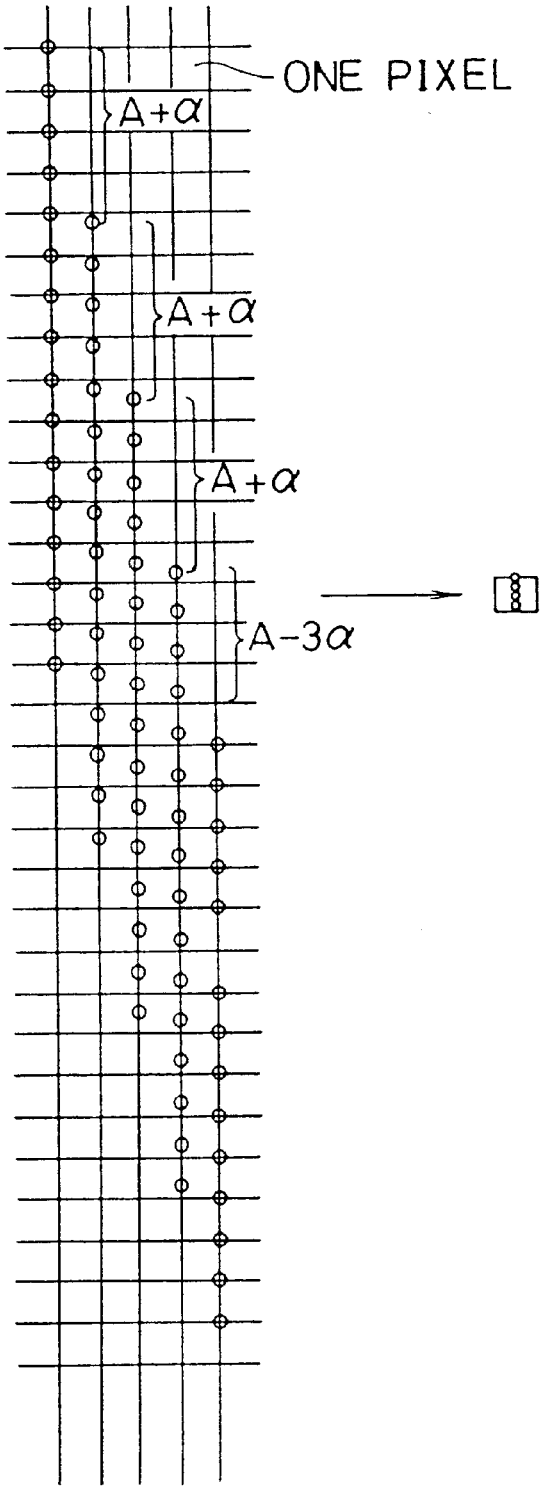
FIG. 52 is a schematic illustration illustrating dot formation of embodiment 10 in relative to paper feed operations.

In FIG. 52, an example of images formed in the above described manner is shown diagrammatically. In this example, the number of orifices of the recording head is 16 and the amount of the sheet feed, A, is 4 times as large as the pitch of orifices, q, that is, 4q.

In prior art recording operations, the amount of a single sheet feed is A and it is required to feed the recording sheet by 4×A in order to form a generic single pixel. On the other hand, in this embodiment, in order to shift dots, the total amount of the sheet feed as described above is greater than the amount of the generic sheet feed. As a result, there may be a case that recorded images contain stripe-noises. In order to prevent this problem, the amount of the sheet feed is selected to be A−3×α once in four times of feeding the recording sheet so as to establish the total amount of the sheet feed to be 4×A after forming a single pixel. This means that the position of dots from each orifice is determined to be an identical position once in four times of feeding the recording sheet.

As described above, a set of dots 506 is formed as all the ink droplets forming a pixel are projected on the recording sheet. This set of dots 506 covers almost all the area within the pixel 505. As described above, in the case that the maximum optical density is established by all the four orifices ejecting four ink droplets in order to form a single pixel, as shown in FIG. 51, a set 506 of ink droplet projected to the pixel 505 almost covers the whole area of the pixel 505 and unrecorded face of the recording sheet corresponding to the pixel 505 is not found. By means that the amount of the sheet feed is taken to be A+α in three times out of the four times in feeding a recording sheet and to be A−3×α once in the four times of feeding a recording sheet, ink droplets can be projected on different positions in the pixel, and thus, a desirable optical density can be obtained with a designated amount of ejected ink fluids for establishing a necessary number of gray levels.

In this embodiment, the amount of sheet feeding at three times is taken to be A+α and the amount of sheet feeding at one time is taken to be A−3×α. The same effect can be obtained even by taking the amount of sheet feeding at three times is taken to be A−α and the amount of sheet feeding at one time is taken to be A+3×α. In addition, by taking the amount of sheet feeding at all the 4 times to be A−4×n×α−α with n being 0 or a positive integer, and making one orifice or a plurality of orifices not being used at four times of sheet feeding so as to alter orifices sequentially for forming pixels, the same effect can be obtained.

Embodiment 10A

FIGS. 53A to 53D show the embodiment 10A. This embodiment regards a recording method where a method in which the position of projecting ink droplets in a pixel are shifted in the recording head scanning direction as described above and a method in which the positions of projecting ink droplets in a pixel is shifted in the sheet feeding direction are combined. In FIGS. 53A to 53D, like numerals are assigned to the positions of dots projected by ink droplets ejected from an identical orifice. Reference numeral 601 designates the position of the dot projected by an ink droplet ejected from the orifice No. 100, reference numeral 602 designates the position of the dot projected by an ink droplet ejected from the orifice No. 68, reference numeral 603 designates the position of the dot projected by an ink droplet ejected from the orifice No. 36, and reference numeral 604 designates the position of the dot projected by an ink droplet ejected from the orifice No. 68, respectively. The positions of dots shown in FIGS. 53A to 53D are established in sheet feeding at every 32 pixel units, and reference numeral 605 designates each projected dot.

Figures 53A, 53B, 53C, 53D:
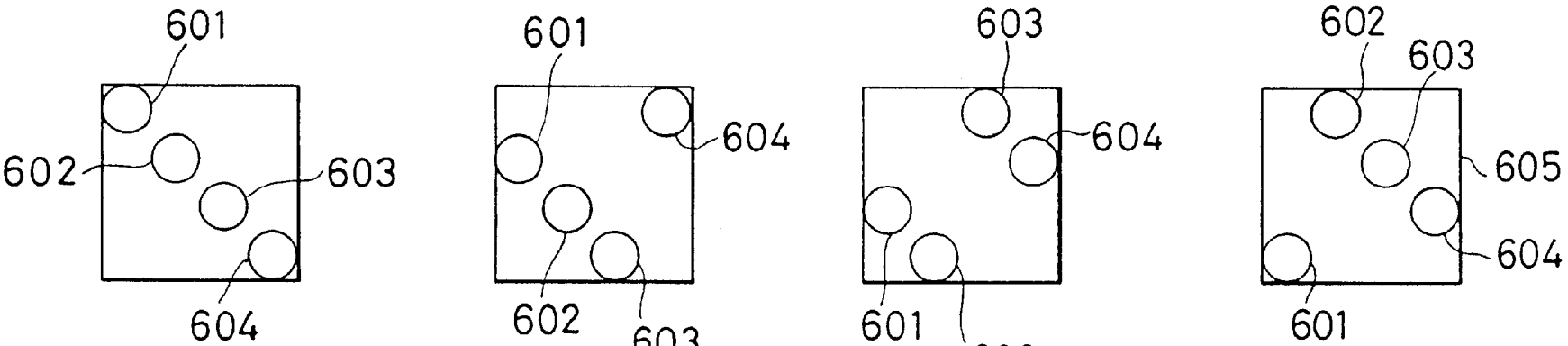
FIGS. 53A, 53B, 53C and 53D are diagrammatic views showing a layout of dots in a pixel in embodiment 10A of the present invention.

The dot pattern configuration shown in FIG. 53A can be explained straightforwardly by the previously described recording method of shifting dot positions both in the main-scanning direction and in the sub-scanning direction. For example, by separating orifices into several blocks as in the embodiment 4 and driving orifices by blocks in the direction along which orifices are arranged in an array, the positions of projected dots can be shifted within a pixel in the horizontal direction in FIGS. 53A to 53D, and as in the embodiment 10, by taking the amount of sheet feeding at three times is taken to be A+α and the amount of sheet feeding at one time is taken to be A−3×α, the position of dots can be shifted in the vertical direction in FIGS. 53A to 53D.

In FIGS. 53B to 53D, the positions of projected dots on the recording sheet seem to be randomized because the order of the position of dots and sheet feedings are different from pixel to pixel. Specifically, in the example shown by FIG. 53B this is because the amount of sheet feeding before the last dot forming with an ink droplet is A−3×α, and in the example shown by FIG. 53C, the amount of sheet feeding before the third dot forming with an ink droplet and after the second dot forming with an ink droplet is A−3×α, and in FIG. 53D, before the second dot forming with an ink droplet and after the first dot forming with an ink droplet is A−3×α.

In FIGS. 53B to 53D, though the area within a single pixel does not seem to be covered fully by projected dots on the recording sheet, viewing adjacent pixels and the dot patterns inside them tells that an overall dot pattern layout defined by a plurality of pixels is similar to that in FIG. 53A, and hence, it is found that all the pixels are covered fully the projected dots.

As described above, this embodiment is effective specifically in the cases that recording sheets composed of materials with lower fluid-absorption properties are used and that the number of pixels in arranged in the recording head scanning direction is extremely large and ink droplets projected on the recording sheet are fully developed and dried out.

In the embodiment 10A, what is explained about are images with 5 gray levels in which a single pixel is formed by four dots. This embodiment can be applicable to cases that the number of dots formed in a pixel is not limited to 4 without loss of generality. Specifically in case of extremely large number of dots formed in a pixel, all the dots may not be formed in different positions. For example, it is allowed that 3 dots are projected on different positions and 1 dot is projected on one of the positions occupied by these dots, and also that 2 dots are projected on different and other 2 dots are projected on each of the positions occupied by these 2 dots, respectively. In these cases, it is required that a desirable maximum optical density should be established by the above described method for forming pixels. In addition, in this embodiment, what is explained is the case that the size of a pixel is equivalent to the pitch of orifices, but this invention is not limited to this case.

Embodiment 11

Figure 54:
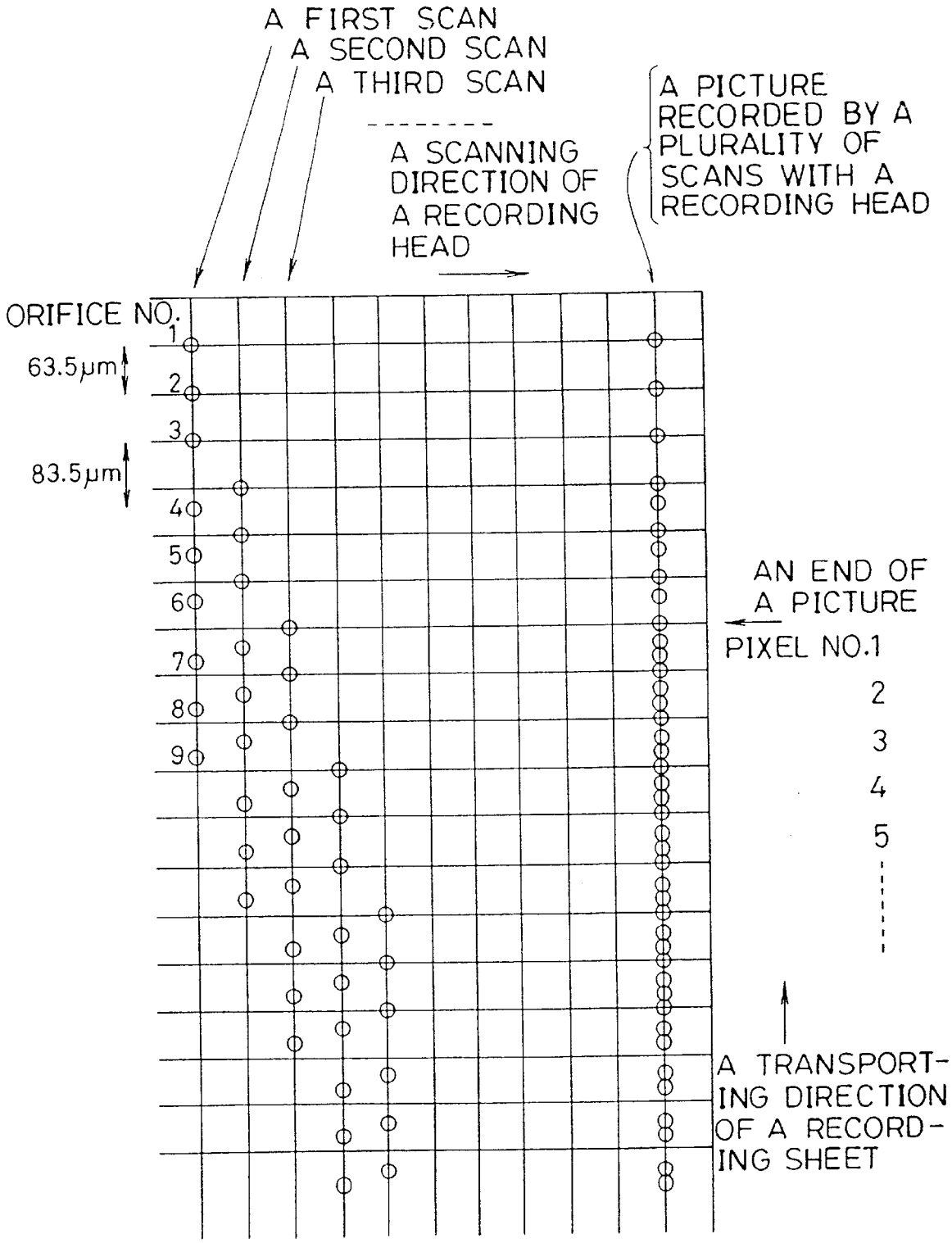
FIG. 54 is a schematic illustration illustrating recording operations of embodiment 11 of the present invention.

FIG. 54 is a diagram illustrating a recording method of the embodiment 11. In this embodiment, a recording apparatus similar to that of the embodiment 1 is used and the scanning of the recording head and the sheet feeding are performed in the similar manner to that in embodiment 1.

As shown in FIG. 54, the distance between orifices No. 3 and 4 and the distance between orifices No. 5 and 6 are different from the distance between other orifices, and 9 orifices are formed on the recording head in the vertical direction in FIG. 54.

In recording images on the recording sheet, at first, images are recorded by ejecting ink droplets from orifices No. 7 to 9 while moving the carriage. As a result, pixels No. 1 to 3 are formed with 0 or 1 ink droplet. Next, after feeding the recording sheet 2 in the upward direction by 3 pixels units (3×63.5 μm), images are recorded with orifices No. 4 to 9. In FIG. 54, for explanation, what is shown in that the recording head 1 moves in the downward direction. As a result, pixels No. 1 to 3 are recorded with 0 to 2 ink droplets per single pixel, and pixels No. 4 to 6 are recorded with 0 or 1 ink droplet per single pixel. And next, after feeding the recording sheet 2 in the upward direction by 3 pixels units (3×63.5 μm), images are recorded with orifices No. 1 to 9. As a result, pixels No. 1 to 3 are recorded with 0 to 3 ink droplets per single pixel, and pixels No. 7 to 9 are recorded with 0 or 1 ink droplet per single pixel. By repeating these recording processes, images with 4 gray levels are recorded by ejecting 0 to 3 ink droplets per single pixel. In recording the bottom edge part of images, every 3 orifices are stopped from the bottom of the recording head at every recording head scanning operation.

As, in images recorded in the above described recording method, a single pixel is formed with ink droplets ejected from a plurality of orifices, the variation of the amount of ink fluids ejected from each orifice can be reduced and images without shading and stripe noises can be attained.

As, in projecting 2 or more ink droplets in a single pixel, the positions of dots formed in a pixel on the recording sheet are shifted to one another, the surface of the recording sheet can be covered sufficiently by ink droplets and images with a high optical density can be obtained. In this embodiment, the positions of ink droplets projected on a pixel are shifted only in the sub-scanning direction. In addition to this mode, it is allowed that the position of ink droplets projected on a pixel are shifted also in the main-scanning direction by controlling the timings for ejecting ink droplets.

In the result of several attempts to record various kinds of images with the above described recording method, it is concluded that clearer recorded images without stripe-noises and shading can be obtained in comparison with images recorded with a plurality of ink droplets ejected from an identical orifice to a single pixel.

Embodiment 11A

Figure 55:
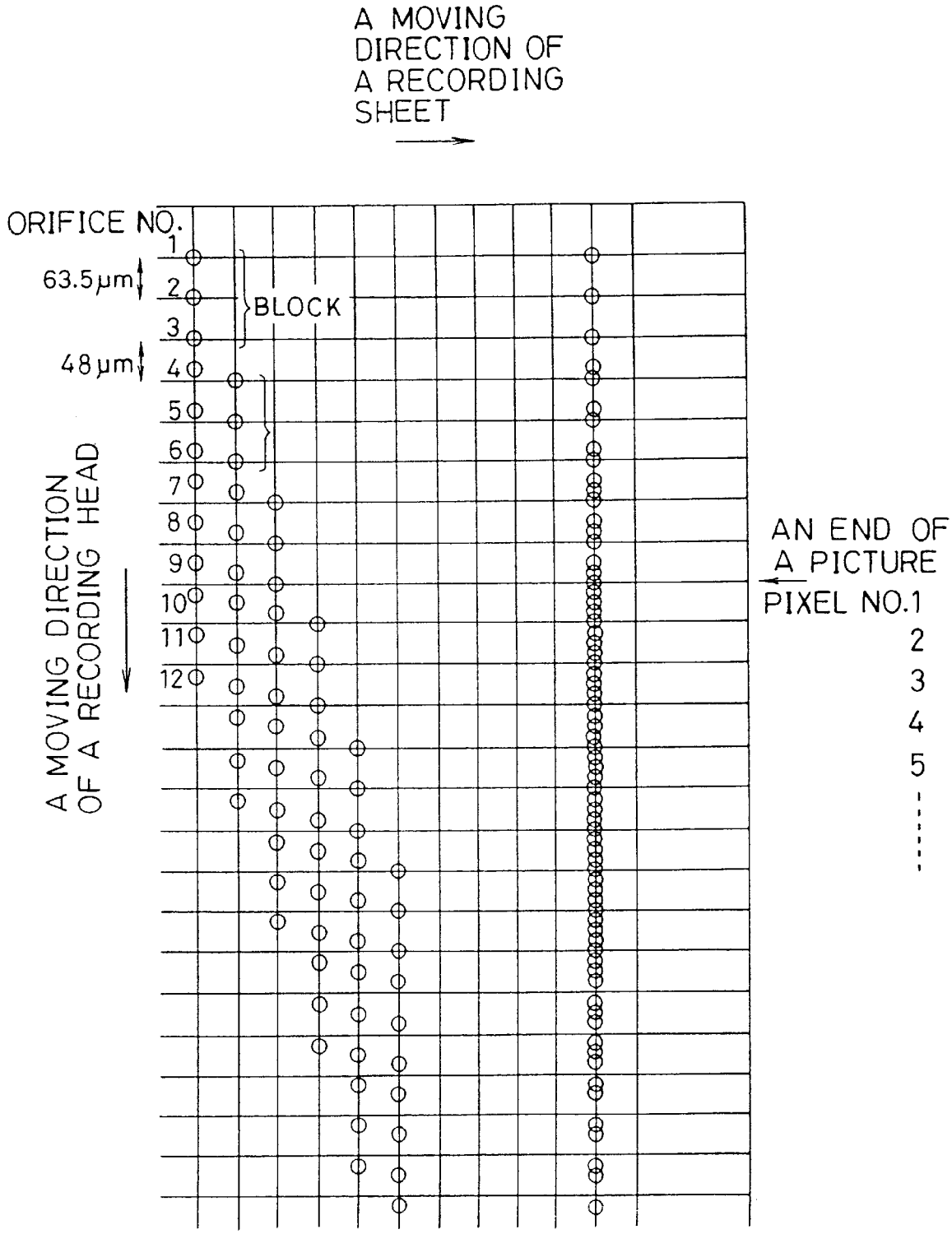
FIG. 55 is a schematic illustration illustrating recording operations of embodiment 11A of the present invention.

FIG. 55 is a diagram illustrating a recording method of this embodiment. In this embodiment, a recording apparatus shown in FIG. 5 is used except the pitch of orifices of the recording head. The distance, q, between orifices No. 3 and No. 4, No. 6 and No. 7, and No. 9 and No. 10 is 48 $\mu$m and the distance, q, between other adjacent orifices is 63.5 $\mu$m.

At first, the recording head is located in the right end side of FIG. 5, and using only orifices No. 10 and 11, images are recorded on the recording sheet while the drum rotates for 360°. Next, the recording head is moved in the left direction by 3 pixel units (3×63.5 $\mu$m), and using six orifices No. 7 to 12, images are recorded on the recording sheet while the drum rotates for 360°. And next, the recording head is moved in the left direction by 3 pixel units, and using nine orifices No. 4 to 12, images are recorded on the recording sheet while the drum rotates for 360°. And furthermore, the recording head is moved in the left direction by 3 pixel units, and using 12 orifices No. 1 to 12, images are recorded on the recording sheet while the drum rotates for 360°. And afterwards, by repeating that the recording head is moved in the left direction by 3 pixel units and using 12 orifices No. 1 to 12, images are recorded on the recording sheet while the drum rotates for 360°, then images are recorded on the whole face of the recording sheet.

As, in images recorded in the above described recording method, a single pixel is formed with ink droplets ejected from four orifices, the variation of,the amount of ink fluids ejected from each orifice can be reduced and images without shading and stripe noises can be attained. And in projecting 2 or more ink droplets in a single pixel, the positions of dots formed in a pixel on the recording sheet are shifted to one another, and hence, the surface of the recording sheet can be covered sufficiently by ink droplets and images with a high optical density can be obtained.

Embodiment 11B

In the recording head used in this embodiment, the number of orifices is 129, only the distance between orifices No. 86 and 87 is 96 $\mu$m, and the distance between other adjacent orifices is 64 $\mu$m. A recording apparatus similar to that of the embodiment 11 is used except that the amount of sheet feeding per single scanning of the recording head is 43 pixel units.

Figure 56:
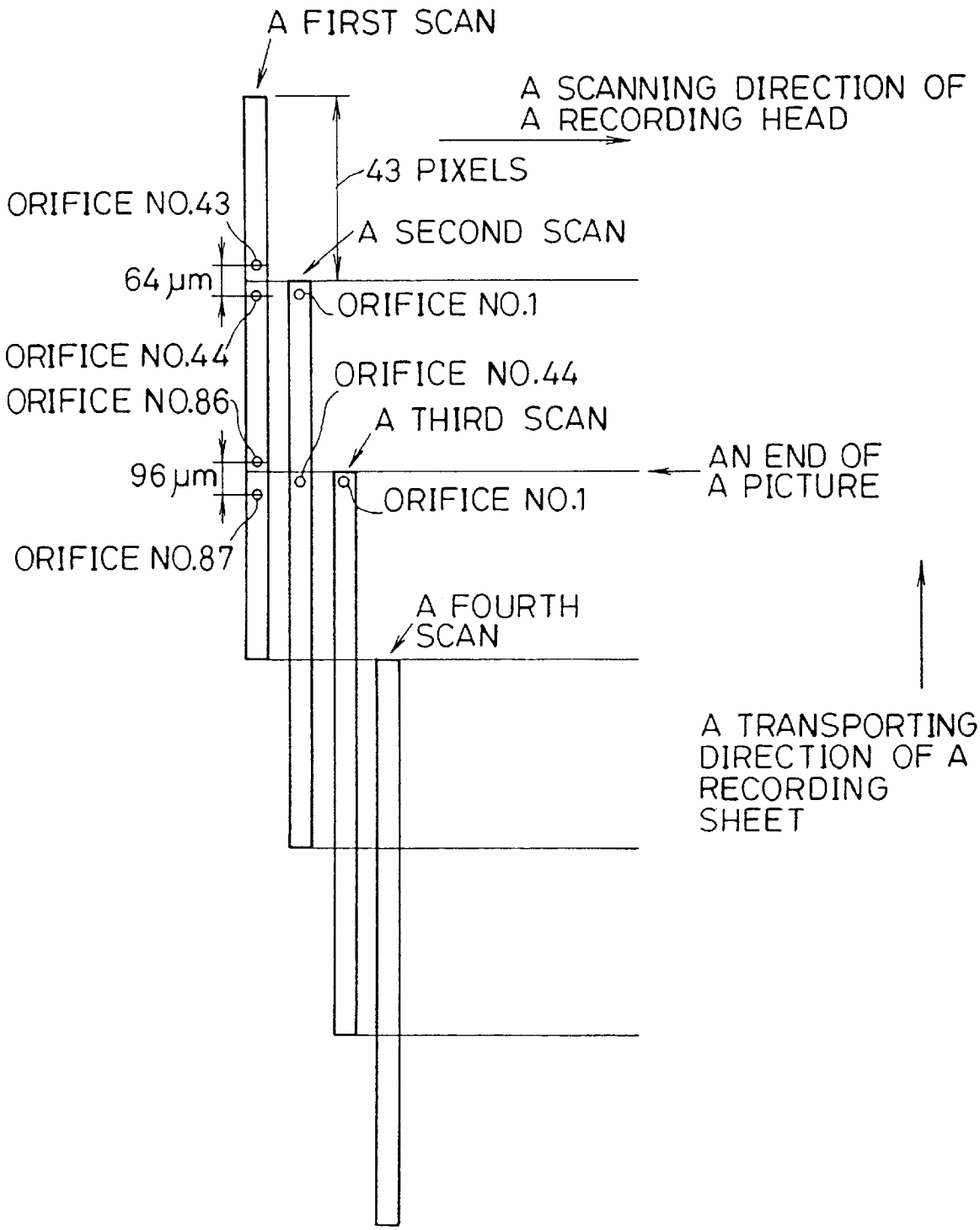
FIG. 56 is a schematic illustration illustrating recording operations of embodiment 11B of the present invention.

FIG. 56 is a diagram illustrating a recording method of this embodiment. As found in FIG. 56, the positions of the dots formed in an identical pixel in the second and third scans are met exactly with each other, but the positions of dots formed in the first scan is shifted to the positions given by the second and third scans. Owing to this, in forming a pixel with three dots, the pixel on the recording sheet can be covered by ink droplets and hence, images with a high optical density can be obtained.

When forming a single pixel with two dots, two modes are possible; a combination of the first scan and the second or third scan with which two dots are shifted to each other, and a combination of the second scan and the third scan with which two dots are met with each other. By mixing above two modes, as the optical density in the first mode is higher than that in the second mode, images with complex gray levels can be developed effectively. More specifically, when recording images by altering the number of ink droplets projected to a single pixel from 0 to 4, by switching above described two modes for ejecting two ink droplets, images with further fine gray levels can be recorded.

In each of the above embodiments 1 to 11B, what is explained about are a recording apparatus with an ink jet recording method and a recording device composed of orifices and their corresponding electro-thermal conversion elements. This invention can be applicable to another kinds of recording apparatus and recording devices, such as a thermal transfer recording method and its recording devices.

The present invention achieves distinct effect when applied to a recording head or a recording apparatus which has means for generating thermal energy such as electro-thermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, as an output device of a facsimile apparatus having a transmission and receiving function, and as an output device of an optical disc apparatus for recording and/or reproducing information into and/or from an optical disc.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recording method for recording an image with a plurality of pixels, each said pixel being composed of a plurality of dots of a number, comprising the steps of:

providing a recording head having a plurality of recording elements arranged across a width measured in a sub-scan direction for forming the dots on a recording medium;

supplying an image data including a tone level information for each of said pixels to the recording head;

causing a first main scan by effecting a first relative movement between said recording head and said recording medium in a first direction in which each said pixel is recorded with a fraction of the number of the dots by a particular said recording element, each said number of dots corresponding to a particular said tone level for said pixel composed of said number of said dots;

causing a sub-scan by effecting a second relative movement between said recording head and said recording medium in the sub-scan direction crossing the movement direction of the first main scan, in which a distance of the second relative movement in the sub-scan is less than the width;

causing a second main scan in which each said pixel is recorded so that for each said pixel, a portion of the number of the dots are formed by a different said recording element than the particular said recording element used in said first main scan, said fraction and said portion of the number of the dots together corresponding to the tone level; and repeating the sub-scan and the second main scan to record a tone image for at least one time, so that the numbers of the dots in each of said pixels are formed using different said recording elements from each other until the tone level of said each of said pixels coincides with the tone level designated by the image data for said each of said pixels, wherein said numbers of dots are formed in individual different positions in said pixel, and wherein said plurality of dots are formed in individual different positions in at least one of the direction of said first relative movement and in the sub-scan direction of said second relative movement, and wherein adjacent said recording elements in said plurality of recording elements are not used concurrently in forming the dots, and wherein a condition $b/g>(N/s)-1$ is satisfied with a set of b, g, N and s, where N is the number of said recording elements of said recording head;

q is a pitch of said recording elements;

a plurality of consecutive said recording elements forming dots concurrently is arranged with a periodical distance bq where b is a natural number greater than or equal to 2;

a displacement of said second relative movement is sq, where s is a natural number greater than or equal to 2; and g is a greatest common divisor of s and b.

2. A recording method as claimed in claim 1, wherein each distance between adjacent dots of said plurality of dots is different from each other in the direction of said first relative movement.

3. A recording method as claimed in claim 1, wherein said plurality of dots are formed in individual different position in responsive to a position of said pixel in the direction of said first relative movement.

4. A recording apparatus for recording an image with a plurality of pixels, each pixel being composed of a plurality of dots of a number, comprising:

a recording head having a plurality of recording elements arranged across a width measured in a sub-scan direction for forming the dots on a recording medium;

data supply means for supplying an image data including a tone level information for each of said pixels to the recording head;

first scanning means for performing a first main scan by effecting a first relative movement between said recording head and said recording medium in a first direction in which each said pixels is recorded with a fraction of the number of the dots by a particular said recording element, each said number of dots corresponding to a particular said tone level for said pixel composed of said number of said dots;

sub-scanning means for performing a second relative movement between said recording head and said recording medium in a direction crossing with a movement direction of the first main scan, in which a distance of the second relative movement in the sub-scan is less than the width;

second scanning means for performing a second main scan in which each said pixel is recorded so that for each said pixel, a portion of the number of the dots are formed by a different said recording element than the particular said recording element used in said first main scan, said fraction and said portion of the number of the dots together corresponding to the tone level; and repeat means for repeating the sub-scan and the second main scan to record a tone image for at least one time, so that the numbers of the dots in each of said pixels are formed using different said recording elements from each other until the tone level of said each of said pixels coincides with the tone level designated by the image data for said each of said pixels, and two adjacent said dots of said numbers of the dots in each of said pixels are not formed by two adjacent said recording elements of said plurality of recording elements arranged across a width measured in the sub-scan direction, wherein said plurality of dots are formed in individual different positions in said pixel, wherein said plurality of dots are formed in individual different positions in at least one of the direction of said first relative movement and in the sub-scan direction of said second relative movement, wherein adjacent said recording elements in said plurality of recording elements are not used concurrently in forming the dots, and wherein a condition $b/g>(N/s)-1$ is satisfied with a set of b, g, N and s, where N is the number of said plurality of recording elements of said recording head;

q is a pitch of said plurality of recording elements;

a plurality of consecutive said recording elements forming dots concurrently is arranged with a periodical distance bq where b is a natural number greater than or equal to 2;

a displacement of said second relative movement is sq, where s is a natural number greater than or equal to 2; and g is a greatest common divisor of s and b.

5. A recording apparatus as claimed in claim 4, wherein each distance between adjacent dots of said plurality of dots is different from each other in the direction of said first relative movement.

6. A recording apparatus as claimed in claim 4, wherein said plurality of dots are formed in individual different positions in response to a position of said pixel in the direction of said first relative movement.

7. A recording apparatus as claimed in claim 4, wherein a plurality of said recording heads, each of which corresponds to each of 3 or 4 colors of an ink fluid for recording, are included, and said plurality of recording elements in each of at least one couple of said plurality of recording heads are shifted relative to each other, and said plurality of dots composed of said 3 or 4 colors of an ink fluid are placed on each of corners of a triangle or rectangle in said pixel.

8. A recording apparatus for recording an image with a plurality of pixels, each pixel being composed of a plurality of dots of a number, comprising:

a recording head having a plurality of recording elements arranged across a width measured in a sub-scan direction for forming the dots on a recording medium;

data supply means for supplying an image data including a tone level information for each of said pixels to the recording head;

first scanning means for performing a first main scan by effecting a first relative movement between said recording head and said recording medium in a first direction in which each said pixel is recorded with a fraction of the number of the dots by a particular said recording element, each said number of dots corresponding to a particular said tone level for said pixel composed of said number of said dots;

sub-scanning means for performing a second relative movement between said recording head and said recording medium in a direction crossing with a movement direction of the first main scan, in which a distance of the second relative movement in the sub-scan is less than the width;

second scanning means for performing a second main scan in which each said pixel is recorded so that for each said pixel, a portion of the number of the dots are formed by a different said recording element than the particular said recording element used in said first main scan, said fraction and said portion of the number of the dots together corresponding to the tone level; and repeat means for repeating the sub-scan and the second main scan to record a tone image for at least one time, so that the numbers of the dots in each of said pixels are formed using different said recording elements from each other until the tone level of said each of said pixels coincides with the tone level designated by the image data for said each of said pixels, and two adjacent said dots of said numbers of the dots in each of said pixels are not formed by two adjacent said recording elements of said plurality of recording elements arranged across a width measured in the sub-scan direction, wherein said plurality of dots are formed in individual different positions in said pixel, and said plurality of dots are formed in individual different positions in at least one of the direction of said first relative movement and in the sub-scan direction of said second relative movement, and wherein a value of at least one of $q_1$ is different from a value of at least one of $q_2$, and said second relative movement is taken to be $q_2n/h$ at every said first relative movement, where h is the number of times of said first relative movement, n is the number of said plurality of recording elements, i is an integer 1 or over and less than or equal to (h−1), $q_1$ is a pitch between in/h-th recording element and in/h+1-th recording element, and $q_2$ is a pitch between recording elements not defining $q_1$.

* * * * *

UNITED STATES PATENT AND TRADEMARK OFFICE

CERTIFICATE OF CORRECTION

PATENT NO. : 6,513,906 B1 
DATED : February 4, 2003
INVENTOR(S) : Hideki Tanaka et al.

It is certified that error appears in the above-identified patent and that said Letters Patent is hereby corrected as shown below:

Title page,
Item [*] Notice, insert: -- This patent issued on a continued prosecution application filed under 37 CFR § 1.53(d), and is subject to the twenty year patent term provisions of 35 U.S.C. 154 (a)(2). --.
Item [56], References Cited, FOREIGN PATENT DOCUMENTS
"4361054" should read -- 4-361054 --.
"59123670" should read -- 59-123670 --;
"59138461" should read -- 59-138461 --; and
"60208251" should read -- 60-208251 --.
OTHER PUBLICATIONS, "Interface-Scan Arreys" should read -- Interface-Scan-Arrays --.

Column 14,
Line 26, "not" should read -- is not --.

Column 15,
Line 9, "i-the" should read -- i-th --; and
Line 13, "+αη*j*" should read -- +α'η*j* --.

Column 19,
Line 12, "im ages" should read -- images --.

Column 22,
Line 34, "η2" should read -- θ2 --; and
Line 63, "a" should be deleted.

Column 26,
Line 23, "represet" should read -- represent --.

Column 28,
Line 30, "ad" should read -- and --.

Column 29,
Line 12, "in," should read -- in --.

Column 30,
Line 30, "Ria" should read -- R1a --.

UNITED STATES PATENT AND TRADEMARK OFFICE

CERTIFICATE OF CORRECTION

PATENT NO. : 6,513,906 B1
DATED : February 4, 2003
INVENTOR(S) : Hideki Tanaka et al.

It is certified that error appears in the above-identified patent and that said Letters Patent is hereby corrected as shown below:

Column 31,
Line 40, "thebe" should read -- the be --.

Column 33,
Line 27, "every," should read -- every --.

Column 36,
Line 13, "in arranged" should read -- arranged --.

Column 37,
Line 47, "of,the" should read -- of the --.

Column 41,
Line 14, "position" should read -- positions --; and
Line 15, "responsive" should read -- response --.

Signed and Sealed this

First Day of June, 2004

JON W. DUDAS
*Acting Director of the United States Patent and Trademark Office*